US006137970A

United States Patent [19]

Sasago

[11] Patent Number: 6,137,970

[45] Date of Patent: Oct. 24, 2000

[54] CARTRIDGE DETACHABLY DETACHABLE TO A MAIN BODY OF AN IMAGE FORMING APPARATUS AND AN IMAGE FORMING APPARATUS DETECTING WHETHER A SEAL MEMBER OF THE CARTRIDGE IS REMOVED THEREFROM

[75] Inventor: Yoshikazu Sasago, Toride, Japan

[73] Assignee: Canon Kabushiki Kaisha, Tokyo, Japan

[21] Appl. No.: 09/273,269

[22] Filed: Mar. 22, 1999

[30] Foreign Application Priority Data

Mar. 26, 1998 [JP] Japan ..... 10-098590

[51] Int. Cl.[7] ..... G03G 15/08

[52] U.S. Cl. ..... 399/106; 399/30; 399/111

[58] Field of Search ..... 399/30, 103, 104, 399/105, 106, 119, 111

[56] References Cited

U.S. PATENT DOCUMENTS

| | | | |
|---|---|---|---|
| 5,153,650 | 10/1992 | Maeshima | 399/106 |
| 5,331,372 | 7/1994 | Tsuda et al. . | |
| 5,404,198 | 4/1995 | Noda et al. . | |
| 5,436,704 | 7/1995 | Moon | 399/30 X |
| 5,470,635 | 11/1995 | Shirai et al. | 428/81 |
| 5,475,470 | 12/1995 | Sasago et al. . | |
| 5,488,459 | 1/1996 | Tsuda et al. . | |
| 5,510,878 | 4/1996 | Noda et al. . | |
| 5,602,623 | 2/1997 | Nishibata et al. | 399/111 |
| 5,608,509 | 3/1997 | Shirai et al. | 399/351 |
| 5,623,328 | 4/1997 | Tsuda et al. | 399/111 |
| 5,635,972 | 6/1997 | Maruyama et al. | 399/30 X |
| 5,659,847 | 8/1997 | Tsuda et al. | 399/113 |
| 5,669,042 | 9/1997 | Kobayashi et al. | 399/111 |
| 5,671,465 | 9/1997 | Kimura et al. | 399/119 |
| 5,749,027 | 5/1998 | Ikemoto et al. | 399/113 |
| 5,774,766 | 6/1998 | Karakama et al. | 399/111 |
| 5,794,101 | 8/1998 | Watanabe et al. | 399/103 |
| 5,828,928 | 10/1998 | Sasago et al. . | |
| 5,878,310 | 3/1999 | Noda et al. | 399/117 |
| 5,890,036 | 3/1999 | Karakama et al. | 399/119 |
| 5,899,602 | 5/1999 | Noda et al. | 399/111 |
| 5,920,752 | 7/1999 | Karakama et al. | 399/111 |
| 5,943,528 | 8/1999 | Akutsu et al. | 399/110 |

FOREIGN PATENT DOCUMENTS

| | | |
|---|---|---|
| 63-214765 | 9/1988 | Japan . |
| 1-188878 | 7/1989 | Japan . |
| 2-51182 | 2/1990 | Japan . |

*Primary Examiner*—Susan S. Y. Lee
*Attorney, Agent, or Firm*—Fitzpatrick, Cella, Harper & Scinto

[57] ABSTRACT

A cartridge detachably attachable to a main body of an image forming apparatus which includes a developing device, and the developing device includes a developer containing container, a developing container having a developer bearing member, a removable seal member for covering the opening portion, and a detecting portion for detecting an amount of the developer within the developing container, and the main body of the image forming apparatus detecting whether the seal member is removed or not by detecting the detecting portion by the main body of the image forming apparatus.

30 Claims, 37 Drawing Sheets

12
12i1
12i2
12B
9h1 (122)
12j
12s1
12i
12b
12s
12s2
12h
9h
9e
11
9d3
9d4
9d6
9d1a
9d
9d1
9d2
9d5
9d4
9d6
9v
9i
G
9c
9i
9p
9k
9p1
9g1
12s1
12j
12i2
12g
12i3
9w
12f
12g
12A
9j5
9j
9j1
9j1
9j4

FIG. 26A
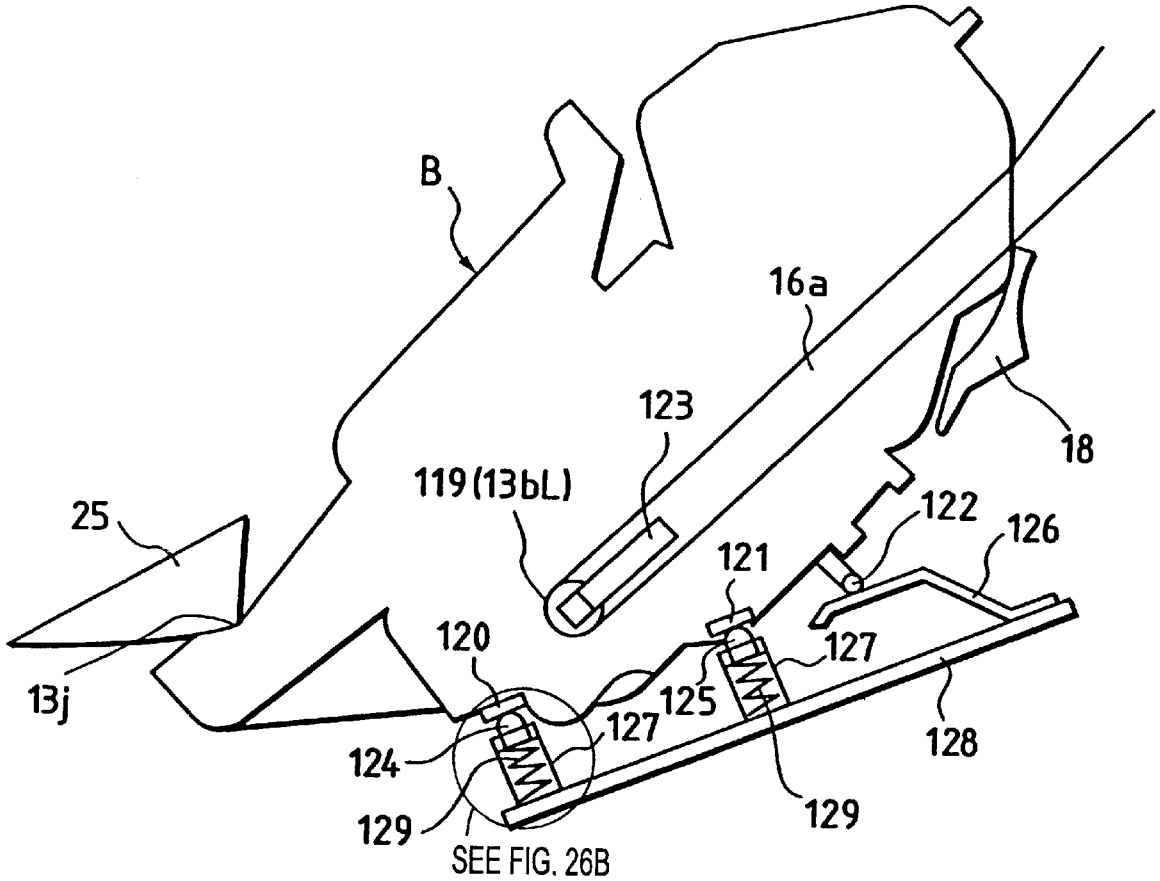
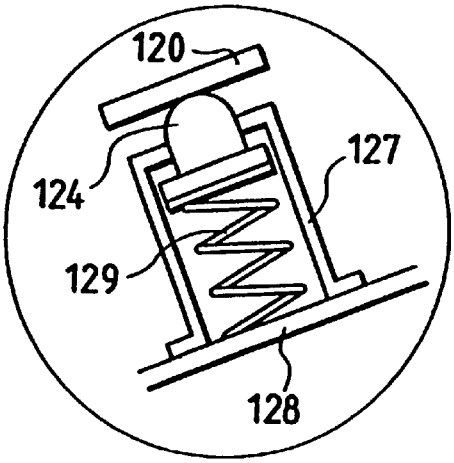
FIG. 26B

CARTRIDGE DETACHABLY DETACHABLE TO A MAIN BODY OF AN IMAGE FORMING APPARATUS AND AN IMAGE FORMING APPARATUS DETECTING WHETHER A SEAL MEMBER OF THE CARTRIDGE IS REMOVED THEREFROM

BACKGROUND OF THE INVENTION

1. Field of the Invention

The present invention relates to, an image forming apparatus such as an electrophotographic copying machine, and an electrophotographic printer and the like, and a process cartridge detachable to such an image forming apparatus.

2. Related Background Art

In the past, in electrophotographic image forming apparatuses, such as electrophotographic copying machines, if the apparatus has been used for a long time, replacement of an electrophotographic photosensitive drum, replacement of a developing device, replenishment of toner (developer), cleaning of a charger, replacement of a cleaning contained filled with waste toner and adjustment of the electrophotographic photosensitive drum and therearound, have been required.

Thus, conventionally, in the electrophotographic image forming apparatus using an electrophotographic image forming process, the electrophotographic photosensitive drum and process means acting on the drum are integrally incorporated as a cartridge unit which can detachably be mounted to the electrophotographic image forming apparatus, thereby forming a process cartridge.

According to this system, since the maintenance of the electrophotographic image forming apparatus can be effected by the used himself, operability could be improved considerably. Therefore, such a process cartridge has widely been used in the electrophotographic image forming apparatus.

In such a process cartridge, before the process cartridge is mounted to the electrophotographic image forming apparatus, by pulling a toner seal member out of the process cartridge, an opening portion of a developer container as a developer frame containing toner is opened, so that the toner can be supplied to a developing means, such as a developing roller, provided within a developing container. Further, also in a developing cartridge, a seal member is provided on an opening portion between the developer container and the developing container, which seal member can be removed later.

Further, in such an electrophotographic image forming apparatus, if the toner (developer) becomes insufficient during the image forming operation, since an inconvenience such as reduction of image density or poor image, occurs, normally, a remaining amount of toner within the process cartridge is always monitored so that the toner can be replenished before the inconvenience, such as the reduction of the image density, occurs, so that, if the toner becomes insufficient, such a fact is displayed and warns the user.

SUMMARY OF THE INVENTION

The present invention relates to an improvement in the above-mentioned conventional technique, and a main object of the present invention is to provide a cartridge in which, when the cartridge is mounted to a main body of an image forming apparatus, the fact that a seal member is not removed can be detected.

Another object of the present invention is to inform the user of the fact that a seal member is not removed before an image is outputted, when a cartridge is mounted to the main body of the image forming apparatus.

The other object of the present invention is to provide an image forming apparatus in which a malfunction of a cartridge, which may be caused by rotating a developing means of the cartridge where the seal member is not yet removed, can be prevented.

BRIEF DESCRIPTION OF THE DRAWINGS

FIG. 26 is an elevational sectional view showing a relation between electrical contacts when the process cartridge is mounted to the main body of the electrophotographic image forming apparatus;

DESCRIPTION OF THE PREFERRED EMBODIMENTS

First Embodiment

Now, a first embodiment of the present invention will be fully described with reference to the accompanying drawings.

In the following description, the width-wise direction of a process cartridge B is referred to as a direction along which the process cartridge B is mounted and dismounted with respect to a body of an electrophotographic image forming apparatus (referred to as "main body of apparatus" hereinafter) 14 and coincides with a recording medium conveying direction. The longitudinal direction of the process cartridge B is referred to as a direction transverse to the direction (substantially perpendicular to the direction) along which the process cartridge B is mounted and dismounted with respect to the apparatus body 14 and parallel with a surface of the recording medium and transverse to (substantially perpendicular to) the recording medium conveying direction. Further, "left" and "right" with respect to the process cartridge B are left and right when the recording medium is looked at from above along the recording medium conveying direction.

Figure 1:
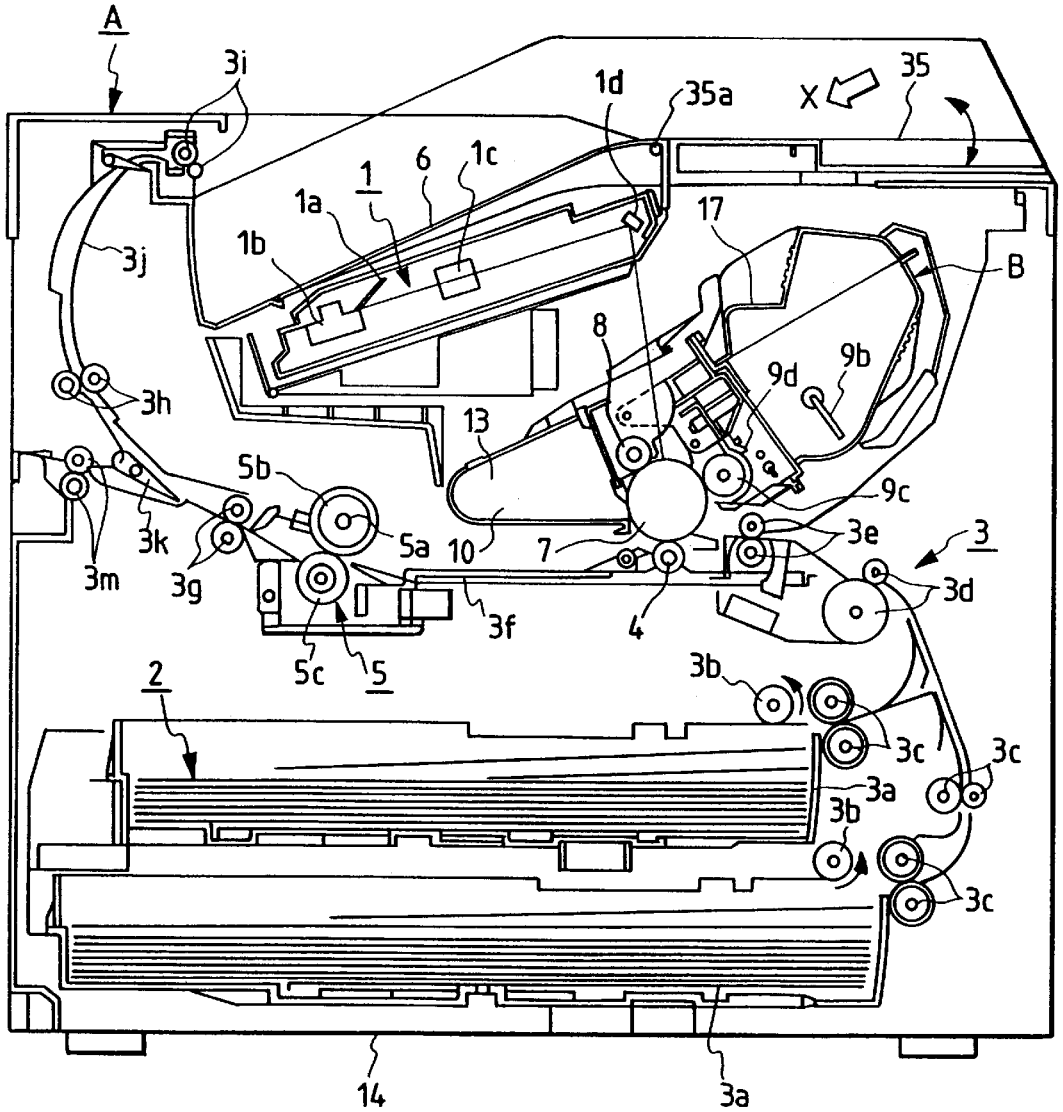
FIG. 1 is an elevational sectional view of an electrophotographic image forming apparatus.
Figure 2:
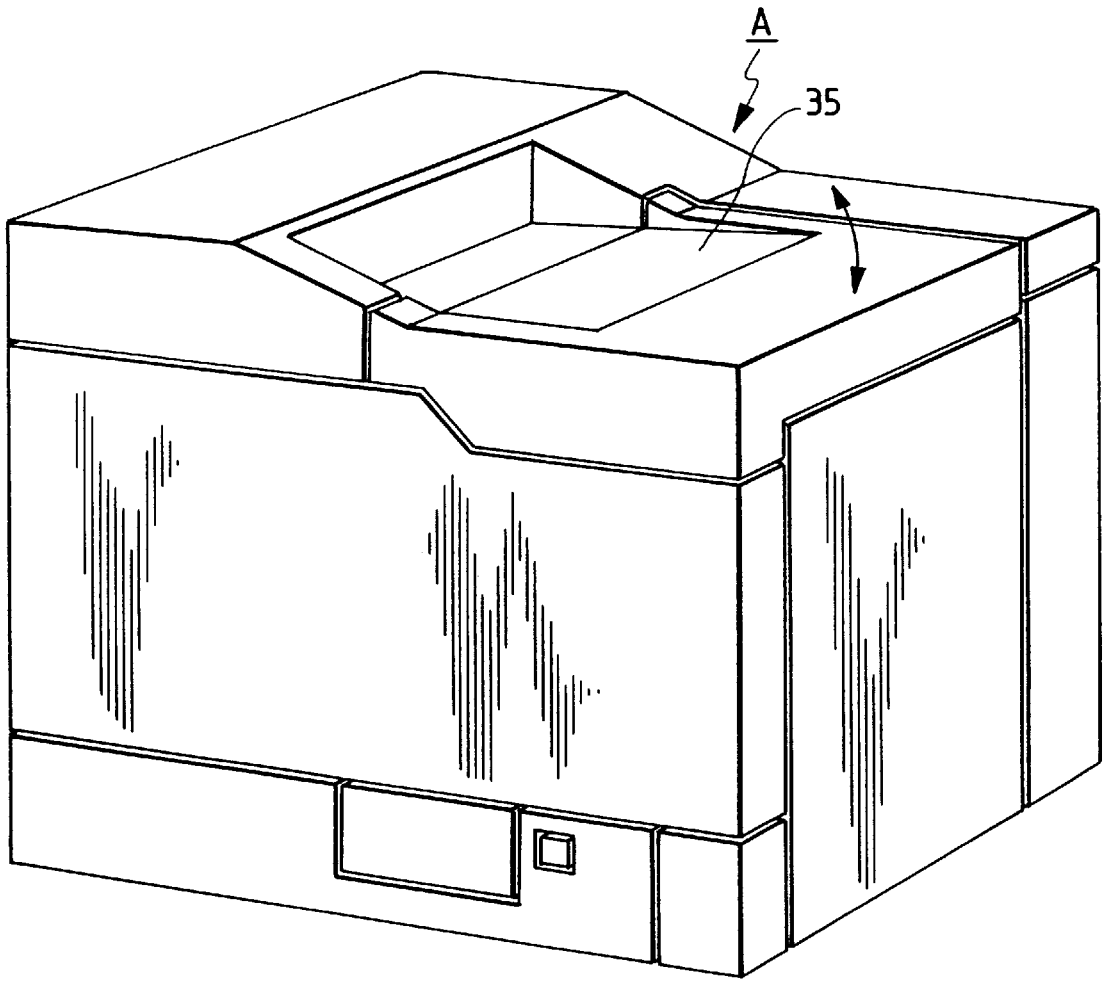
FIG. 2 is a perspective view of the electrophotographic image forming apparatus shown in FIG. 1.
Figure 3:
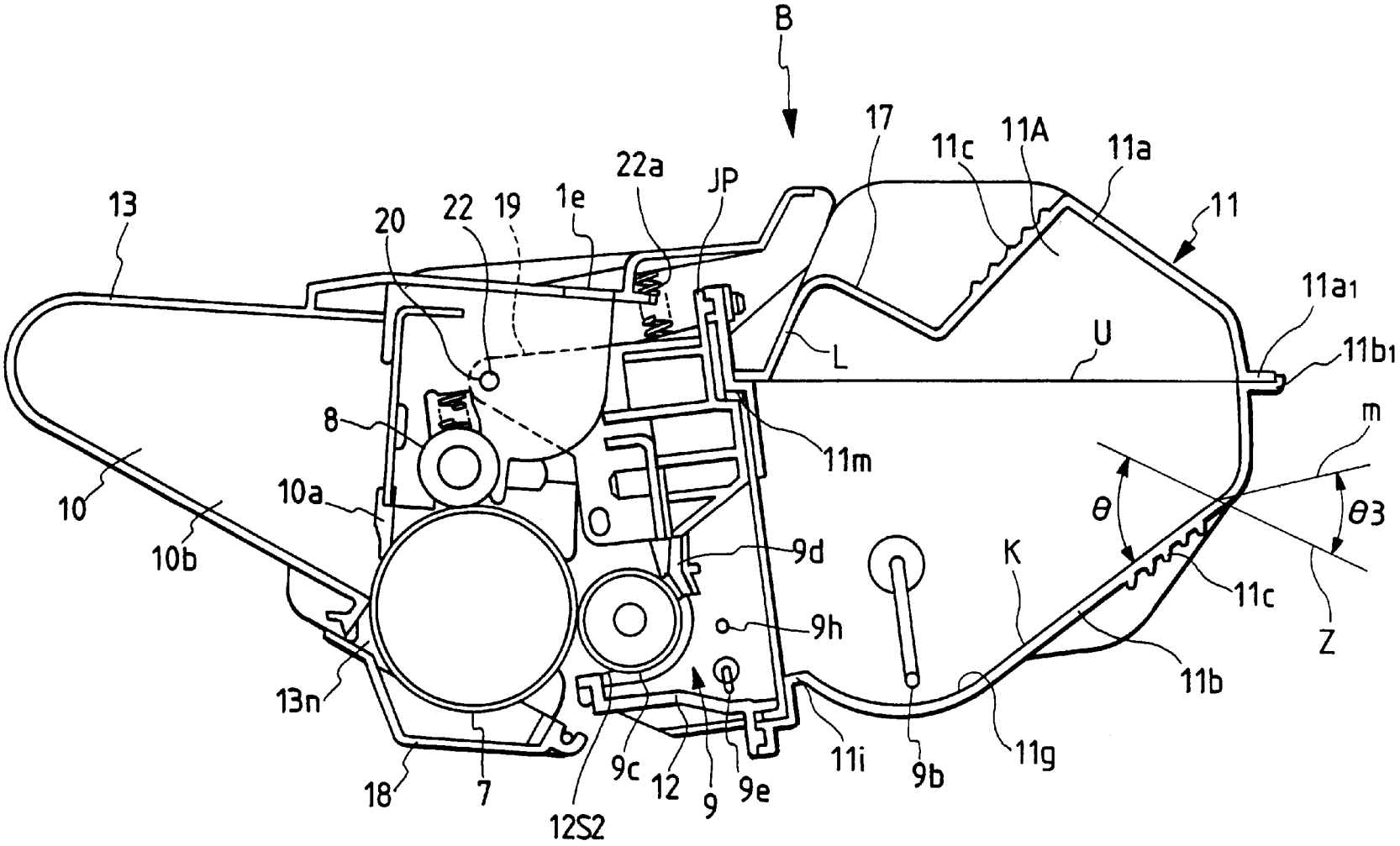
FIG. 3 is an elevational sectional view of a process cartridge.
Figure 4:
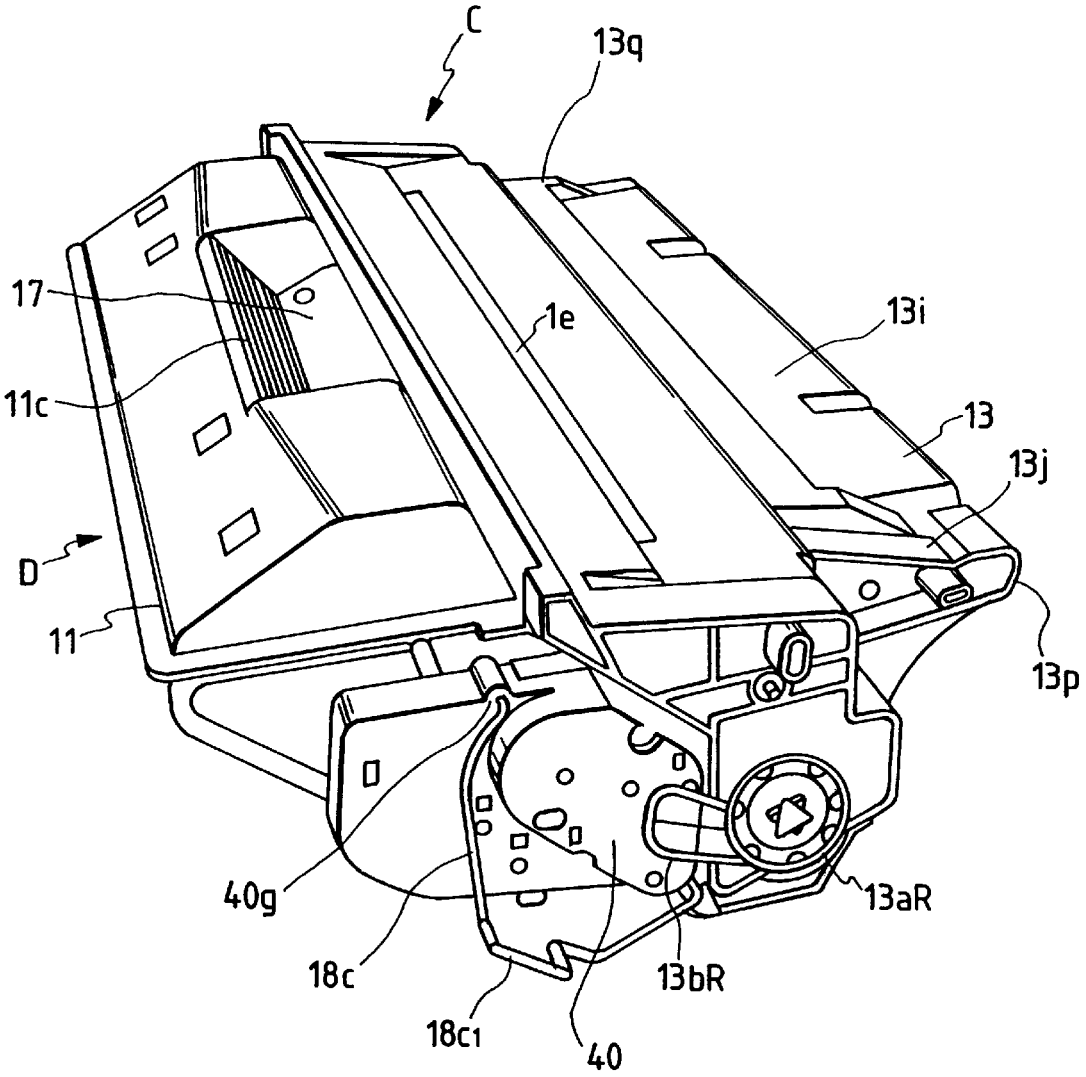
FIG. 4 is a perspective view of the process cartridge of FIG. 3, looked at from above and the right.
Figure 5:
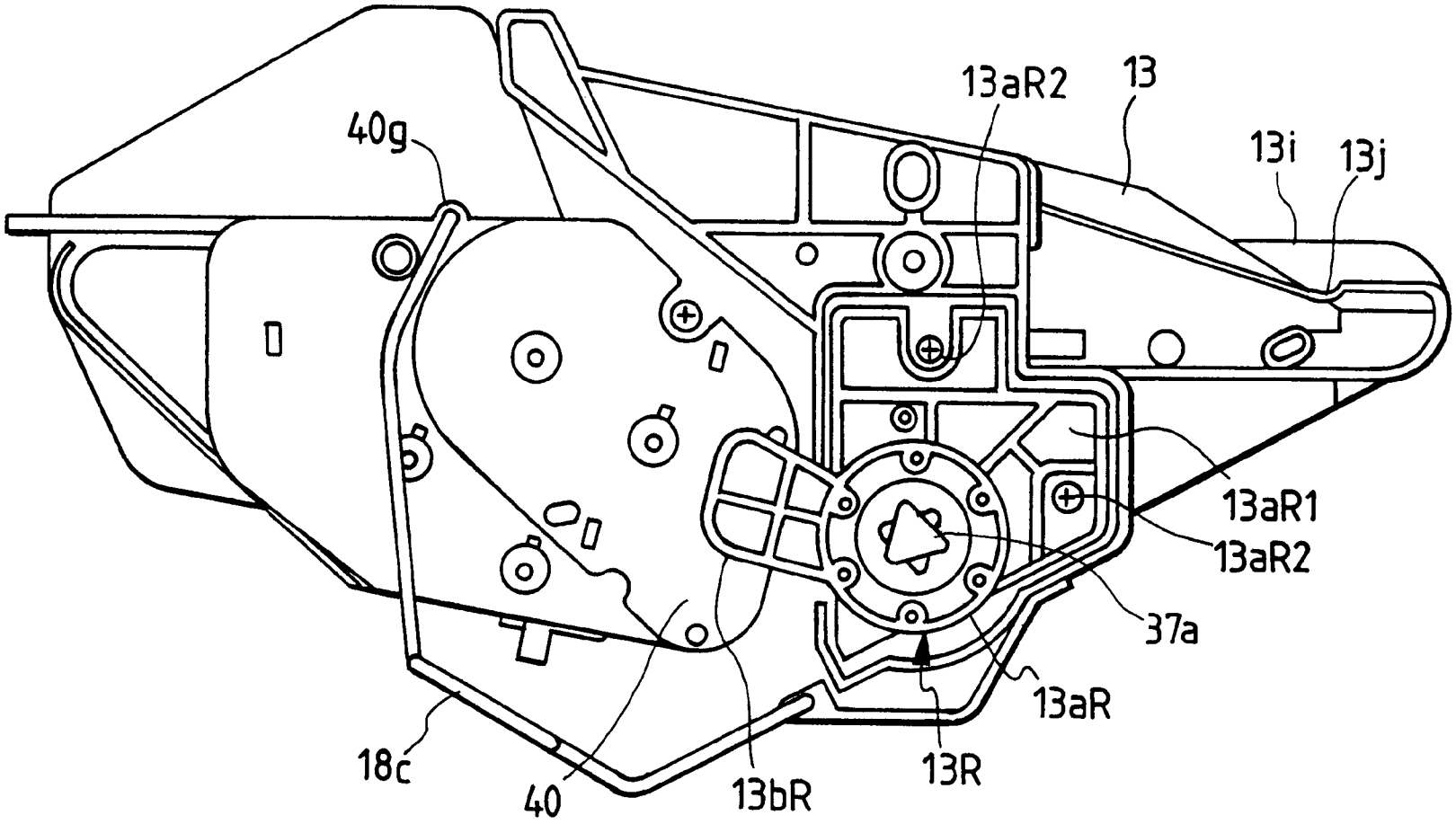
FIG. 5 is a right side view of the process cartridge of FIG. 3.
Figure 6:
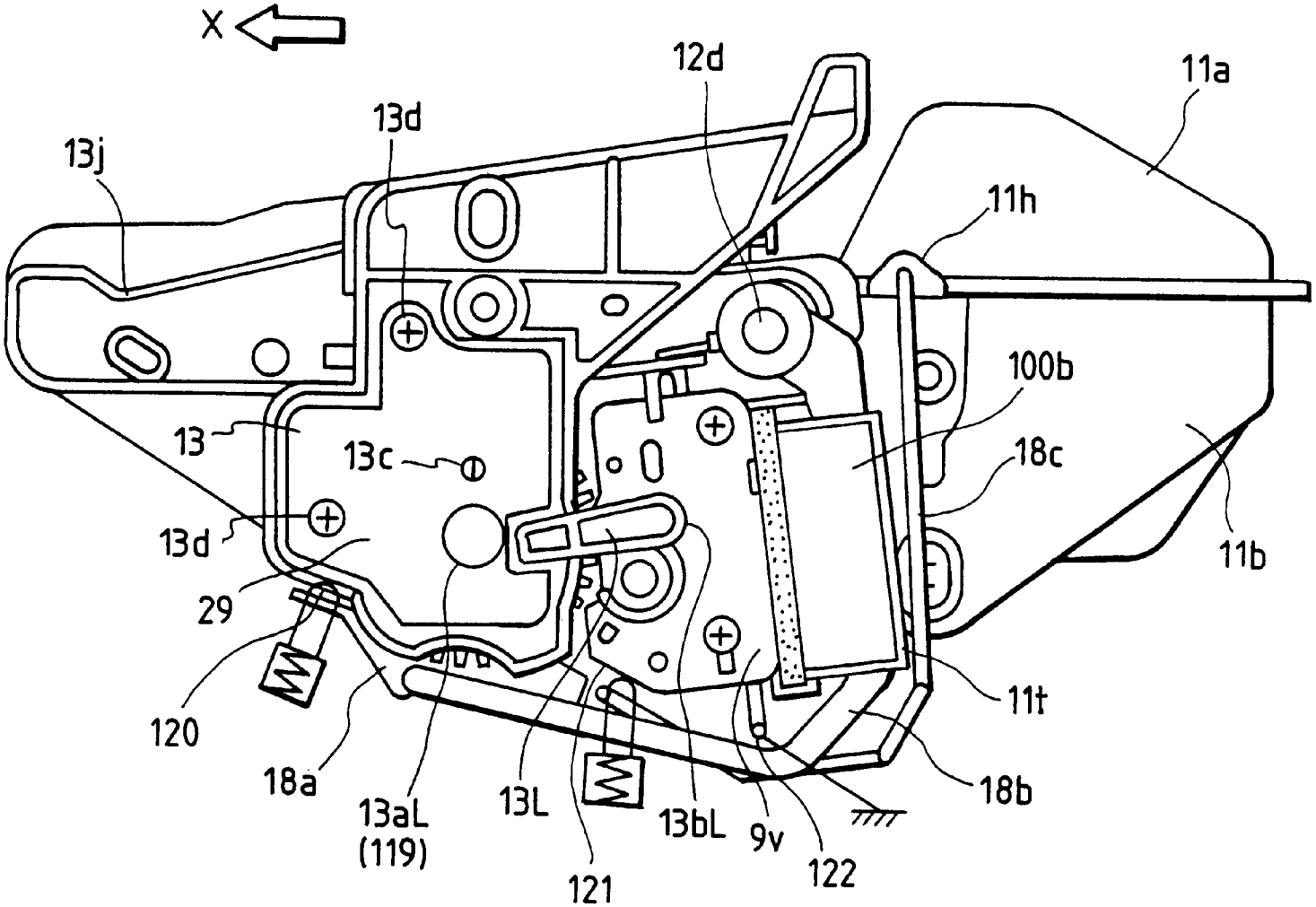
FIG. 6 is a left side view of the process cartridge of FIG. 3.
Figure 7:
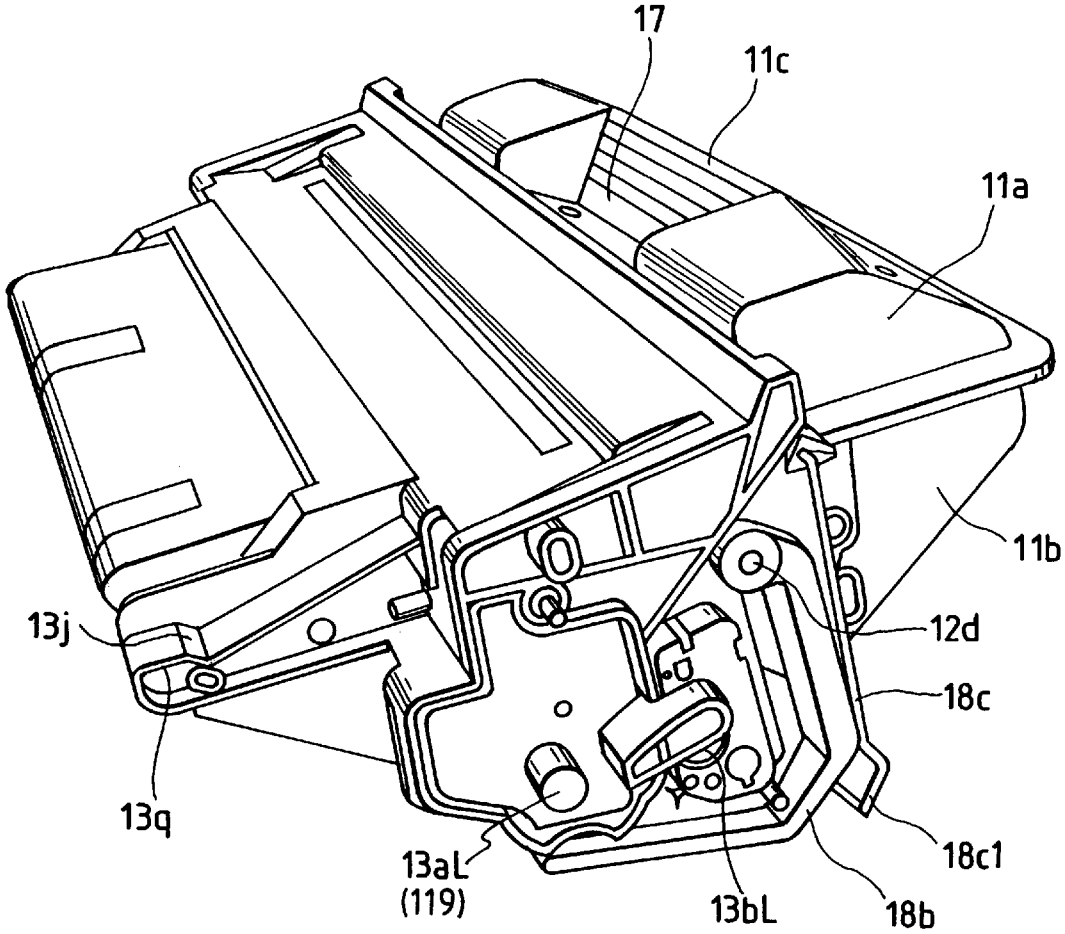
FIG. 7 is a perspective view of the process cartridge of FIG. 3, looked at from above and the left.
Figure 8:
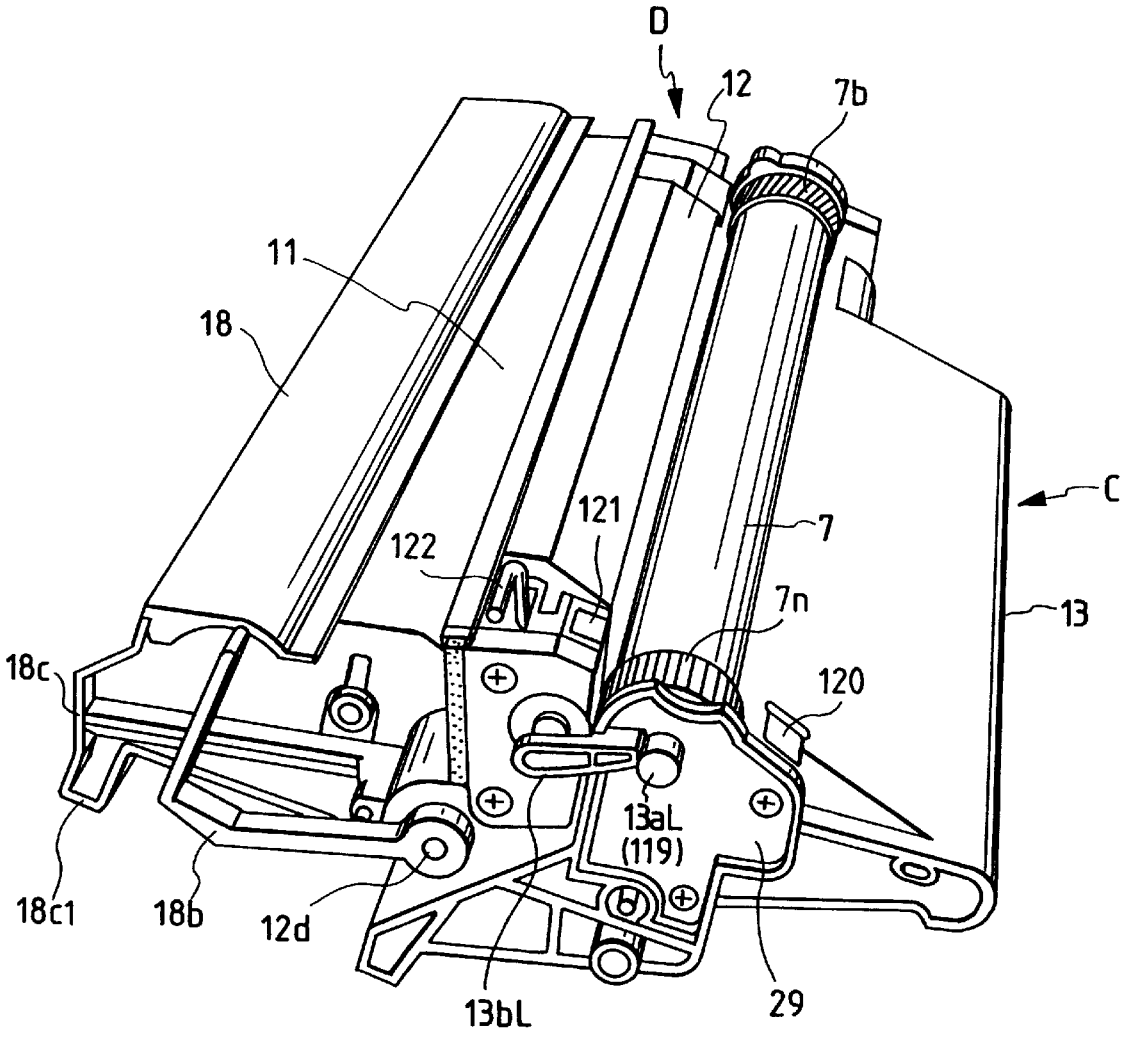
FIG. 8 is a perspective view of the process cartridge of FIG. 3, looked at from above and the left.

FIG. 1 is a constructural explanatory view of an electrophotographic image forming apparatus (laser beam printer) to which a first embodiment of the present invention is applied, and FIG. 2 is a perspective view of the image forming apparatus. Further, FIGS. 3 to 8 are views showing a process cartridge to which the first embodiment of the present invention is applied. FIG. 3 is a side sectional view of the process cartridge, FIG. 4 is a perspective view of the process cartridge, FIG. 5 is a right side view of the process cartridge, FIG. 6 is a left side view of the process cartridge, FIG. 7 is a perspective view of the process cartridge, looked at from above, and FIG. 8 is a perspective view of the process cartridge turned over, looked at from above. Further, in the following description, an upper surface of the process cartridge B is referred to as a face directed upwardly in a condition that the process cartridge B is mounted to the main body 14 of the apparatus, and a lower surface is referred to as a face directed downwardly.

The electrophotographic image forming apparatus serves to form an image on the recording medium by using an electrophotographic image forming process. The electrophotographic image forming apparatus may be, for example, an electrophotographic copying machine, an electrophotographic printer (for example, a laser beam printer, an LED printer and the like), an electrophotographic word processor or the like.

Since the process cartridge can be attached and detached with respect to the main body of the electrophotographic image forming apparatus by the operator himself, the maintenance of the electrophotographic image forming apparatus can be facilitated.

Electrophotographic Image Forming Apparatus A and Process Cartridge B

First of all, a laser beam printer (electrophotographic image forming apparatus) A to which the first embodiment is applied will be explained with reference to FIGS. 1 and 2. Further, FIG. 3 is a side sectional view of the process cartridge B, and FIG. 41 is a constructural block diagram showing a control system for the electrophotographic image forming apparatus and the process cartridge B.

As shown in FIG. 1, the laser beam printer A serves to form an image on a recording medium (for example, recording sheet, OHP sheet, cloth or the like) by using an electrophotographic image forming process. A toner image is formed on a drum-shaped electrophotographic photosensitive body (referred to as "photosensitive drum" hereinafter). More specifically, the photosensitive drum is charged by a charge means, and then, a latent image corresponding to image information is formed on the photosensitive drum by illuminating the photosensitive drum with a laser beam (corresponding to the image information) from an optical means. Then, the latent image is developed by a developing means to form a toner image. In synchronism with formation of the toner image, a recording medium 2 is picked up from a sheet supply cassette 3*a* and is reverse-conveyed by means of a pick-up roller 3*b*, pairs of convey rollers 3*c*, 3*d* and a pair of registration rollers 3*e*. Then, the toner image formed on the photosensitive drum 7 of the process cartridge B is transferred onto the recording material 2 by applying voltage to a transfer roller (transfer means) 4. Thereafter, the recording material 2 to which the toner image was transferred is conveyed to a fixing means 5 by a convey guide 3*f*. The fixing means 5 comprises a drive roller 5*c* and a fixing roller 5*b* containing a heater 5*a* therein. The toner image is fixed onto the recording medium 2 by applying heat and pressure to the recording medium while the recording medium is being passed through the fixing means. Thereafter, the recording medium 2 is conveyed through a reverse path 3*j* by pairs of discharge rollers 3*g*, 3*h*, 3*i* to be discharged onto a discharge tray 6. The discharge tray 6 is formed on an upper surface of the apparatus body 14 of the image forming apparatus A. Incidentally, by actuating a rockable flapper 3*k*, the recording medium 2 can be discharged by a pair of discharge rollers 3*m* without passing through the reverse path 3*j*. In the illustrated embodiment, the pick-up roller 3*b*, the pairs of convey rollers 3*c*, 3*d*, pair of registration rollers 3*e*, the guide 3*f*, pairs of discharge rollers 3*g*, 3*h*, 3*i* and pair of discharge rollers 3*m* constitute a convey means 3.

Figure 41:
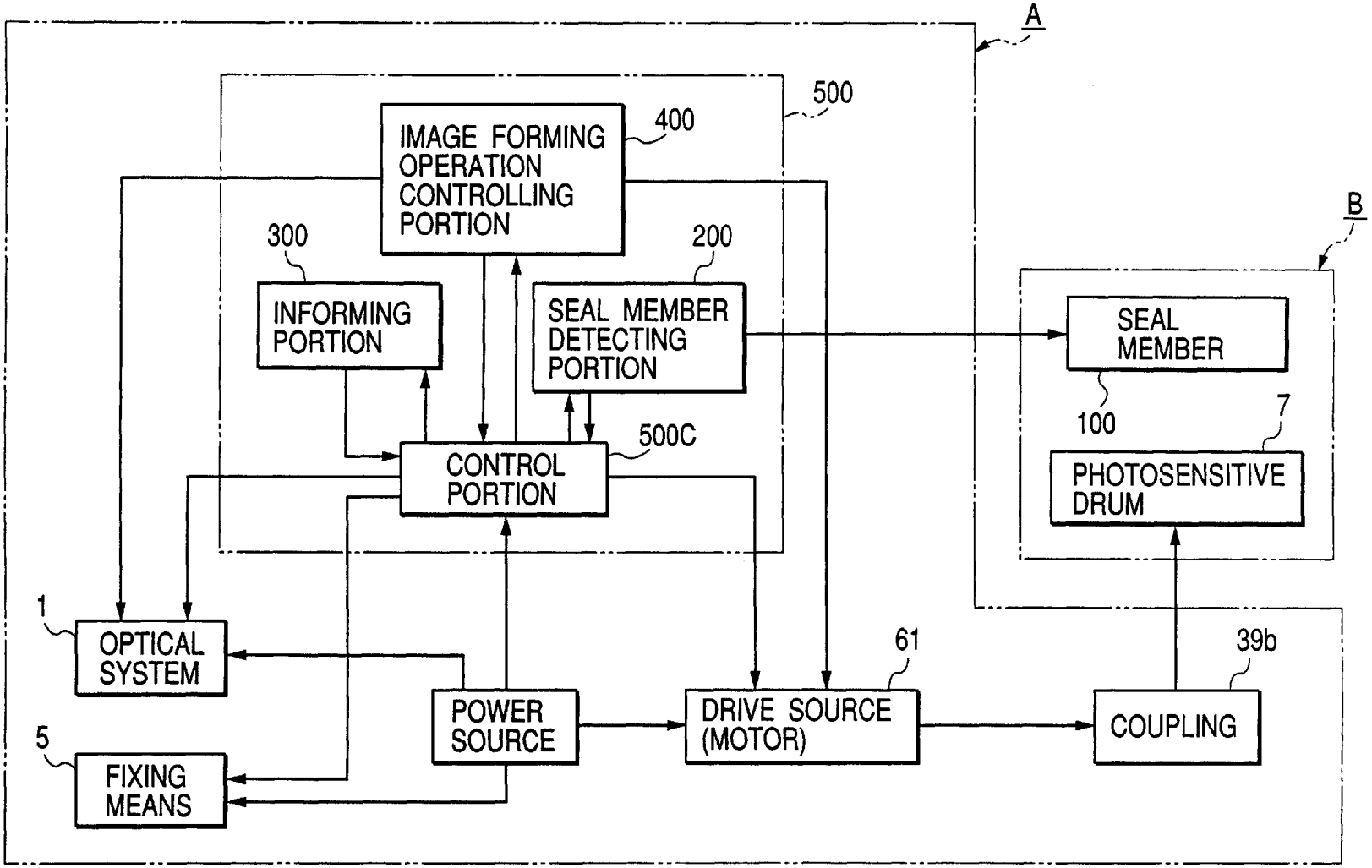
FIG. 41 is a block diagram of the electrophotographic image forming apparatus and the process cartridge.

As shown in FIG. 41, the image forming apparatus A includes a seal member detecting portion (seal member detecting means) 200 for detecting the fact that a seal member 100 (described later) of the process cartridge B is not removed, an informing portion (informing means) 300 for informing the operator of the fact that the seal member 100 is not removed, an image forming operation controlling portion (image forming operation controlling means) 400 for inhibiting an image forming operation if the seal member 100 is not removed, and a toner remaining amount detecting portion (developer amount detecting means) and further includes a control portion 500C for controlling the optical system 1, the fixing means 5, a motor (drive source) 61, the seal member detecting portion 200, the informing portion 300 and the image forming operation controlling portion 400.

The seal member detecting portion 200, the informing portion 300, the image forming operation controlling portion 400 and control portion 500C are provided in a the control means 500 which will be described later.

As shown in FIGS. 3 to 8, in the process cartridge B, while the photosensitive drum 7 having a photosensitive layer 7*e* (FIG. 11) is being rotated, a surface of the drum is uniformly charged by applying voltage to a charge roller (charge means) 8. Then, the laser beam corresponding to the image information and emitted from the optical system 1 illuminates onto the photosensitive drum 7 through an exposure opening portion 1*e*, thereby forming the latent image. The latent image is developed with toner by a developing means 9. More particularly, the charge roller 8 is contacted with the photosensitive drum 7 to charge the photosensitive drum 7. The charge roller 8 is rotatingly driven by rotation of the photosensitive drum 7. The developing means 9 serves to supply the toner to a developing area of the photosensitive drum 7, thereby developing the latent image formed on the photosensitive drum 7. Incidentally, the optical system 1 includes a laser diode 1*a*, a polygon mirror 1*b*, a lens 1*c* and a reflection mirror 1*d*.

In the developing means 9, magnetic toner in a toner container (developer container) 11A is fed to a developing roller 9*c* within a developing container by rotation of a toner feed member 9*b*. While the developing roller (developer bearing member) 9*c* having a fixed magnet therein is being rotated, a toner layer (to which frictional charges are given by a developing blade 9*d*) is formed on a surface of the developing roller 9*c*, thereby supplying the toner to the developing area of the photosensitive drum 7. By transferring the toner onto the photosensitive drum 7 in correspondence to the latent image, the latent image is visualized as the toner image. The developing blade 9*d* serves to regulate the amount of the toner on a peripheral surface of the developing roller 9*c* and to apply the frictional charges. A toner agitating member 9*e* for circulating the toner within the developing chamber is rotatably disposed within a developing chamber in the vicinity of the developing roller 9*c*.

After the toner image formed on the photosensitive drum 7 is transferred to the recording medium 2 by applying to the transfer roller voltage having polarity opposite to that of the toner image, residual toner remaining on the photosensitive drum 7 is removed by a cleaning means 10. In the cleaning means 10, the residual toner remaining on the photosensitive drum 7 is scraped by an elastic cleaning blade 10*a* urged against the photosensitive drum 7, and the waste toner is collected into a waste toner reservoir 10*b*.

Incidentally, in the process cartridge B, a toner frame 11 as a developer container having the toner container (toner containing portion) 11A and a developing frame 12 as the developing container holding the developing means 9 such as the developing roller 9*c* are joined together. Further, a cleaning frame 13 to which the photosensitive drum 7, the cleaning means 10, such as the cleaning blade 10*a*, and the charge roller 8 are attached, is joined to the assembly. The process cartridge B can detachably be mounted to the body 14 of the image forming apparatus by the operator.

The process cartridge B is provided with the exposure opening portion 1*e*, through which the laser beam, corresponding to the image information, illuminates the photosensitive drum 7, and a transfer opening portion 13*n* through which the photosensitive drum 7 is opposed to the recording medium 2. More specifically, the exposure opening portion 1*e* is formed in the cleaning frame 13 and the transfer opening portion 13*n* is defined between the developing frame 12 and the cleaning frame 13.

Next, a housing of the process cartridge B according to the illustrated embodiment will be described.

In the process cartridge B according to the illustrated embodiment, the toner frame 11 and the developing frame 12 are joined together as an assembly to which the cleaning frame 13 is rotatably joined to form a housing in which the photosensitive drum 7, the charge roller 8, the developing means 9 and the cleaning means 10 are contained. The process cartridge B is detachably mounted to a cartridge mounting means of the main body (body) 14 of the image forming apparatus.

As mentioned above, the process cartridge B according to the illustrated embodiment has the housing constituted by joining the toner frame 11, the developing frame 12 and the cleaning frame 13. Now, the construction of the housing will be described.

Figure 13:
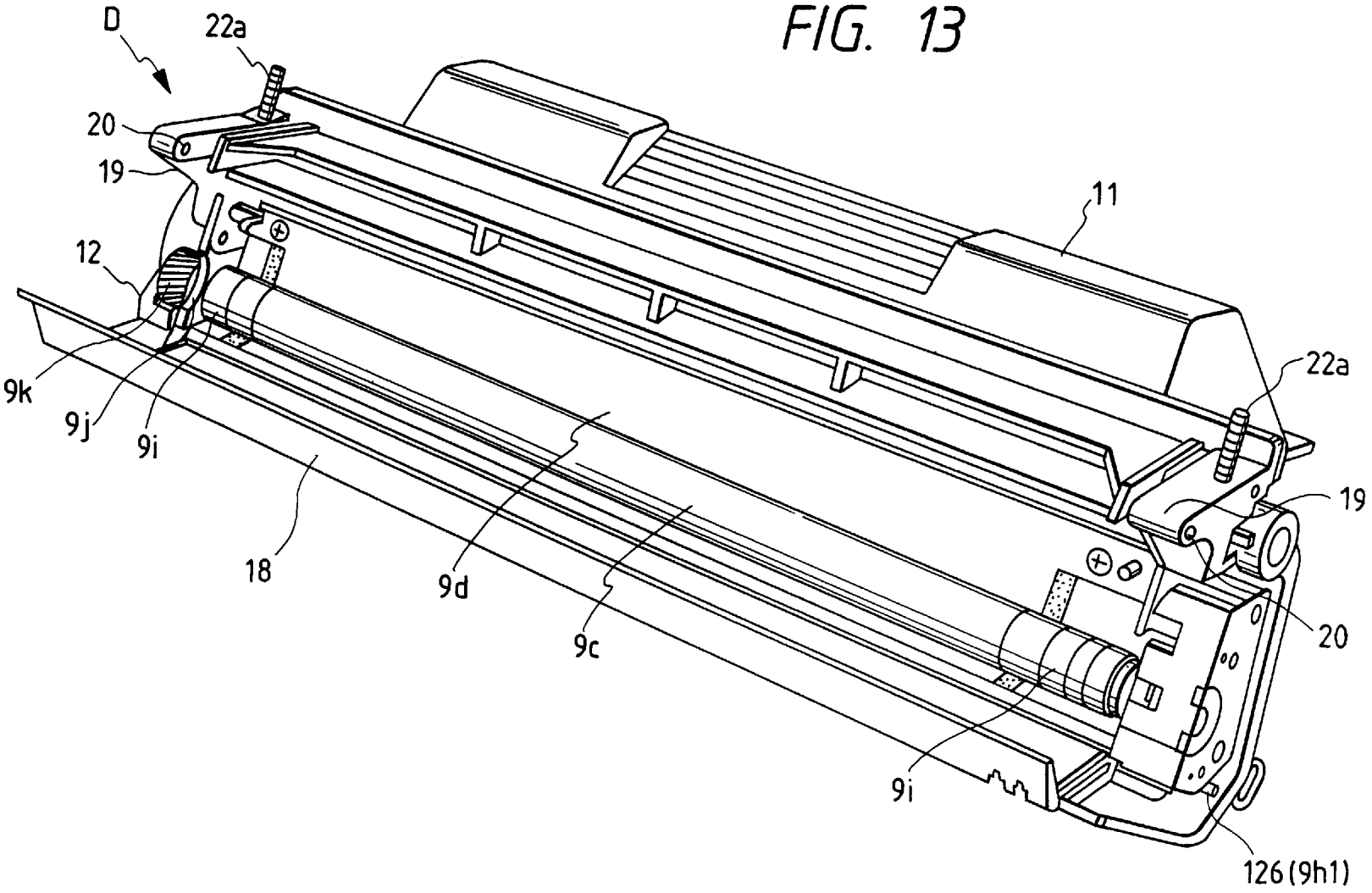
FIG. 13 is a perspective view of a developing unit.
Figure 19:
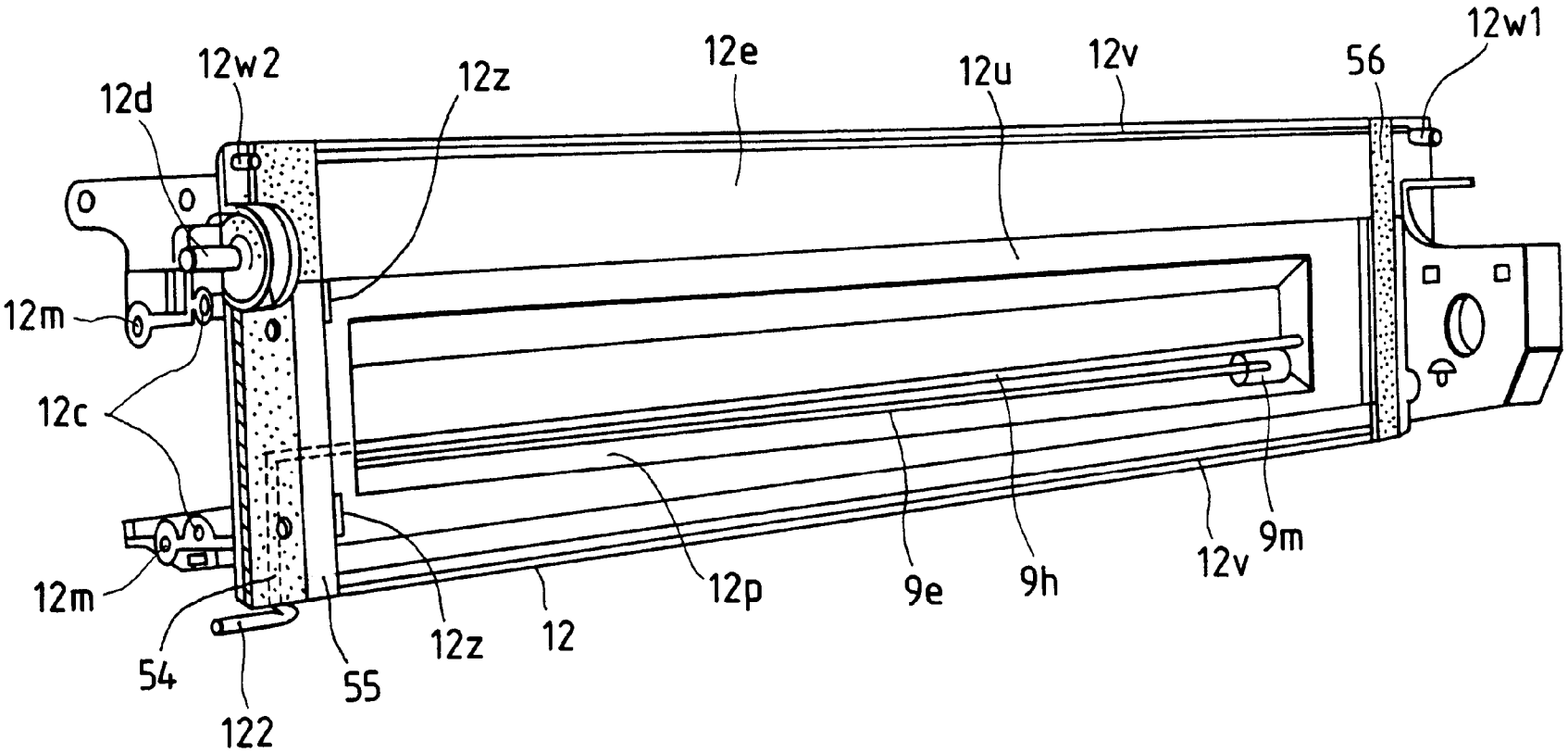
FIG. 19 is a perspective view of the developing frame.
Figure 20:
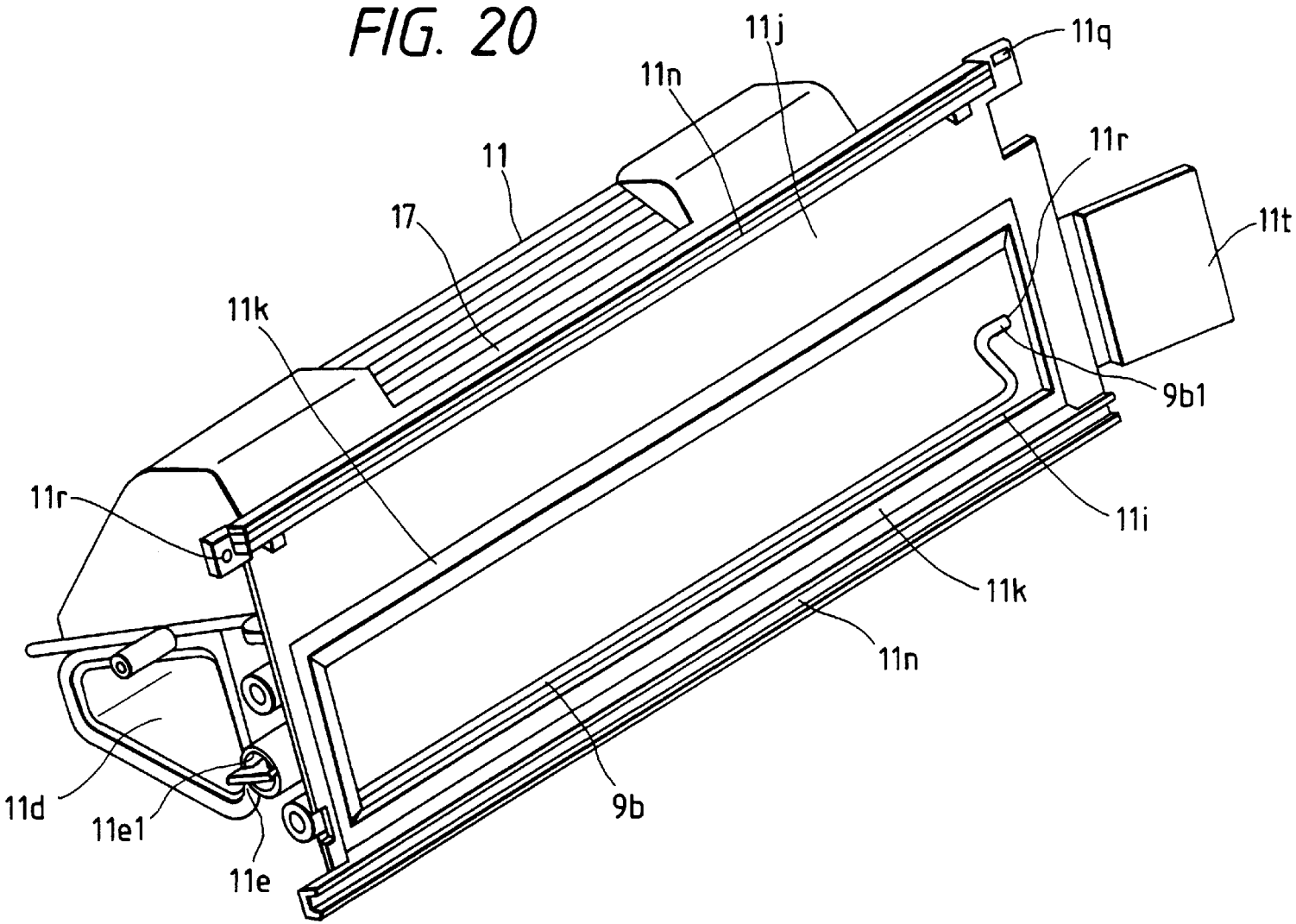
FIG. 20 is a perspective view of the toner frame.

As shown in FIGS. 3 and 20, the toner feed member 9*b* is attached to the toner frame 11. The developing roller 9*c* and the developing blade 9*d* are attached to the developing frame 12, and the agitating member 9*e* for circulating the toner within the developing chamber is rotatably disposed in the vicinity of the developing roller 9*c*. Further, as shown in FIGS. 3 and 19, an antenna rod 9*h* extending along a longitudinal direction of the developing roller 9*c* is attached to the developing frame 12 substantially in parallel with the developing roller 9*c*. The toner frame 11 and the developing frame 12 are welded (by ultrasonic welding in the illustrated embodiment) together to form a developing unit (second frame) D (FIG. 13).

A drum shutter member 18 for covering the photosensitive drum 7, to protect the latter from long-term exposure or contact with foreign matters when the process cartridge B is dismounted from the body 14 of the image forming apparatus, is attached to the toner developing frame D.

As shown in FIG. 6, the drum shutter 18 comprises a shutter cover 18*a* for opening and closing the transfer opening portion 13*n*, and links 18*b*, 18*c* for supporting the shutter cover 18*a*. At both longitudinal ends of the shutter cover 18*a* and an upstream side in the recording medium conveying direction, as shown in FIGS. 4 and 5, one end of the right link 18*c* is pivotally connected to a hole 40*g* of the developing holder 40, and, as shown in FIGS. 6 and 7, one end of the left link 18*c* is pivotally connected to a boss 11*h* provided on a lower frame portion 11*b* of the toner frame 11. The other ends of both links 18*c* are pivotally connected to an upstream end of the shutter cover 18*a* in a cartridge mounting direction. The links 18*c* are formed from metal wires, and portions thereof pivotally connected to the shutter cover 18*a* are interconnected between both sides of the process cartridge B so that the left and right links 18*c* are integral with each other. On the other hand, the link 18*b* is arranged only at one side of the shutter cover 18*a* and has one end pivotally connected to the shutter cover 18*a* at a downstream end in the recording medium-conveying direction with respect to points where the links 18*c* are pivotally connected, and has the other end pivotally connected to a dowel 12*d* of the developing frame 12. The link 18*b* is formed from synthetic resin.

The links 18*b*, 18*c* have different lengths and are combined with a link constituted by the shutter cover 18*a*, the toner frame 11 and the developing frame 12 to form a quadric linkage mechanism. Projections 18*c*1 provided on the links 18*c* and protruding laterally abut against fixed members (not shown) provided near a cartridge mounting space S of the body 14 of the image forming apparatus, so that, when the process cartridge B is shifted, the drum shutter member 18 is operated to open the shutter cover 18*a*.

The drum shutter member 18, comprised of the shutter cover 18*a* and the links 18*b*, 18*c*, is biased to cause the shutter cover 18*a* to close the transfer opening portion 13*n*, by means of a torsion coil spring (not shown) inserted into the dowel 12*d* and having one end locked to the link 18*b* and the other end locked to the developing frame 12.

Figure 12:
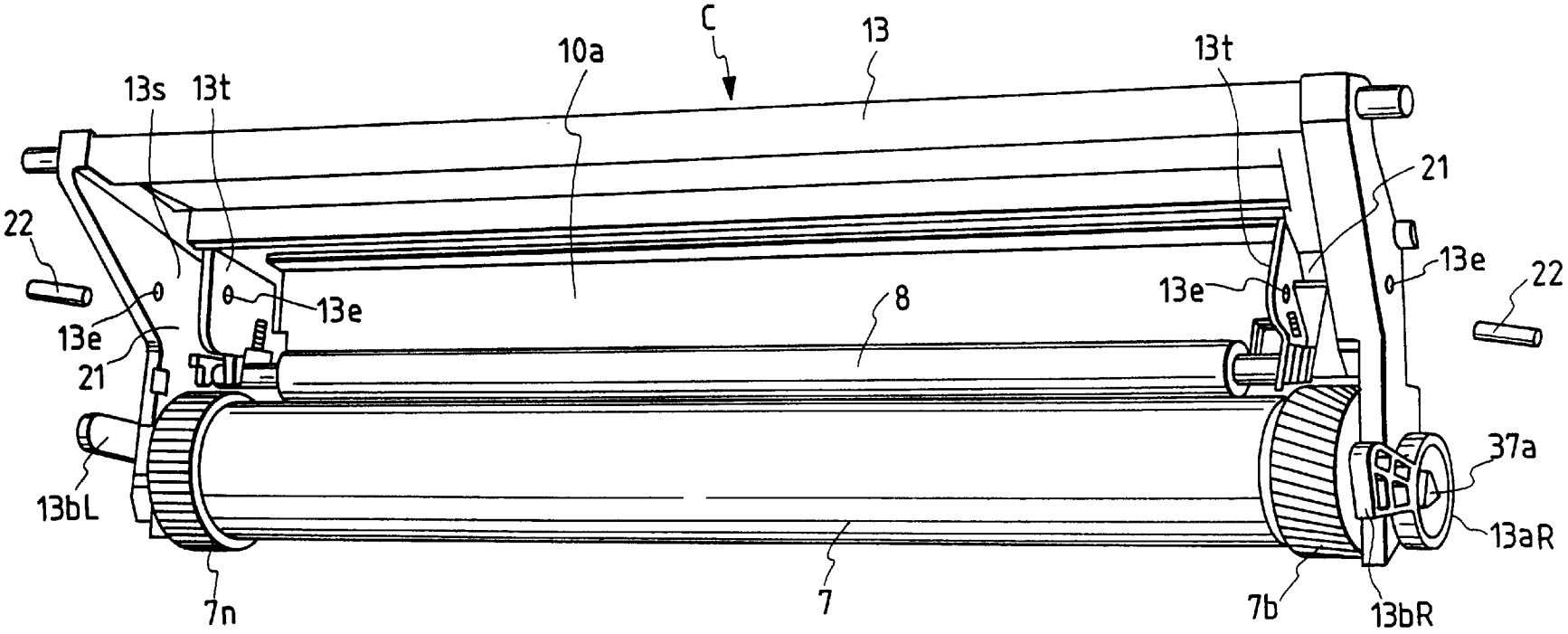
FIG. 12 is a perspective view of a cleaning unit.

As shown in FIGS. 3 and 12, the photosensitive drum 7, the charge roller 8 and the cleaning means 10 are attached to the cleaning frame to form a cleaning unit (first frame) C (FIG. 12).

By pivotally connecting the developing unit D and the cleaning unit C to each other by round pin connection members 22, the process cartridge B is formed. That is to say, as shown in FIG. 13, arm portions 19 provided on both longitudinal (axial direction of the developing roller 9*c*) sides of the developing frame 12 are provided at their tip ends with circular rotation holes 20 extending in parallel with the developing roller 9*c* (refer to FIG. 13). On the other hand, recesses 21 through which the arm portions 19 can pass are formed in both longitudinal side portions of the cleaning frame 13 (refer to FIG. 12). By inserting the arm portions 19 into the recesses 21 and by press-fitting the connection members 22 into attachment holes 13*e* of the cleaning frame 13 and into the rotation holes 20 of the tip ends of the arm members 19, the developing unit D is joined to the cleaning unit C for rotational movement around the connection member 22. In this case, compression springs 22*a* inserted into dowels (not shown) provided on roots of the arm members 19 abut against upper surfaces of the recesses 21 of the cleaning frame 13 to bias the developing frame 12 downwardly, thereby positively urging the developing roller 9*c* against the photosensitive drum 7. Incidentally, the upper surfaces of the recesses 21 of the cleaning frame 13 are inclined so that, when the developing unit D and the cleaning unit C are assembled together, the compression springs 22*a* are compressed gradually from a non-compressed condition. Accordingly, as shown in FIG. 13, by providing spacer sub-rollers 9*i* each having a diameter greater than that of the developing roller 9*c* on both longitudinal ends of the developing roller 9*c*, the spacer sub-rollers 9*i* are urged against the photosensitive drum 7, thereby maintaining a predetermined gap (about 300 $\mu$m) between the photosensitive drum 7 and the developing roller 9*c*. Therefore, since the developing unit D and the cleaning unit C can be rotated relative to each other around the connection members 22, a positional relation between the peripheral surface of the photosensitive drum 7 and the peripheral surface of the developing roller 9*c* can be maintained by elastic forces of the compression springs 22*a*.

Construction of Guide Means of Process Cartridge B

Figure 9:
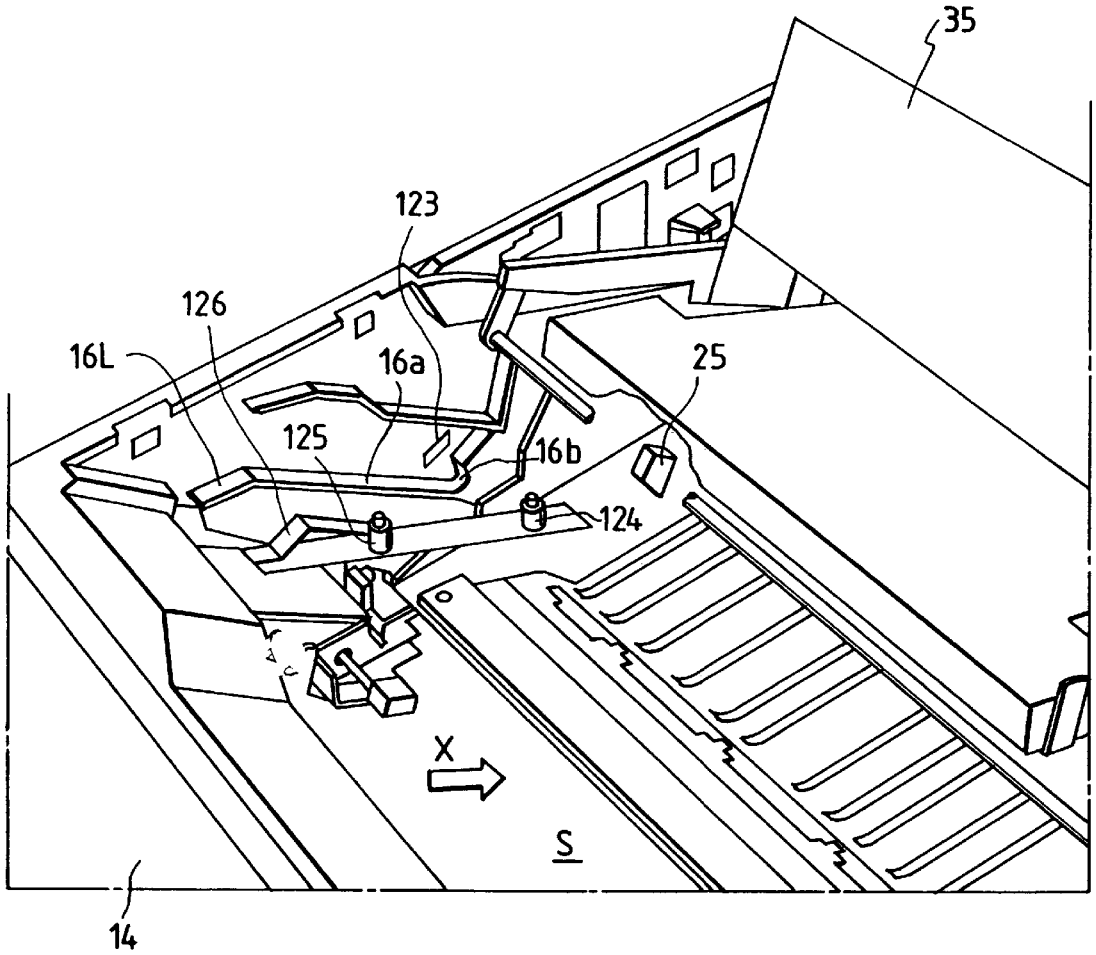
FIG. 9 is a perspective view of a process cartridge mounting portion of the electrophotographic image forming apparatus.
Figure 10:
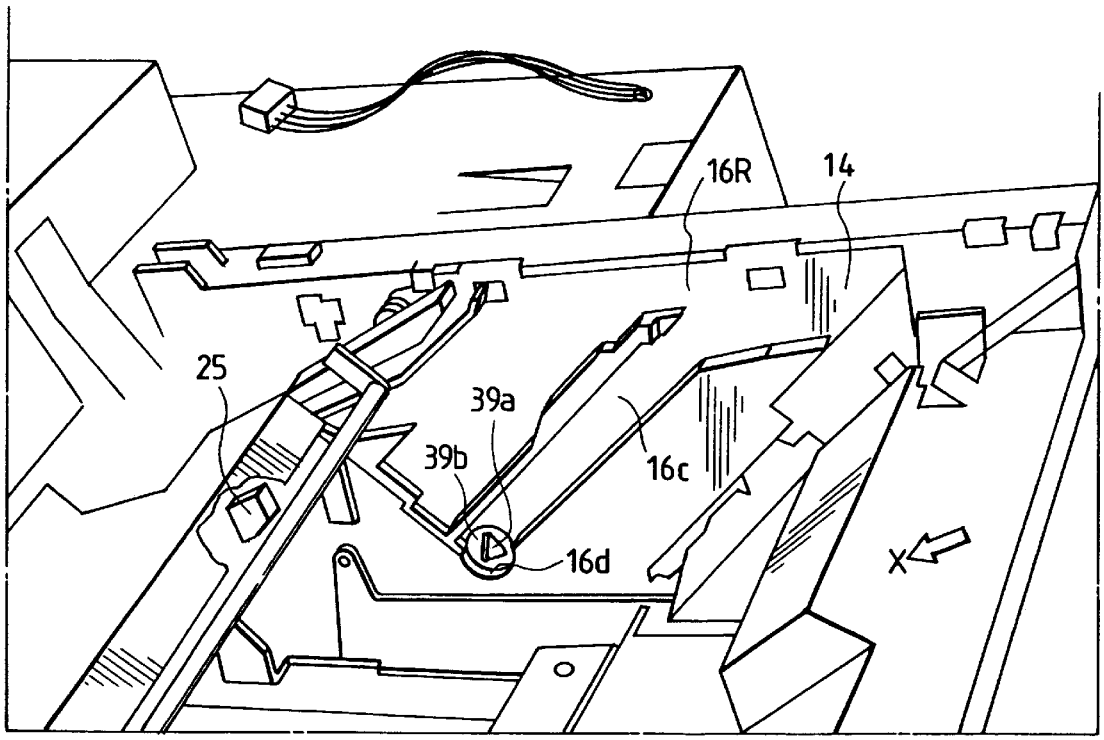
FIG. 10 is a perspective view of a process cartridge mounting portion of the electrophotographic image forming apparatus.

Next, guide means operating when the process cartridge B is mounted and dismounted with respect to the body 14 of the image forming apparatus will be described. The guide means are shown in FIGS. 9 and 10. Incidentally, FIG. 9 is a left side perspective view looked at along a direction (shown by the arrow X) along which the process cartridge B is mounted to the image forming apparatus A. FIG. 10 is a right side perspective view.

As shown in FIGS. 4 to 7, guide means acting as guides when the process cartridge B is mounted and dismounted with respect to the body 14 of the image forming apparatus provided on both outer surfaces of the cleaning frame 13. The guide means includes cylindrical guides (positioning guide members) 13*a*P, 13*a*L, and rotation-preventing guides 13*b*R, 13*b*L as guide members for maintaining the posture of the cartridge during the mounting and dismounting.

As shown in FIG. 5, the cylindrical guide 13*a*R is a cylindrical guide member, and the rotation-preventing guide 13*b*R is formed integrally with the cylindrical guide 13*a*R and protrudes radially from the periphery of the cylindrical guide 13*a*R. An attachment flange 13*a*R1 is integrally formed with the cylindrical guide 13*a*R. The right guide member 13R having the cylindrical guide 13*a*R, the rotation-preventing guide 13*b*R and the attachment flange 13*a*R1 in this way is secured by threading small screws 13*a*R2 into the cleaning frame 13 through holes of the attachment flange 13*a*R1. The rotation-preventing guide 13*b*R of the right guide member 13R secured to the cleaning frame 13 is disposed near the side surface of the developing frame 12 to extend toward the side of the developing holder 40 (described later) secured to the developing frame 12.

Figure 11:
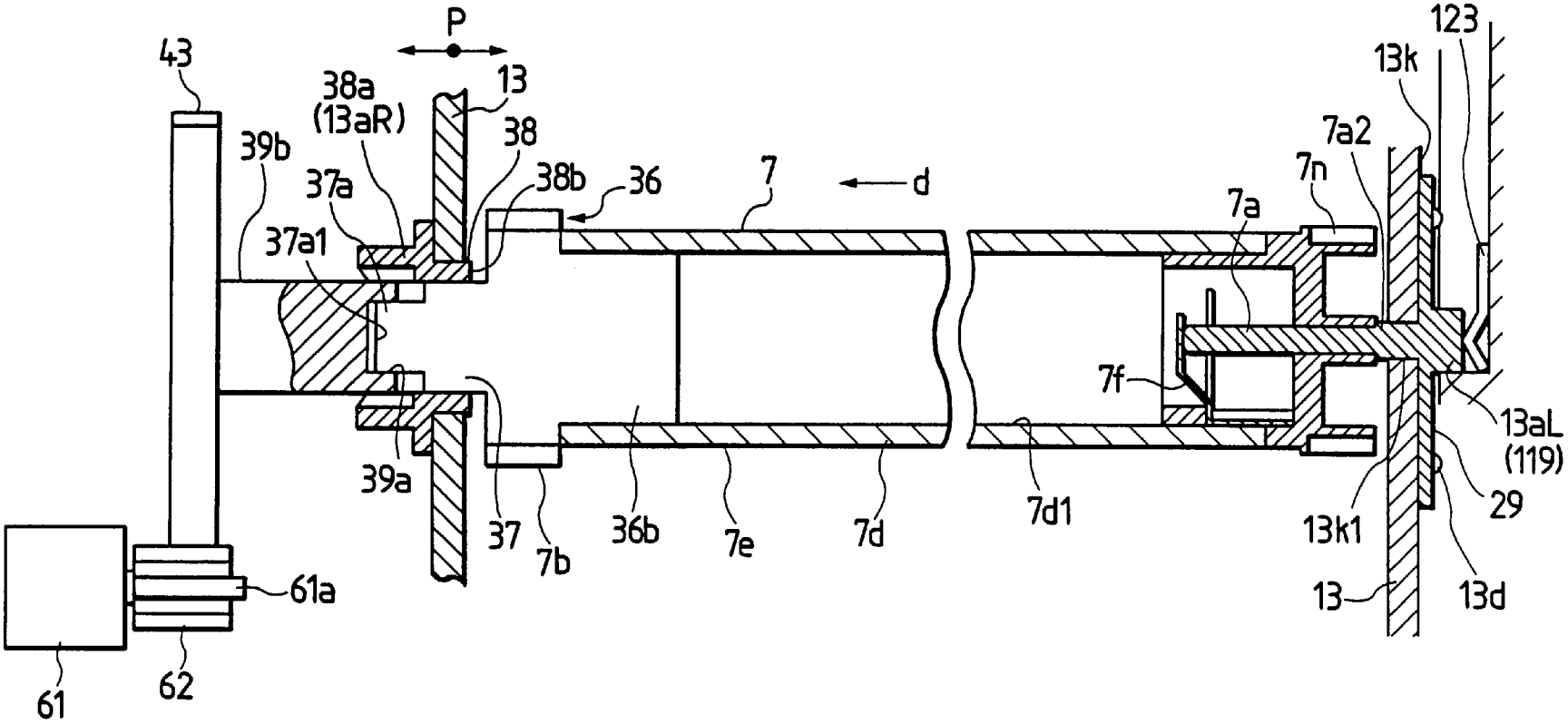
FIG. 11 is an elevational sectional view of a photosensitive drum and a drive device therefor.

As shown in FIG. 11, a large diameter portion 7*a*2 of a drum shaft 7*a* is fitted into a hole 13*k*1 of the cleaning frame 13. The cylindrical guide 13*a*L protrudes outwardly (front side perpendicular to the plane of FIG. 6) from a flange 29 fitted on a positioning pin 13*c* protruding from the side surface of the cleaning frame 13 (to prevent rotation of the flange) and secured to the cleaning frame 13 by small screws 13*d*. The fixed drum shaft 7*a* (FIG. 11) extends inwardly from the inner surface of the flange 29 to rotatably support a spur gear 7*n* secured to the photosensitive drum 7. The drum shaft 7*a* is coaxial with the cylindrical guide 13*a*L. The flange 29, the cylindrical guide 13*a*L and the drum shaft 7*a* may be integral with each other or may be integrally formed from a metallic material such as iron.

As shown in FIG. 6, the elongated rotation-preventing guide 13*b*L is integrally formed with the cleaning frame 13 to protrude laterally from the cleaning frame 13, which rotation-preventing guide extends substantially radially of the cylindrical guide 13*a*L, slightly spaced apart from the latter. A portion of the flange 29 which interferes with the rotation-preventing guide 13*b*L is cut away, and a side protruded amount of the rotation-preventing guide 13*b*L is selected so that a top surface of the flange substantially coincides with a top surface of the rotation-preventing guide 13*b*L. The rotation-preventing guide 13*b*L is extended laterally of a developing roller bearing box 9*v* secured to the developing frame 12. In this way, in the left guide member 13L, the metallic cylindrical guide 13*a*L and the synthetic resin rotation-preventing guide 13*b*L are discrete members.

Next, regulating abutment portions 13*j* provided on an upper surface 13*i* of the cleaning unit C will be described.

Here, "the upper surface" is referred to as a surface facing upwardly when the process cartridge B is mounted to the body 14 of the image forming apparatus.

In the illustrated embodiment, as shown in FIGS. 4 to 7, regulating abutment portions 13*j* are provided on the upper surface 13*i* of the cleaning unit C at right and left ends 13*p*, 13*q* thereof in a direction perpendicular to the process cartridge mounting direction. The regulating abutment portions 13*j* serve to the position of the process cartridge B when the process cartridge B is mounted to the body 14 of the image forming apparatus. That is to say, when the process cartridge B is mounted to the body 14 of the image forming apparatus, the regulating abutment portions 13*j* abut against fixed members 25 (FIGS. 9, 10 and 26) of the body 14 of the image forming apparatus, thereby regulating the rotation of the process cartridge B around the cylindrical guides 13*a*R, 13*a*L.

Next, a guide means of the body 14 of the image forming apparatus will be described. When the open/close member 35 of the body 14 of the image forming apparatus is rotated around a fulcrum 35*a* in a counter-clockwise direction in FIG. 1, the upper part of the body 14 of the image forming apparatus is opened, with the result that the mounting portion for the process cartridge B is exposed, as shown in FIGS. 9 and 10. When the open/close member 35 is opened, it can be seen that guide members 16L (FIG. 9), 16R (FIG. 10) are provided on left and right inner surfaces of the body 14 of the image forming apparatus, respectively, in a direction looked at from the process cartridge mounting and dismounting direction.

As shown, the guide members 16L, 16R have guide portions 16*a*, 16*c* sloped forwardly and downwardly in the process cartridge inserting direction (shown by the arrow X), and semi-circular positioning recesses 16*b*, 16*d* contiguous with the guide portions 16*a*, 16*c* and adapted to just receive the cylindrical guides 13*a*L, 13*a*R of the process cartridge B. The positioning recesses 16*b*, 16*d* have cylindrical peripheral surfaces. The centers of the positioning recesses 16*b*, 16*d* coincide the centers of the cylindrical guides 13*a*L, 13*a*R when the process cartridge B is mounted to the body 14 of the image forming apparatus, and, thus coincide with the center of the photosensitive drum 7.

The widths of the guide portions 16*a*, 16*c* are selected so that the cylindrical guides 13*a*L, 13*a*R can be loosely fitted in such guide portions in the process cartridge mounting and dismounting direction. Although the rotation-preventing guides 13*b*L, 13*b*R, having diameters smaller than those of the cylindrical guides 13*a*L, 13*a*R, are naturally loosely fitted, the rotations of the cylindrical guides 13*a*L, 13*a*R and the rotation-preventing guides 13*b*L, 13*b*R are regulated by the guide portions 16*a*, 16*c*, so that the process cartridge B is mounted while maintaining the posture within a predetermined range. In the condition that the process cartridge B is mounted to the body 14 of the image forming apparatus, the cylindrical guides 13*a*L, 13*a*R of the process cartridge B are fitted into the positioning recesses 16*b*, 16*d* of the guide members 13L, 13R, respectively, and the left and right regulating abutment portions 13*j* of the abut against the fixed members 25 of the apparatus body 14.

The process cartridge B has a weight distribution so that, if a straight line connecting centers of the cylindrical guides 13*a*L, 13*a*R is kept horizontally, the developing unit D side has a primary moment greater than that of the cleaning unit C side.

When the process cartridge B is mounted to the body 14 of the image forming apparatus, the operator grasps a recess 17 side and a lower rib 11*c* side of the toner frame 11 by his one hand, inserts the cylindrical guides 13*a*L, 13*a*R into the guide portions 16*a*, 16*c* of the cartridge mounting portion of the body 14 of the image forming apparatus, respectively, and then inserts the rotation-preventing guides 13*b*L, 13*b*R into the guide portions 16*a*, 16*c* of the body 14 of the image forming apparatus while inclining the process cartridge B forwardly and downwardly when looked at from the cartridge inserting direction. The cylindrical guides 13*a*L, 13*a*R and the rotation-preventing guides 13*b*L, 13*b*R of the process cartridge B are shifted rearwardly along the guide portions 16*a*, 16*c* of the body 14 of the image forming apparatus. When the cylindrical guides 13*a*L, 13*a*R of the process cartridge B reach the positioning recesses 16*b*, 16*d* of the body 14 of the image forming apparatus, the cylindrical guides 13*a*L, 13*a*R are seated into the positioning recesses 16*b*, 16*d* by a gravity force of the process cartridge B. As a result, the cylindrical guides 13*a*L, 13*a*R of the process cartridge B are correctly positioned with respect to the positioning recesses 16*b*, 16*d*. Since the center line connecting the centers of the cylindrical guides 13*a*L, 13*a*R coincides with the center line of the photosensitive drum 7, the photosensitive drum 7 is substantially positioned with respect to the body 14 of the image forming apparatus. Incidentally, the photosensitive drum is ultimately positioned with respect to the apparatus body 14 when the couplings are joined.

In this condition, the regulating abutment portions 13*j* of the process cartridge B are slightly spaced apart from the fixed members 25 of the body 14 of the image forming apparatus. Now, when the operator releases the process cartridge B, the developing unit D side of the process cartridge B is rotated downwardly around the cylindrical guides 13*a*L, 13*a*R and the cleaning unit C side is rotated upwardly, with the result that the regulating abutment portions 13*j* of the process cartridge B abut against the fixed members 25 of the body 14 of the image forming apparatus, thereby correctly mounting the process cartridge B with respect to the body 14 of the image forming apparatus. Thereafter, the open/close member 35 is closed by rotating it around the fulcrum 35*a* in the clockwise direction in FIG. 1.

When the process cartridge B is dismounted from the apparatus body 14, the reverse operations may be performed. That is to say, the open/close member 35 of the apparatus body 14 is opened. Then, when the operator lifts the process cartridge by grasping the upper and lower ribs 11*c* (grip portion) of the cartridge B, the cylindrical guides 13*a*L, 13*a*R of the process cartridge B are rotated around the positioning recesses 16*b*, 16*d* of the apparatus body 14, with the result that the regulating abutment portions 13*j* of the process cartridge B are separated from the fixed members 25 of the apparatus body 14. In this condition, by further pulling the process cartridge B, the cylindrical guides 13*a*L, 13*a*R leave the positioning recesses 16*b*, 16*d* and are shifted to the guide portions 16*a*, 16*c* of the guide members 16L, 16R. Then, when the process cartridge B is lifted, the cylindrical guides 13*a*L, 13*a*R and the rotation-preventing guides 13*b*L, 13*b*R of the process cartridge B are lifted while being shifted in the guide portions 16*a*, 16*c* of the apparatus body 14, with the result that the process cartridge B is dismounted from the apparatus body 14 while regulating the posture of the cartridge without interfering with other parts of the apparatus body 14.

Incidentally, as shown in FIG. 12, in the axial direction of the photosensitive drum 7, the spur gear 7*n* is positioned at an end opposite to end on which a helical drum gear 7*b* is positioned. When the process cartridge B is mounted to the apparatus body 14, the spur gear 7*n* is engaged by a gear (not shown) coaxial with the transfer roller 4, with the result that a driving force for rotating the transfer roller 4 is transmitted from the process cartridge B.

Toner Frame

Figure 21:
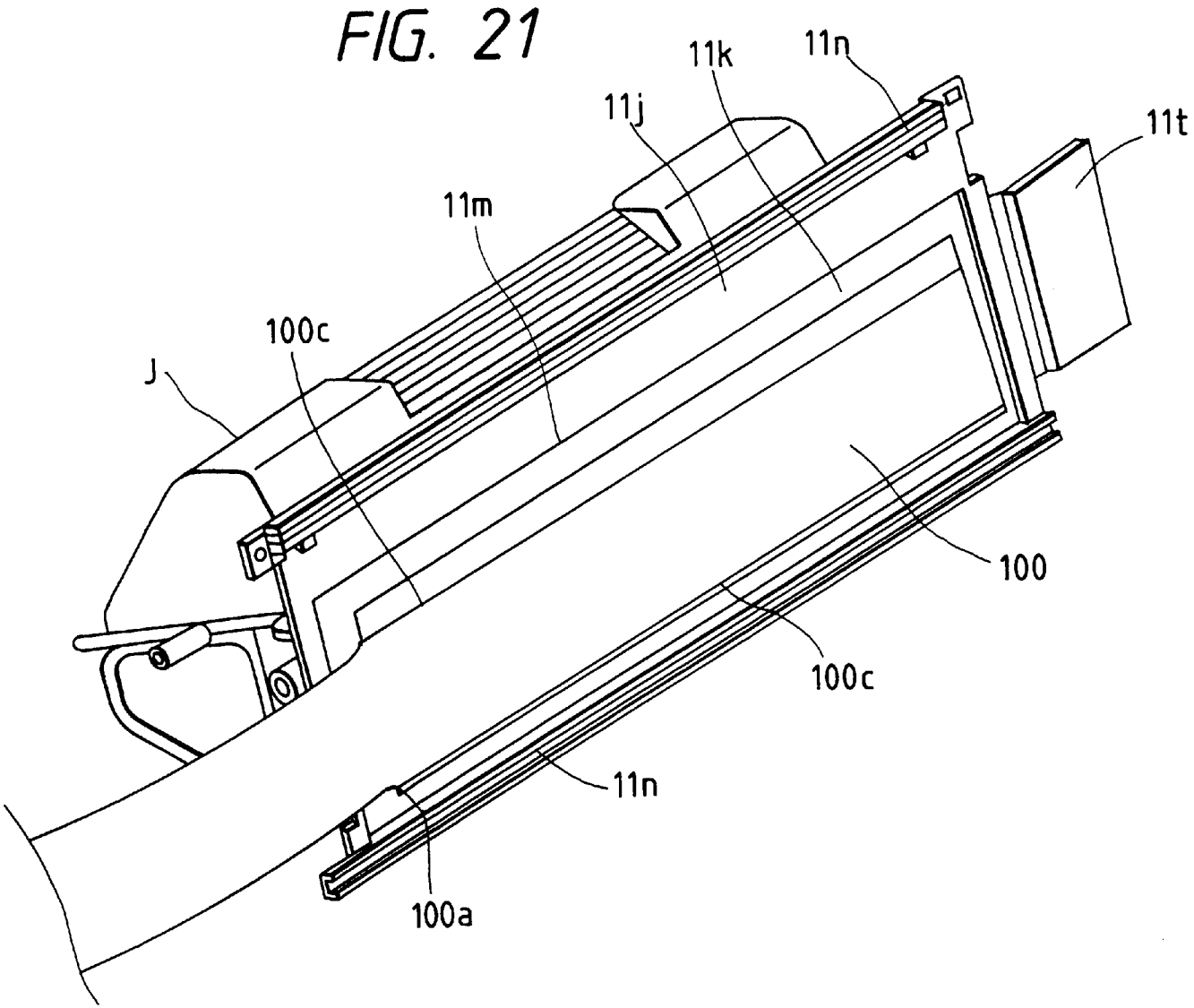
FIG. 21 is a perspective view of the toner frame.
Figure 22:
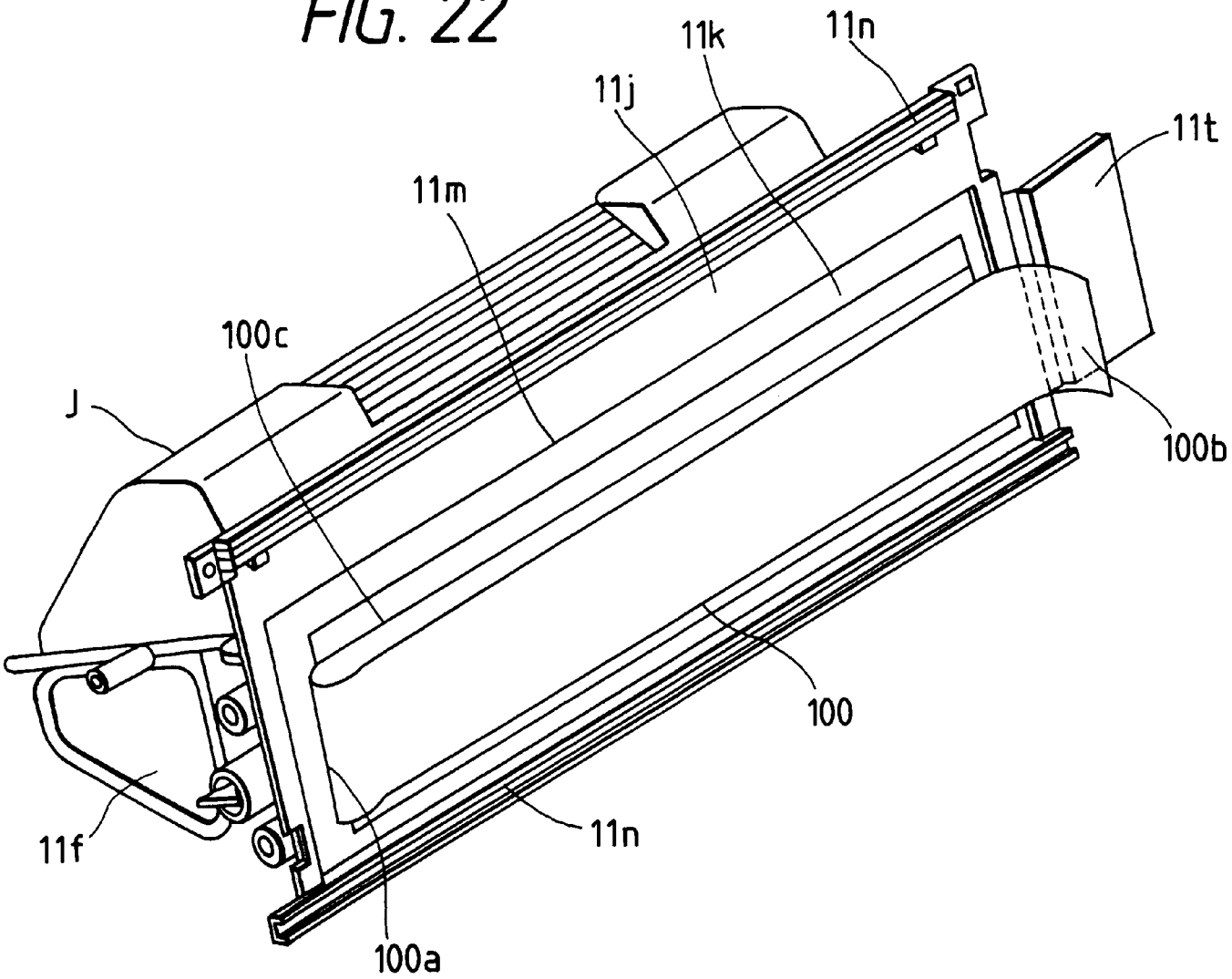
FIG. 22 is a perspective view of the toner frame.

Now, the toner frame will be fully explained with reference to FIGS. 3, 5, 7, 16, 20, 21 and 22. FIG. 20 is a perspective view before a toner seal is welded, and FIGS. 21 and 22 are perspective views after toner is loaded.

As shown in FIG. 3, the toner frame 11 is constituted by an upper frame 11*a* and a lower frame 11*b*. As shown in FIG. 1, the upper frame 11*a* is swollen upwardly to occupy a space rightwardly of the optical system 1 within the body 14 of the image forming apparatus, with the result that a toner containing amount of the process cartridge B is increased without making the image forming apparatus A bulky. As shown in FIGS. 3, 4 and 7, a recessed portion 17 serving as a grip is formed in a longitudinal central portion of the upper frame 11*a*. Thus, the operator can grip the recessed portion 17 of the upper frame 11*a* and a lower surface of the lower frame 11*b* by his hand. Incidentally, the longitudinal ribs 11*c* provided on one side of the recessed portion 17 and on the lower surface of the lower frame 11*b* have a slip-preventing function when the process cartridge B is gripped by the operator. As shown in FIG. 3, a flange 11*a*1 of the upper frame 11*a* is fitted on a flange 11*b*1 (having peripheral ridge) of the lower frame 11*b* at a welding plane U. By melting welding ribs by means of an ultrasonic welding technique, the frames 11*a*, 11*b* are joined together. The joining method is not limited to ultrasonic welding, but, for example, heat welding, forcible vibration, or welding may be used. When the frames 11*a*, 11*b* are welded by the ultrasonic welding technique, the frames 11*a*, 11*b* are supported by the flange 11*b*1, and a stepped portion 11*m* is provided substantially flush with the flange 11*b*1 outwardly and upwardly of the opening portion 11*i*. The provision of the stepped portion 11*m* will be described later.

Figure 16:
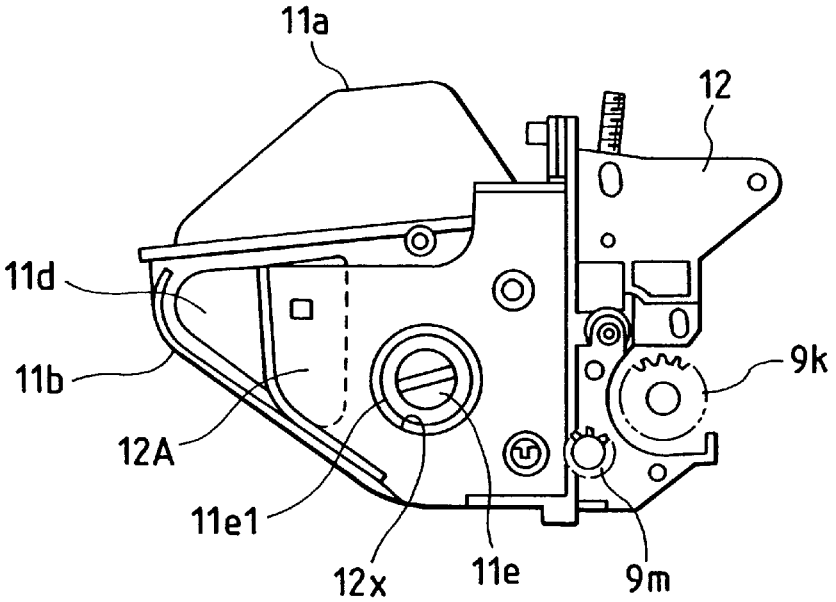
FIG. 16 is a side view of a side plate of a developing frame and a toner frame.

Before the frames 11*a*, 11*b* are joined together, the toner feed member 9*b* is incorporated into the lower frame 11*b*. Further, as shown in FIG. 16, a coupling member 11*e* is inserted into a hole 11*e*1 formed in a side plate of the toner frame 11 to be locked to the end of the toner feed member 9*b*. The hole 11*e*1 is formed in one longitudinal end portion of the lower frame 11*b*. At the same side as the hole 11*e*1, a substantially triangular toner loading opening 11*d* is provided. The toner loading opening 11*d* has one edge along an interface between the upper and lower frames 11*a*, 11*b*, a vertical edge perpendicular to said one edge, and an oblique edge along the lower surface of the lower frame 11*b*. Thus, the toner loading opening 11*d* can be maximized. The hole 11*e*1 and the toner loading opening 11*d* are arranged side by side. Further, as shown in FIG. 20, the opening portion 11*i* through which the toner is sent from the toner frame 11 to the developing frame 12 is formed in the toner frame 11 along the longitudinal direction of the toner frame 11. A seal member 100 (described later) is welded to close the opening portion 11*i*. Thereafter, the toner is loaded through the toner loading opening 11*d*, and, as shown in FIG. 21, the toner loading opening 11*d* is closed by a toner cap 11*f*, thereby completing a toner unit J. The toner cap 11*f* is made of a material such as polyethylene or polypropylene and is press-fitted into or welded to the toner loading opening 11*d* not to be disengaged from the latter. Further, the toner unit J is welded to the developing frame 12 (described later) by the ultrasonic welding, thereby forming a part of the developing unit D. The joining method is not limited to ultrasonic welding, but welding or snap-fit (utilizing an elastic force) may be used.

Further, as shown in FIG. 3, an inclined surface K of the lower frame 11*b* of the toner frame 11 has an angle θ for naturally dropping the toner while the toner is being consumed. This angle θ, i.e., an angle θ between the inclined surface K of the process cartridge B mounted to the apparatus body 14 (in a condition that the apparatus body 14 is kept horizontally) and a horizontal plane is preferably about 65 degrees. The lower frame 11*b* is provided at its lower part with a recessed portion 11*g* not to interfere with the rotation of the toner feed member 9*b*. The recessed portion 11*g* may be concave by about 0 mm to 10 mm from an extension plane of the inclined surface K. If the recessed portion 11*g* is positioned above the inclined surface K, the toner slid down along the inclined surface K and trapped between the recessed portion 11*g* and the inclined surface K may not be sent into the developing frame 12. However, in the illustrated embodiment, the toner can surely be sent from the toner frame 11 to the developing frame 12.

Incidentally, the toner feed member 9*b* is formed from an iron group rod having a diameter of about 2 mm and has a crank shape, and, as shown in FIG. 20, one of journals 9*b*1 (only one is shown) of the toner feed member is pivotally connected to a hole 11*r* of the toner frame 11 facing the opening portion 11*i* and the other journal (not shown) is secured to the coupling member 11*e* (in FIG. 20, the connecting portion can be seen).

By providing the recessed portion 11*g* in the bottom of the toner frame 11 not to interfere with the toner feed member 9*c* in this way, a stable toner feeding ability can be achieved without increasing cost.

Figure 40:
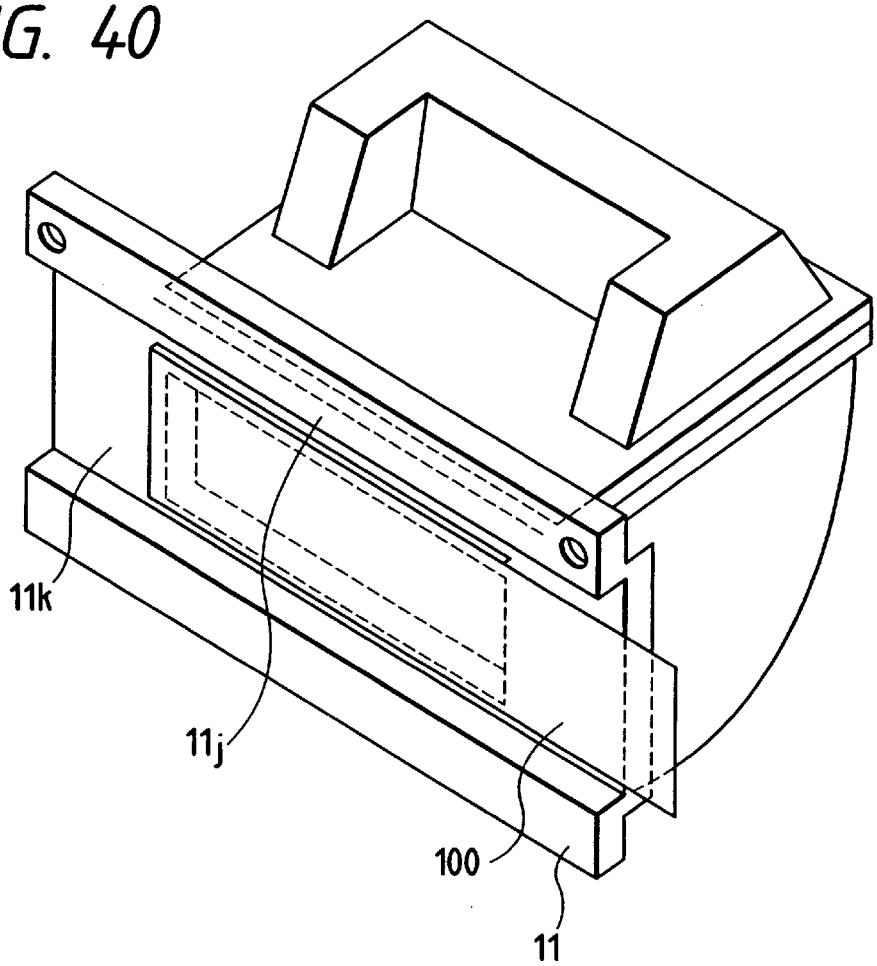
FIG. 40 is a perspective view showing another embodiment showing an opening portion of a toner frame.

As shown in FIGS. 3, 20 and 23, the opening portion 11*i* for feeding the toner from the toner frame 11 to the developing frame 12 is positioned at the interface between the toner frame 11 and the developing frame 12. A recessed surface 11*k* is disposed around the opening portion 11*i*. Upper and lower flanges 11*j*, 11*j*1 of the recessed surface 11*k* are provided at its free edges with longitudinal grooves 11*n* extending in parallel with the flanges. The upper flange 11*j* of the recessed surface 11*k* has a gate shape, and the lower flange 11*j*1 is perpendicular to the recessed surface 11*k*. As shown in FIG. 23, the bottoms 11*n*2 of the grooves 11*n* protrude outwardly (toward the developing frame 12) more than the recessed surface 11*k*. Incidentally, as shown in FIG. 40, the flange 11*j* of the opening portion 11*i* may have a flat rectangular ring.

As shown in FIG. 19, a surface of the developing frame 12 opposing to the toner frame 11 is a flat surface 12*u*, and a closed flat rectangular ring-shaped flange 12*e* encircles the flat surface 12*u* in such a manner that the flange is retarded from the flat surface and is disposed in parallel with the flat surface. The flange 12*e* is provided at its upper and lower edges with longitudinal protrusions 12*v* which can be fitted into the grooves 11*n* of the toner frame 11. Triangular welding projections 12*v*1 (FIG. 23) used in the ultrasonic welding are provided on top surfaces of the protrusions 12*v*. After the parts are incorporated or assembled, the grooves 11*n* of the toner frame 11 are fitted onto the protrusions 12*v* of the developing frame 12, and the toner frame 11 and the developing frame 12 are welded together along the longitudinal direction by ultrasonic welding (details will be described later).

Now, the seal member 100 for closing the opening portion 11*i* will be fully described.

The seal member 100 is constituted by laminating PET (polyethylene telephthalate) films on both surfaces of an aluminium film and is adhered to the recessed surface 11*k* to close the opening portion 11*i* of the toner frame 11, as shown in FIG. 21.

As shown in FIG. 21, one of the PET films of the seal member 100 has cut lines 100*c* for permitting the opening (unsealing) of the opening portion 11*i*. As will be described later, by effecting an unsealing operation, the seal member 100 is torn along the cut lines 100*c*, thereby unsealing the opening portion 11*i* of the toner frame 11.

As shown in FIG. 22, the seal member 100 is folded back at a longitudinal one end 100*a* of the opening portion 11*i*, and a free end 100*b* of the seal member is passed between an elastic seal material 54 (FIG. 19), such as felt, adhered to the longitudinal end of the surface of the developing frame 12 (opposing to the toner frame 11) and the toner frame 11 and is extended out of the cartridge. The outwardly extended end (referred to as "grip end" herein after) of the seal member 100 is attached to a grip member 11*t* (FIGS. 6, 20 and 21). The grip member 11*t* is integrally formed with the toner frame 11, but has a weak or thinner portion adjacent to the toner frame 11 so that the grip member can easily be separated from the toner frame. Further, the grip member 11*t* is bent at about a right angle so as to reduce a longitudinal space when the process cartridge B is packed. A synthetic resin film tape 55 having small coefficient of friction is adhered to the surface of the seal material 54 at inner side thereof. Further, an elastic seal material 56 (FIG. 19) is adhered to the flange 12*e* at a longitudinal end thereof opposite to the end to which the elastic seal material 54 is adhered.

Thee elastic seal materials 54, 56 at both longitudinal ends are adhered to the flange 12*e* along the entire width thereof. The elastic seal materials 54, 56 coincide with the flange portions 11*j* at the both longitudinal ends of the recessed surface 11*k* and extend along the entire widths of the flange portions 11*j* while overlapping with the protrusions 12*v*.

When the toner frame 11 and the developing frame 12 are joined together, in order to facilitate the positioning between the frames 11, 12, the flange 11*j* of the toner frame 11 is provided with a circular hole 11*r* and a rectangular hole 11*q* which can be fitted onto a cylindrical dowel 12*w*1 and a rectangular dowel 12*w*2 of the developing frame 12. The circular hole 11*r* is closely fitted onto the dowel 12*w*1 and the rectangular hole 11*q* is fitted on the dowel 12*w*2 closely in the width-wise direction with any play in the longitudinal direction.

When the toner frame 11 and the developing frame 12 are joined together, the toner frame 11 and the developing frame 12 are prepared as independent assemblies. Thereafter, the positioning cylindrical dowel 12*w*1 and rectangular dowel 12*w*2 of the developing frame 12 are fitted into the positioning circular hole 11*r* and rectangular hole 11*q* of the toner frame 11. Further, the protrusions 12*v* of the developing frame 12 are fitted into the grooves 12*n* of the toner frame 11. Then, when the toner frame 11 and the developing frame 12 are urged against each other, the seal materials 54, 56 are compressed against the both longitudinal end flange portions 11*j* of the toner frame 11, and projections (spacers) 12*z* integrally formed with the developing frame 12 along the width-wise direction at both longitudinal sides of the flat surface 12 of the developing frame approach the flange 11*j* of the toner frame 11. The projections 12*z* are disposed only on both width-wise sides of the seal member 100 for permitting the passage of the seal member 100.

In the above-mentioned condition, while the toner frame 11 and the developing frame 12 are being urged against each other, ultrasonic vibration is applied between the protrusions 12*v* and the grooves 11*n* to melt the triangular projections 12*v*1 by frictional heat, thereby welding the protrusions to the bottoms of the grooves 11*n*. Consequently, edges 11*n*1 of the grooves 11*n* of the toner frame 11 and the spacer projections 12*z* of the developing frame 12 closely contact each other, with the result that a space having sealed periphery is formed between the recessed surface 11*k* of the toner frame 11 and the opposed flat surface 12*u* of the developing frame 12. And, the seal member 100 is contained in this space.

In order to send the toner contained in the toner frame 11 to the developing frame 12, the root of the grip member 11*t*, to which the grip end 100*b* (FIG. 6) of the seal member 100 protruding out of the process cartridge B is attached, is torn from the toner frame 11. When the grip member 11*t* is pulled by the operator, the cover film 51 is torn to unseal the opening portion 11*i* of the toner frame 11, thereby permitting the sending of the toner from the toner frame 11 to the developing frame 12. Since the elastic seal materials 54, 56 are merely compressed or deformed at both longitudinal ends of the flange 11*j* of the toner frame 11 without changing their cubic shapes, good sealing ability can be obtained.

Since the opposed surfaces of the toner frame 11 and the developing frame 12 are constituted in this way, when a force for tearing the seal member 100 is applied, a seal member 100 can smoothly be pulled out between the toner frame 11 and the developing frame 12.

Material for forming the toner frame 11 and the developing frame 12 may be for example, plastic such as polystyrene, ABS resin (acrylonitrile/butadiene/styrene copolymer), polycarbonate, polyethylene or polypropylene.

Developing Frame

Figure 14:
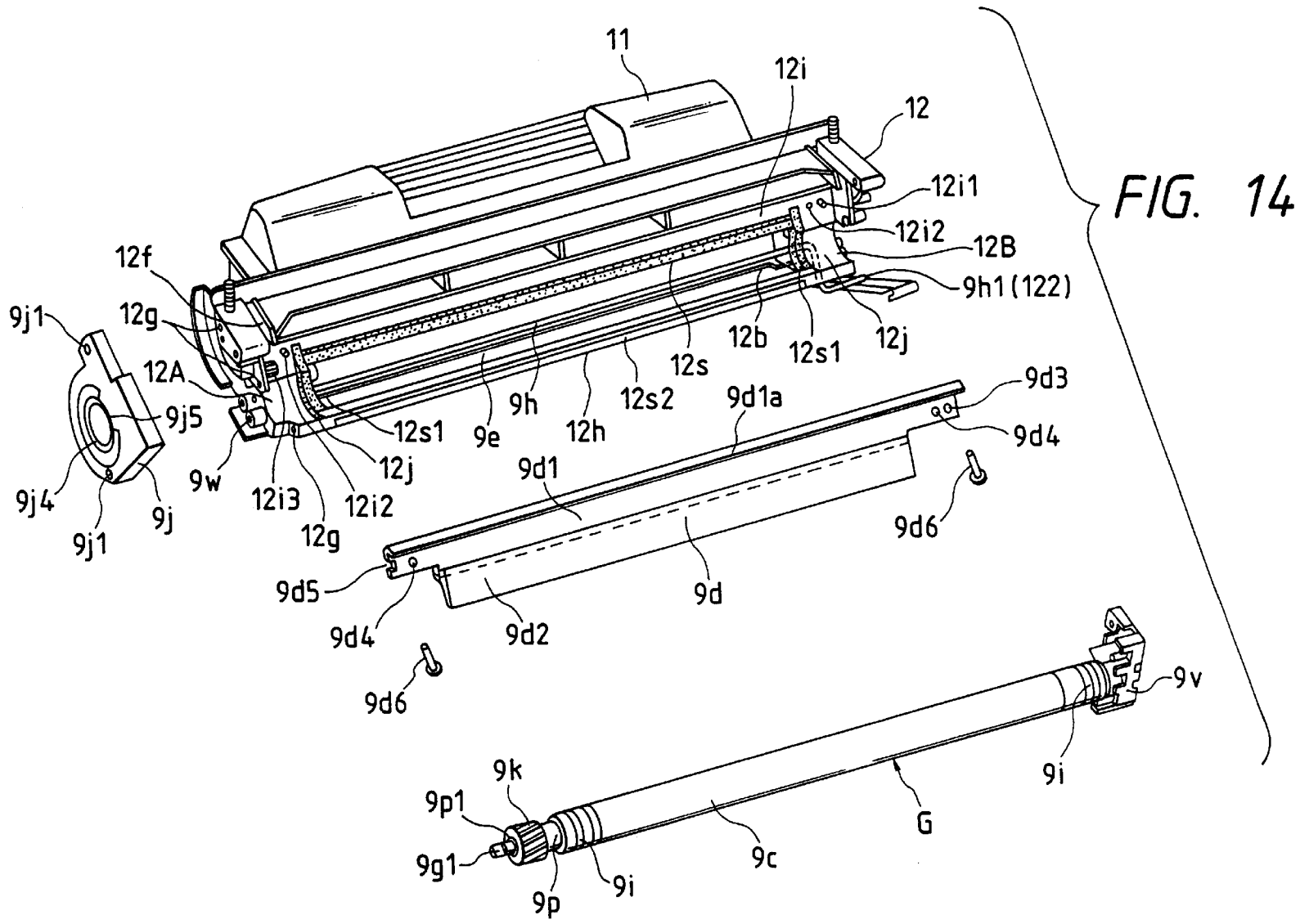
FIG. 14 is a partial exploded perspective view of the developing unit.
Figure 15:
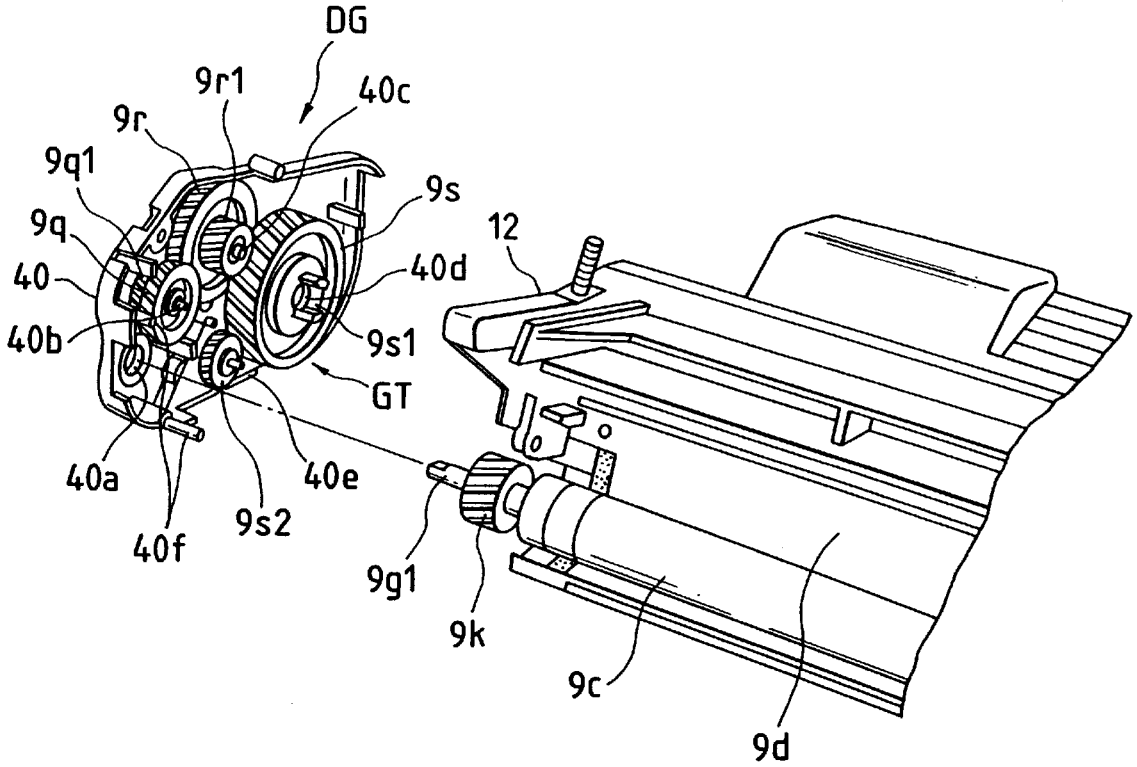
FIG. 15 is a perspective view of the back of a developing holder.
Figure 17:
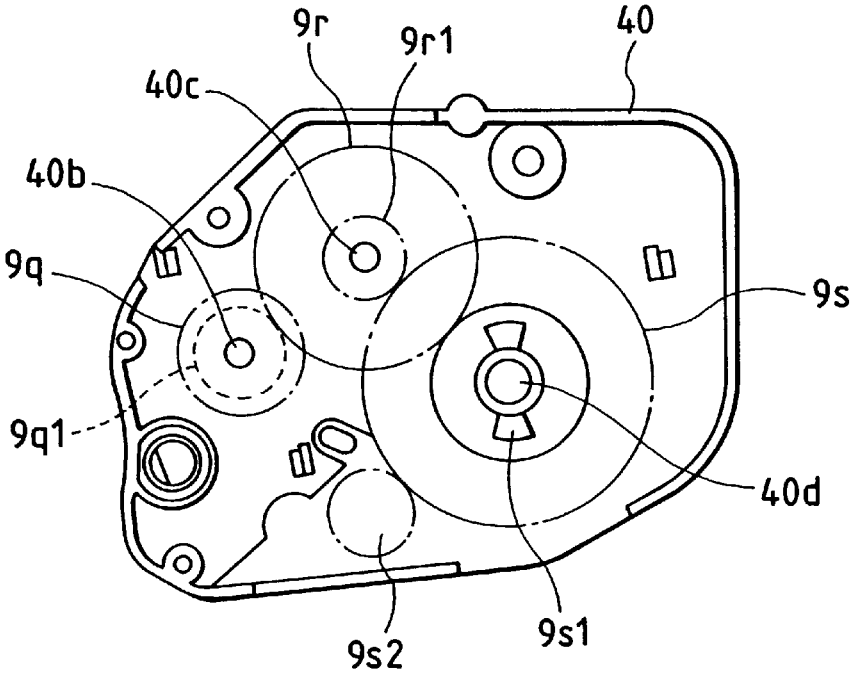
FIG. 17 is a side view of the developing holder of FIG. 15, looked at from the interior toward the exterior thereof.
Figure 18:
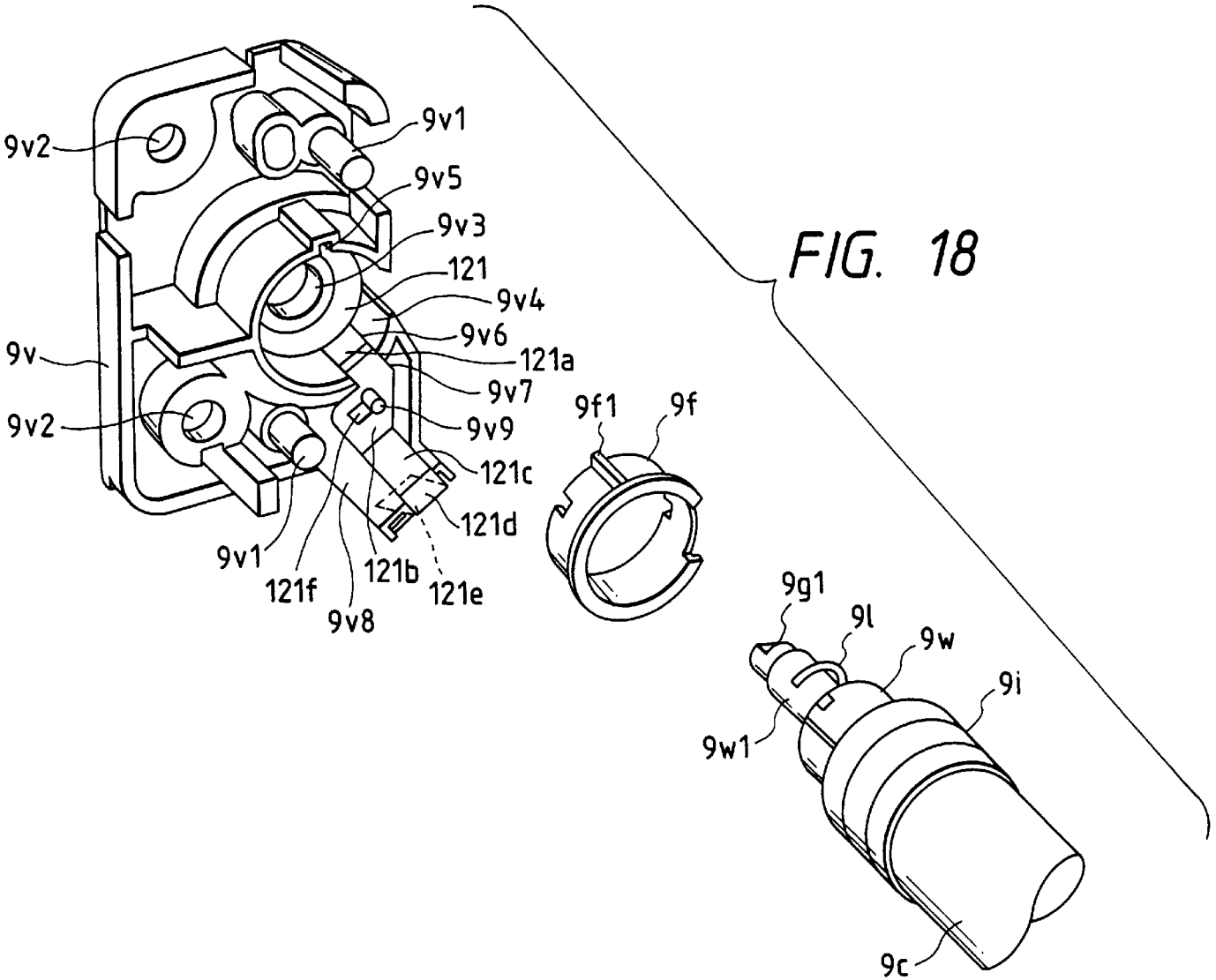
FIG. 18 is a perspective view of a developing roller bearing box.

Next, the developing frame 12 will be explained with reference to FIGS. 3, 14, 15, 16, 17 and 18. FIG. 14 is a perspective view showing a condition that various parts are incorporated into the developing frame 12, FIG. 15 is a perspective view showing a condition that a developing portion drive transmitting unit DG is incorporated into the developing frame 12, FIG. 16 is a side view of the developing unit in a condition that the developing portion drive transmitting unit DG is not attached, FIG. 17 is a side view of the developing portion drive transmitting unit DG, looked at from inside, and FIG. 18 is a perspective view showing interior of a bearing box.

As mentioned above, the developing roller 9*c*, the developing blade 9*d*, the toner agitating member 9*e* and the antenna rod 9*h* for detecting the toner remaining amount are incorporated into the developing frame 12.

As shown in FIG. 14, the developing blade 9*d* is constituted by securing urethane rubber 9*d*2 onto a metal plate 9*d*1 (having a thickness of about 1 mm to 2 mm) by hot melt or a two-face adhesive tape, and by contacting the urethane rubber 9*d*2 with the generatrix of the developing roller 9*c*, the toner amount on the peripheral surface of the developing roller 9*c* is regulated. A dowel 12*i*1, a rectangular projection 12*i*3 and a threaded hole 12*i*2 are provided on both longitudinal end portions of a blade abut flat surface (blade attachment portion) 12*i* of the developing frame 12. A hole 9*d*3 and a cut portion 9*d*5 of the metal plate 9*d*1 are fitted to the dowel 12*i*1 and the rectangular projection 12*i*3, respectively. Thereafter, a small screw 9*d*6 passing through a threaded hole 9*d*4 of the metal plate 9*d*1 is threaded into the threaded hole 12*i*2, thereby securing the metal plate 9*d*1 to the flat surface 12*i*. In order to prevent the toner from leaking outside, an elastic seal member 12*s*, such as moltprene, is adhered to the developing frame 12 along the longitudinal direction of the metal plate 9*d*1. Further, elastic seal members 12*s*1 continuous to the elastic seal member 12*s* are adhered to a curved surface 12*j* along the developing roller 9*c*. In addition, a thin elastic seal member 12*s*2 contacting the generatrix of the developing roller 9*c* is adhered to a lower flange 12*h*.

Next, a developing roller unit G will be explained with reference to FIGS. 14 and 18. To constitute a unit, the developing roller unit G comprises (1) the developing roller 9*c*, (2) spacer sub-rollers 9*i* for keeping the distance between the peripheral surface of the developing roller 9*c* and the peripheral surface of the photosensitive drum 7 constant, the spacer subrollers being made of electrically insulation material of synthetic resin and also acting as sleeve caps coated on both ends of the developing roller 9*c* to prevent leakage between the aluminium cylindrical portion of the developing roller 9*c* and the aluminium cylindrical portion of the photosensitive drum 7, (3) developing roller bearings 9*j* (shown in FIG. 14 in an enlarged form) for rotatably supporting the developing roller 9*c* and for positioning the latter with respect to the developing frame 12, (4) a developing roller gear (helical gear) 9*k* for receiving a driving force from the helical drum gear 7*b* of the photosensitive drum 7 to drive the developing roller 9*c*, (5) a developing roller coil spring contact 91 (FIG. 18) having one end fitted into the end of the developing roller 9*c*, and (6) a magnet 9*g* disposed within the developing roller 9*c* and adapted to adhere the toner to the peripheral surface of the developing roller 9*c*. Incidentally, in FIG. 14, although the bearing box 9*v* was already attached to the developing roller unit G, the developing roller unit G is connected to the bearing box 9*v* when a rear bearing box 9*v* between side plates 12A, 12B of the developing frame 12 is attached to the developing frame 12.

As shown in FIG. 14, in the developing roller unit G, a metallic flange 9*p* is fitted onto and secured to one end of the developing roller 9*c*, and a developing roller gear attachment shaft portion 9*p*1 having two flat portions is protrudes outwardly from the flange 9*p*, and a developing roller gear 9*k* is fitted onto the developing roller gear attachment shaft portion 9*p*1 while preventing rotation of the latter by the two flat portions. The developing roller gear 9*k* is a helical gear so that, when the gear is rotated, an axial thrust force is deviated to direct toward the central portion of the developing roller 9*c* (refer to FIG. 38). A D-cut shaft 9*g*1 of the magnet 9*g* is protruded outwardly through the flange 9*p*. The D-cut shaft 9*g*1 is fitted into the developing holder 40 of the drive transmitting unit DG (described later) to be supported in a non-rotating manner. The developing roller bearing 9*j* is provided with a circular hole having a rotation-preventing projection 9*j*5 protruding inwardly, and a C-shaped bearing 9*j*4 is closely fitted into the circular hole, and the flange 9*p* is rotatably fitted into the bearing 9*j*4. The developing roller bearing 9*j* is fitted into a slit 12*f* of the developing frame 12 and is held by inserting a projection 40*f* of the developing holder 40 into a hole 12*g* of the developing frame 12 and a hole 9*j*1 of the developing roller bearing 9*j* and by securing the developing holder 40 to the developing frame 12. The bearing 9*j*4 has a flange, and only the flange has a C-shape. However, all of the cross-sections of the bearing in the axial direction may have C-shapes. The hole of the developing roller bearing 9*j* into which the bearing 9*j*4 is fitted is a stepped hole, and the rotation-preventing projection 9*j*5 is provided on a large diameter portion into which the flange of the bearing 9*j*4 is fitted. The bearing 9*j* and a bearing 9*f* (described later) are made of polyacetal or polyamide.

Both end portions of the magnet 9*g* passing through the hollow cylindrical developing roller 9*c* protrude from the both end of the developing roller 9*c*, and the other D-cut end 9*g*1 of the magnet is fitted into an upper D-shaped support hole 9*v*3 of the developing roller bearing box 9*v* shown in FIG. 18. A hollow journal 9*w* is fitted onto and secured to an inner periphery of the end of the developing roller 9*c*, and a reduced diameter cylindrical portion 9*w*1 integral with the journal 9*w* serves to provide electrical insulation between the developing coil spring contact 91 electrically connected to the developing roller 9*c* and the magnet 9*g*. The flanged bearing 9*f* is made of insulation material of synthetic resin and is fitted into a bearing fit hole 9*v*4 coaxial with the magnet support hole 9*v*3. A key portion 9*f*1 integral with the bearing 9*f* is fitted into a key groove 9*v*5 of the bearing fit hole 9*v*4, thereby preventing rotation of the bearing 9*f*.

The bearing fit hole 9*v*4 has a bottom which is provided with an inner side end of an annular developing bias contact 121. When the developing roller 9*c* is incorporated into the developing roller bearing box 9*v*, the metallic developing coil spring contact 91 is urged and compressed against the developing bias contact 121. The developing bias contact 121 comprises a first conductive portion 121*a* bent from the outer diameter of the circular plate and fitted into an axial recess 9*v*6 of the bearing fit hole 9*v*4 to pass through outwardly of the bearing 9*f*, a second bent conductive portion 121*b* contiguous to the first conductive portion 121*a* and fitted into a notch 9*v*7 of the end of the bearing fit hole 9*v*4, a third conductive portion 121*c* bent from the second conductive portion 121*b*, a fourth conductive portion 121*d* bent from the third conductive portion 121*c* radially outwardly looked at from the developing roller 9*c*, and an external contact portion 121*e* bent from the fourth conductive portion 121*d* in the same direction. In order to support such a developing bias contact 121, the developing roller bearing box 9*v* is provided with a support portion 9*v*8 protruding toward a longitudinal interior, which support portion 9*v*8 is contacts with the third and fourth conductive portions 121*c*, 121*d* and the external contact portion 121*e*. Further, the second conductive portion 121*b* is provided with a stop hole 121*f* press-fitted onto a dowel 9*v*9 protruded longitudinally inwardly from the rear surface of the developing roller bearing box 9*v*. When the process cartridge B is mounted to the apparatus body 14, the external contact portion 121*e* of the developing bias contact 121 is contacted with a developing bias contact member 125 (described later) of the apparatus body 14. In this way, developing bias is applied to the developing roller 9*c*.

Two cylindrical projections 9*v*1 of the developing roller bearing box 9*v* are fitted into holes 12*m* formed in one longitudinal end portion of the developing frame 12, thereby positioning the developing roller bearing box 9*v* with respect to the developing frame 12. Further, small screws (not shown) passing through the threaded holes 9*v*2 of the developing roller bearing box 9*v* are threaded into threaded holes 12*c* of the developing frame 12, thereby securing the developing roller bearing box 9*v* to the developing frame 12.

Next, the antenna rod 9*h* for detecting the toner remaining amount will be explained. As shown in FIGS. 14 and 19, the antenna rod 9*h* has one end bent as a crank. A contact portion 9*h*1 (toner remaining amount detecting contact 122) on this one end contacts the toner detecting contact member 126 (described later) attached to the apparatus body 14 and is electrically connected to the contact member. In order to attach the antenna rod 9*h* to the developing frame 12, first of all, a tip end of the antenna rod 9*h* is inserted into the interior of the developing frame 12 through a through-hole 12*b* formed in the side plate 12B of the developing frame. Then, the tip end is supported in a hole (not shown) formed in the other side plate of the developing frame 12. In this way, the antenna rod 9*h* is positioned and supported by the through-hole 12*b* and the hole (not shown). A seal member (not shown) (for example, made of synthetic resin or felt or sponge) is inserted into the through-hole 12*b* to prevent the toner from entering into the through-hole.

The crank-shaped arm portion of the contact portion 9*h*1 is positioned so that, when the developing roller bearing box 9*v* is attached to the developing frame 12, the developing roller bearing box 9*v* prevents the movement of the antenna rod 9*h* to prevent the antenna rod 9*h* from escaping outside.

When the toner frame 11 is joined to the developing frame 12, the side plate 12A of the developing frame 12 through which the tip end of the antenna rod 9*h* is inserted is extended laterally of the toner frame to be opposed to the toner cap 11*f* provided on the lower toner frame 11*b*, thereby partially cover the toner cap 11*f*. Further, as shown in FIG. 16, the side plate 12A is provided with a hole 12*x* into which a shaft coupling portion 9*s*1 (FIG. 15) of a toner feed gear 9*s* for transmitting a driving force to the toner feed member 9*b* is inserted. The toner feed gear 9*s* has the shaft coupling portion 9*s*1 connected to a coupling member 11*e* (FIGS. 16 and 20) engaged by the end of the toner feed member 9*b* and rotatably supported by the toner frame 11 to transmit the driving force to the toner feed member 9*b*.

As shown in FIG. 19, the toner agitating member 9*e* is rotatably supported by the developing frame 12 in parallel with the antenna rod 9*h*. The toner agitating member 9*e* has a crank shape in which one of the journals is fitted into a bearing hole (not shown) of the side plate 12B and the other journal is fitted into a toner agitating gear 9*m* integrally having a shaft portion rotatably supported by the side plate 12A shown in FIG. 16, and a crank arm is engaged by a notch of the shaft portion to transmit rotation of the agitating gear 9*m* to the toner agitating member 9*e*.

Next, transmission of the driving force to the developing unit D will be explained.

As shown in FIG. 15, the D-cut shaft 9*g*1 of the magnet 9*g* is fitted into the support hole 40*a* of the developing holder 40 to be supported in the non-rotating manner. When the developing holder 40 is attached to the developing frame 12, the developing roller gear 9*k* is meshes with a gear 9*q* in a gear train DT and the toner agitating gear 9*m* is meshes with a small gear 9*s*2. As a result, the toner feed gear 9*s* and the toner agitating gear 9*m* can receive the driving force from the developing roller gear 9*k*.

All of gears from the gear 9*q* to the toner feed gear 9*s* are idler gears. The gear 9*q* meshed with the developing roller gear 9*k* and a small gear 9*q*1 integral with the gear 9*q* are rotatably supported by a dowel 40*b* integral with the developing holder 40. A large gear 9*r* meshed with the small gear 9*q*1 and a small gear 9*r*1 integral with the gear 9*r* are rotatably supported by a dowel 40*c* integral with the developing holder 40. The small gear 9*r*1 is meshes with the toner feed gear 9*s*. The toner feed gear 9*s* is rotatably supported by a dowel 40*d* integral with the developing holder 40. The toner feed gear 9*s* has a shaft coupling portion 9*s*1. A small gear 9*s*2 is meshes with the toner feed gear 9*s*. The small gear 9*s*2 is rotatably supported by a dowel 40*e* integral with the developing holder 40. The dowels 40*b*, 40*c*, 40*d*, 40*e* have diameters of about 5 to 6 mm and supports the gears in the gear train GT.

With the above-mentioned arrangement, the gears constituting the gear train can be supported by the same member (developing holder 40 in the illustrated embodiment). That is to say, after the antenna rod 9*h* and the toner agitating member 9*e* are incorporated into the developing frame 12, by incorporating the developing roller unit G into the developing portion drive transmitting unit DG and by incorporating the gear box 9*v* into the developing frame 12, the developing unit D is completed.

In FIG. 19, an opening portion 12*p* is provided along the longitudinal direction of the developing frame 12. Under the condition that the toner frame 11 is joined to the developing frame 12, the opening portion 12*p* is opposed to the opening portion 11*i* of the toner frame 11. In this way, the toner contained in the toner frame 11 can be sent to the developing roller 9*c*. The agitating member 9*e* and the antenna rod 9*h* are attached along the entire length of the opening portion 12*p*.

The material for the developing frame 12 is the same as the material for the toner frame 11.

Construction of Electrical Contacts

Next, the connection and arrangement of the contact for electrically connecting the process cartridge B to the body 1 of the image forming apparatus when the process cartridge B is mounted to the apparatus body 14 will be explained with reference to FIGS. 8, 9, 11, 24 and 26.

As shown in FIG. 8, the process cartridge B has a plurality of electrical contacts. That is to say, the following four contacts are exposed from the side and bottom surfaces of the cartridge frame: (1) a cylindrical guide 13*a*L (the reference numeral 119 is used when explained as the conductive grounding contact) as a conductive grounding contact electrically connected to the photosensitive drum 7 in order to effect grounding between the photosensitive drum 7 and the apparatus body 14, (2) a conductive charge bias contact 120 electrically connected to the charge roller shaft 8*a* in order to apply a charge bias from the apparatus body 14 to the charge roller 8, (3) a conductive developing bias contact 121 electrically a connected to the developing roller 9*c* in order to apply a developing bias from the apparatus body 14 to the developing roller 9*c*, and (4) a conductive toner remaining amount detecting contact 122 electrically connected to the antenna rod 9*h* in order to detect the toner remaining amount. The four contacts 119 to 122 are provided on the side and bottom surfaces of the cartridge frame at the left side looked at from the process cartridge mounting direction and are spaced apart from each other so that there is no electrical leakage between the contacts. The grounding contact 119 and the charge bias contact 120 are provided on the cleaning unit C, and the developing bias contact 121 and the toner remaining amount detecting contact 122 are provided on the developing frame 12. The toner remaining amount detecting contact 122 also acts as a process cartridge presence/absence detecting contact for causing the apparatus body 14 to detect the fact that the process cartridge B is mounted to the apparatus body 14.

As shown in FIG. 11, the grounding contact 119 is integrally connected with the conductive flange 29 mentioned above, and the drum shaft 7*a* integral with the flange 29 is disposed coaxial with the grounding contact 119, and a grounding plate 7*f*, electrically connected to the drum cylinder 7*d*, is urged against the drum shaft 7*a*, thereby directing electricity outside. In the illustrated embodiment, the flange 29 is formed from metallic material, such as iron. The charge bias contact 120 and the developing bias contact 121 are obtained by wiring conductive metal (for example, stainless steel or bronze phosphite) plates having a thickness of about 0.1 mm to 0.3 mm from the interior of the process cartridge. The charge bias contact 120 is exposed from the bottom of the driven side of the cleaning unit C, and the developing bias contact 121 and the toner remaining amount detecting contact 122 are exposed from the bottom of the driven side of the developing unit D.

Next, the developing bias contact 121 and the toner remaining amount detecting contact 122 will be explained. The contacts 121, 122 are provided on the bottom of the developing unit D situated at the same side as one lateral end 13*k* of the cleaning frame 13. The third conductive portion (i.e., external contact portion 121*e*) of the developing bias contact 121 is disposed in an opposed relation to the charge bias contact 120 with the interposition of the spur gear 7*n*. As mentioned above, the developing bias contact 121 is electrically connected to the developing roller 9*c* via the developing coil spring contact 91 electrically connected to the end of the developing roller 9*c* (FIG. 18).

The toner remaining amount detecting contact 122 shown in FIG. 8 is exposed from the developing frame 12 at an upstream side of the developing bias contact 121 in the cartridge mounting direction (arrow X in FIG. 9). As shown in FIG. 19, the toner remaining amount detecting contact 122 forms a part of conductive material (for example, metallic antenna rod 9*h*) provided on the developing frame 12 along the longitudinal direction of the developing roller 9*c*, at the toner frame 11 side of the developing roller 9*c*. As mentioned above, the antenna rod 9*h* is situated with a constant distance to the developing roller 9*c* along the entire length of the developing roller 9*c*. When the process cartridge B is mounted to the apparatus body 14, the antenna rod contracts with the toner detecting contact member 126 of the apparatus body 14. Electrostatic capacity between the antenna rod 9*h* and the developing roller 9*c* is charged in accordance with the amount of toner existing therebetween. Thus, by detecting the change in electrostatic capacity as a change in potential by means of a control means 500 (FIG. 41) electrically connected to the toner detecting contact member 126 of the apparatus body 14, the toner remaining amount is detected.

The toner remaining amount is an amount of toner in which the toner existing between the developing roller 9*c* and the antenna rod 9*h* generates predetermined electrostatic capacity. Thus, the fact that the amount of toner remaining in the toner container 11A reaches a predetermined value can be detected. The fact that the electrostatic capacity reaches a first predetermined value is detected by the control portion of the apparatus body 14 via the toner remaining amount detecting contact 122, and it is judged that the amount of toner remaining in the toner container 11A reaches the predetermined value. When the fact that the electrostatic capacity reaches the first predetermined value is detected, the apparatus body 14 alarms replacement of the process cartridge B (for example, by the flash of a lamp, or a buzzer sound). When the fact that the electrostatic capacity reaches a second predetermined value smaller than the first predetermined value is detected, the control portion detects the fact that the process cartridge B is mounted to the apparatus body 14. If the fact that the process cartridge B is mounted is not detected, the control portion does not start the image forming operation of the apparatus body 14.

Incidentally, information regarding non-mounting of the process cartridge may be effected (for example, flash of lamp).

Next, a connection between the contacts of the process cartridge B and the contacts of the apparatus body 14 will be explained.

As shown in FIG. 9, four contact members (grounding contact member 123 electrically connected to the grounding contact 119, charge contact member 124 electrically connected to the charge bias contact 120, developing bias contact member 125 electrically connected to the developing bias contact 121, and toner detecting contact member 126 electrically connected to the toner remaining amount detecting contact 122) which can be connected to the contacts 119–122 when the process cartridge B is mounted are provided on an inner surface of one side of the cartridge mounting space S of the image forming apparatus A.

As shown in FIG. 9, the grounding contact member 123 is disposed on the bottom of the positioning groove 16*b*. The developing bias contact member 125, the toner detecting contact member 126 and the charge contact member 124 are elastically provided facing upwardly, below and outwardly of the guide portion 16*a* and below the wall of one side of the cartridge mounting space S in the vicinity of the guide portion 16*a*.

Now, positional relations between the contacts and the guides will be described.

Under the condition shown in FIG. 6 that the process cartridge B is positioned substantially horizontally, regarding a vertical direction, the toner remaining amount detecting contact 122 is located at the lowermost position, and the developing bias contact 121 is located thereabove, and the charge bias contact 120 is located thereabove, and the rotation-preventing guide 13*b*L and the cylindrical guide 13*a*L (grounding contact 119) are located thereabove at substantially the same height. In the cartridge mounting direction (shown by the arrow X), the toner remaining amount detecting contact 122 is located the most upstream side, and the rotation-preventing guide 13*b*L and the developing bias contact 121 are located at a downstream side therefrom, and the cylindrical guide 13*a*L (grounding contact 119) is located at a downstream side therefrom, and the charge bias contact 120 is located at a downstream side therefrom.

Figure 30:
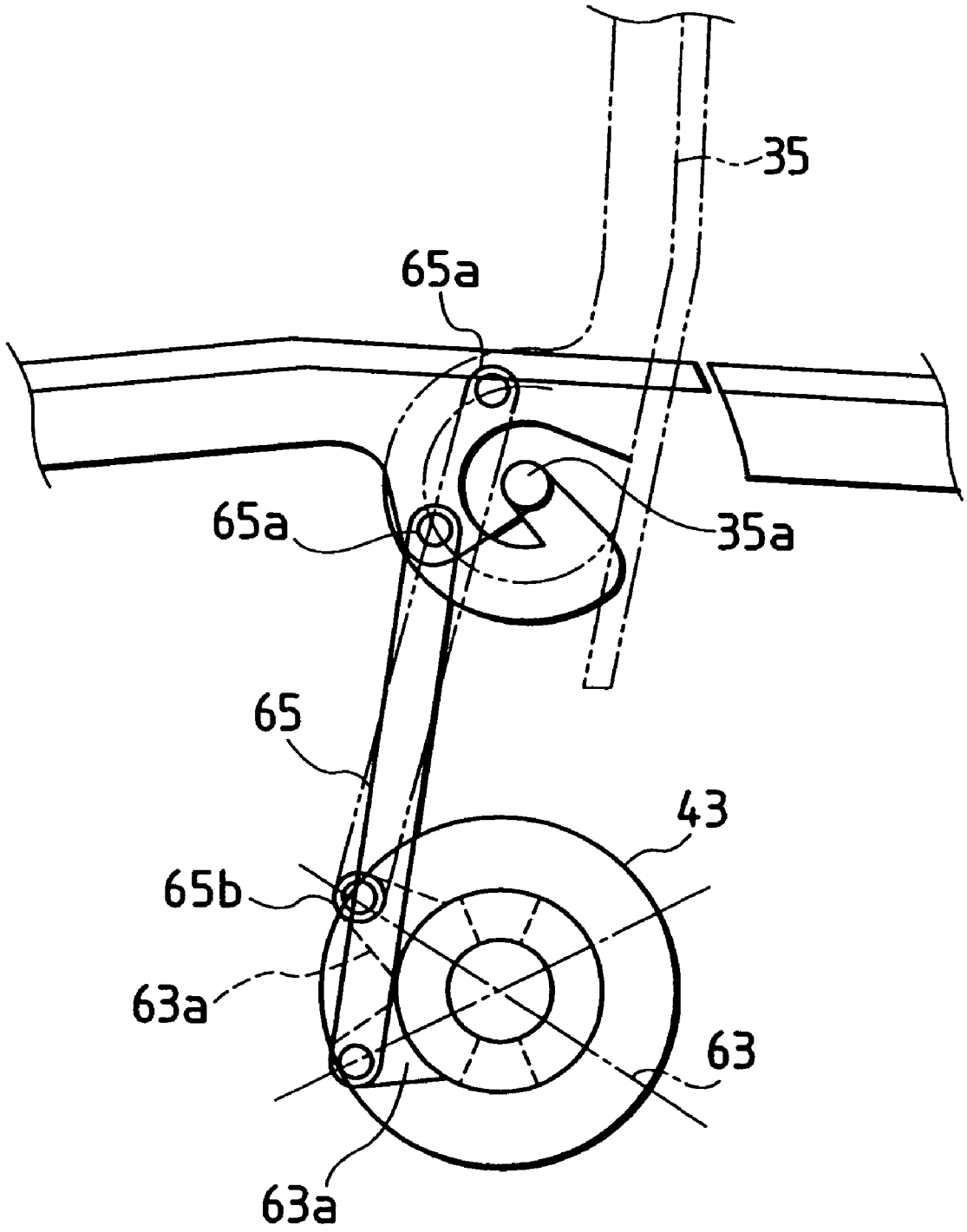
FIG. 30 is a sectional view showing constructions of an open/close member of the main body of the electrophotographic image forming apparatus and a coupling portion.

The grounding contact member 123 is formed from a conductive leaf spring member. The grounding contact member 123 is disposed within the positioning groove 16*b* into which the grounding contact 119, i.e., cylindrical guide 13*a*L (by which the drum shaft 7*a* is positioned) is fitted (FIGS. 9, 11 and 26) and is grounded via a chassis of the apparatus body. The toner detecting contact member 126 is formed from a conductive leaf spring member disposed below the guide portion 16*a* and in the vicinity of the guide portion 16*a*. The other contact members 124, 125 are disposed below the guide portion 16*a* and in the vicinity of the guide portion 16*a* and are protrude upwardly from a holder 127 by means of respective compression coil springs 129. Now, the charge contact member 124 will be described as an example. As shown in FIG. 30 with an enlarged scale, the charge contact member 124 is attached within the holder 127 in such a manner that it is not disengaged from the holder and it can be protrude upwardly. The holder 127 is secured to an electric substrate 128 attached to the apparatus body 14, so that the contact member and a wiring pattern are electrically interconnected by a conductive compression spring 129.

When the process cartridge B is inserted into the image forming apparatus A and is mounted thereto while being guided by the guide portion 16*a*, before the cartridge reaches the predetermined position, the contact members 123 to 126 are protrude by the respective spring forces. In this case, the contacts 119 to 122 of the process cartridge are not contacted with the contact members. When the process cartridge B is further inserted, the contacts 119 to 122 of the process cartridge are contacted with the contact members 123 to 126. After further inserted, when the cylindrical guide 13*a*L is fitted into the positioning recess 16*b*, the contacts 119 to 122 are firmly urged against the contact members 123 to 126 in opposition to the spring forces.

In this way, in the illustrated embodiment, when the process cartridge B is mounted to the predetermined mounting position while being guided by the guide member 16, the contacts are positively connected to the contact members.

When the process cartridge B is mounted to the predetermined mounting position, the leaf spring-shaped grounding contact member 123 contacts the grounding contact 119 protruding from the cylindrical guide 13*a*L (FIG. 11). Now, when the process cartridge B is mounted to the body 14 of the image forming apparatus, the ground contact 119 and the grounding contact member 123 are electrically interconnected, thereby grounding the photosensitive drum 7. Further, the charge bias contact 120 and the charge contact member 124 are electrically interconnected, thereby applying high voltage (overlap of AC voltage and DC voltage) to the charge roller 8. Further, the developing bias contact 121 and the developing bias contact member 125 are electrically interconnected, thereby applying high voltage to the developing roller 9*c*. Further, the toner remaining amount detecting contact 122 and the toner detecting contact member 126 are electrically interconnected, thereby transmitting information corresponding to the electrostatic capacity between the contact 122 and the developing roller 9*c* to the apparatus body 14.

When the process cartridge B is mounted to the body 14 of the image forming apparatus, as will be described later, the coupling of the process cartridge is coupled to the coupling of the apparatus body in response to the closing movement of the open/close member 35, so that the photosensitive drum 7 and the like can receive the driving force from the apparatus body 14.

Coupling and Drive Arrangement

Next, the coupling means as a driving force transmitting mechanism for transmitting the driving force from the body 14 of the image forming apparatus to the process cartridge B will be explained.

FIG. 11 is an elevational sectional view showing a condition that the photosensitive drum 7 is attached to the process cartridge B.

As shown in FIG. 11, a cartridge side coupling means is provided on one longitudinal end of the photosensitive drum 7 attached to the process cartridge B. The coupling means includes a coupling protruded shaft 37 (cylindrical shape) provided on a drum flange 36 secured to one end of the photosensitive drum 7, and a protrusion 37*a* is formed on a tip end of the coupling protruded shaft 37. The protruded shaft 37 is fitted into a bearing 38 to act as a drum rotary shaft. In the illustrated embodiment, the drum flange 36 and the coupling protruded shaft 37 and the protrusion 37*a* are integrally formed. The drum flange 36 is provided with the integral helical drum gear 7*b* to transmit the driving force to the developing roller 9*c* within the process cartridge B. Accordingly, as shown in FIG. 11, the drum flange 36 is an integral part (driving force transmitting part) including the coupling protruded shaft 37 and the protrusion 37*a* and having a function for transmitting the driving force.

The shape of the protrusion 37*a* is a twisted polygonal prism; more particularly, it is a trigonal prism gradually twisted in the rotational direction along the axial direction. A recess 39*a* fitted on the protrusion 37*a* is a hole having a triangular cross-section and being gradually twisted in the rotational direction along the axial direction. The twist pitch of the protrusion 37*a* is substantially the same as that of the recess 39*a*, and they are twisted in the same direction. Incidentally, the recess 39*a* has a substantially triangular cross-section. The recess 39*a* is formed in a coupling recessed shaft 39*b* integrally formed with a gear 43 of the apparatus body 14. The coupling recessed shaft 39*b* is provided within the apparatus body 14 for rotational movement and axial shifting movement, as will be described later. In the arrangement according to the illustrated embodiment, when the process cartridge B is mounted to the apparatus body 14 and the protrusion 37*a* is fitted into the recess 39*a* of the apparatus body 14 to transmit the rotational force from the recess 39*a* to the protrusion 37*a*, since edge lines of the protrusion (substantially triangular prism) 37*a* are equally contacted with inner surfaces of the recess 39*a*, the centers thereof are aligned with each other. Thus, a diameter of a circumscribed circle of the coupling protrusion 37*a* is selected to be greater than an inscribed circle of the coupling recess 39*a* and smaller than a circumscribed circle of the coupling recess 39*a*. Further, due to the twisted configurations, the recess 39*a* generates a force for pulling the protrusion 37*a* toward the recess 39*a*, thereby abutting an end face 37*a*1 of the protrusion against a bottom 39*a*1 of the recess 39*a*. Since the thrust forces generated at the coupling and the drum gear 7*b* direct toward the same directions as shown by the arrow d, axial and radial positions of the photosensitive drum 7 integral with the protrusion 37*a* within the body 14 of the image forming apparatus are stably determined.

In the illustrated embodiment, looked at from the photosensitive 7 side, the twisted direction of the protrusion 37*a* (from the root to the top) is opposite to the rotational direction of the photosensitive drum 7, and the twisted direction of the recess 39*a* (from inlet to bottom) is opposite to the rotational direction of the photosensitive drum 7, and the twisted direction of the drum gear 7*b* of the drum flange 36 is opposite to the twisted direction of the protrusion 37*a*.

The protruded shaft 37 and the protrusion 37*a* are provided on the drum flange 36 in such a manner that, when the drum flange 36 is attached to one end of the photosensitive drum 7, they are aligned with the axis of the photosensitive drum 7. When the drum flange 36 is attached to one end of the photosensitive drum 7, a fitting portion 36*b* is fitted into an inner surface 7*d*1 of the drum cylinder 7*d*. The drum flange 36 is attached to one end of the photosensitive drum 7 by crimping or adhesive. The drum cylinder 7*d* is coated by the photosensitive layer 7*e*.

As mentioned above, the spur gear 7*n* is secured to the other end of the photosensitive drum 7.

The drum flange 36 and the spur gear 7*n* are made of resin material such as polyacetal, polycarbonate, polyamide or polybutylene telephthalate. However, other appropriate material may be used.

Around the protrusion 37*a* of the coupling protruded shaft 37 of the process cartridge B, a cylindrical protrusion 38*a* (cylindrical guide 13*a*R) concentric with the protruded shaft 37 is integrally formed with the bearing 38 secured to the cleaning frame 13 (FIG. 12). When the process cartridge B is mounted and dismounted, the protrusion 37*a* of the coupling protruded shaft 37 is protected by the protrusion 38*a* to prevent damage and deformation due to an external force. Therefore, play and vibration (during the driving of the coupling), which may be caused by such damage of the protrusion 37*a*, can be prevented.

The bearing 38 can also act as a guide member utilized when the process cartridge B is mounted and dismounted with respect to the body 14 of the image forming apparatus. That is to say, when the process cartridge B is mounted to the body 14 of the image forming apparatus, the protrusion 38*a* of the bearing 38 abuts against the guide portion 16*c* of the apparatus body, so that the protrusion 38*a* acts as the positioning guide 13*a*R when the process cartridge B is mounted to the mounting position, thereby facilitating the mounting and dismounting of the process cartridge B with respect to the apparatus body 14. When the process cartridge B is mounted to the mounting position, the protrusion 38*a* is supported by the positioning recess 16*d* provided in the guide portion 16*c*.

Figure 25:
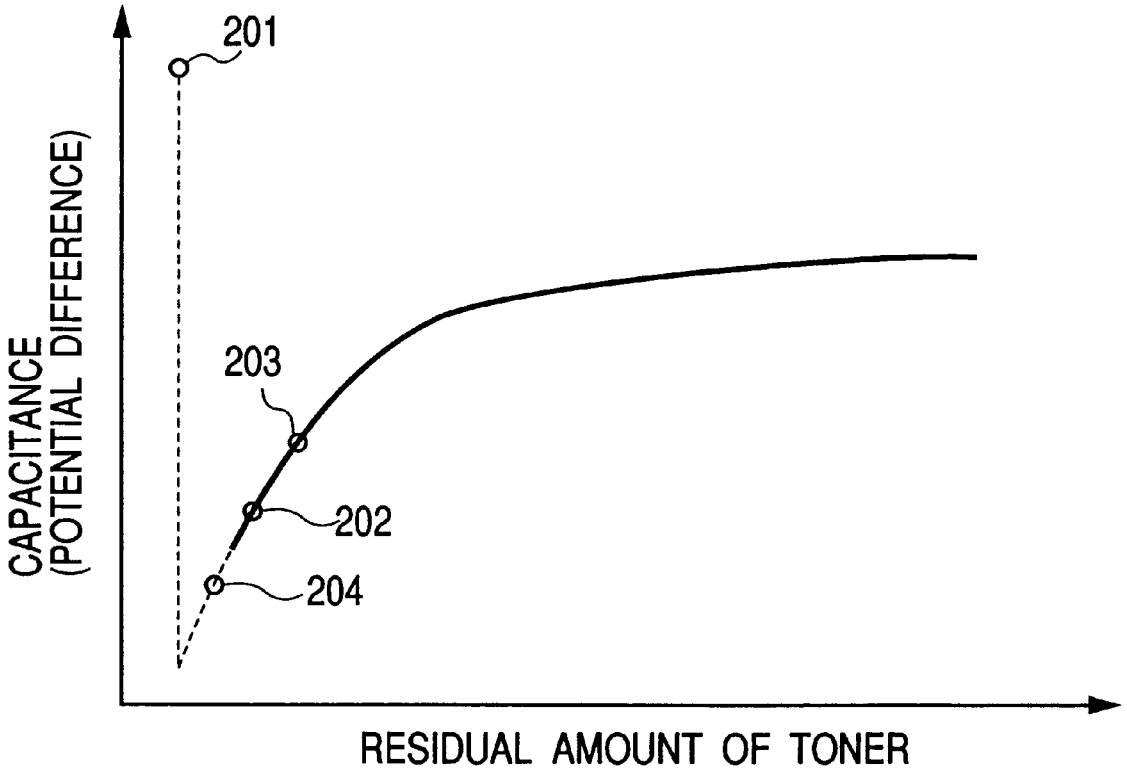
FIG. 25 is a graph showing the relation between a toner remaining amount and electrostatic capacity.
Figure 27:
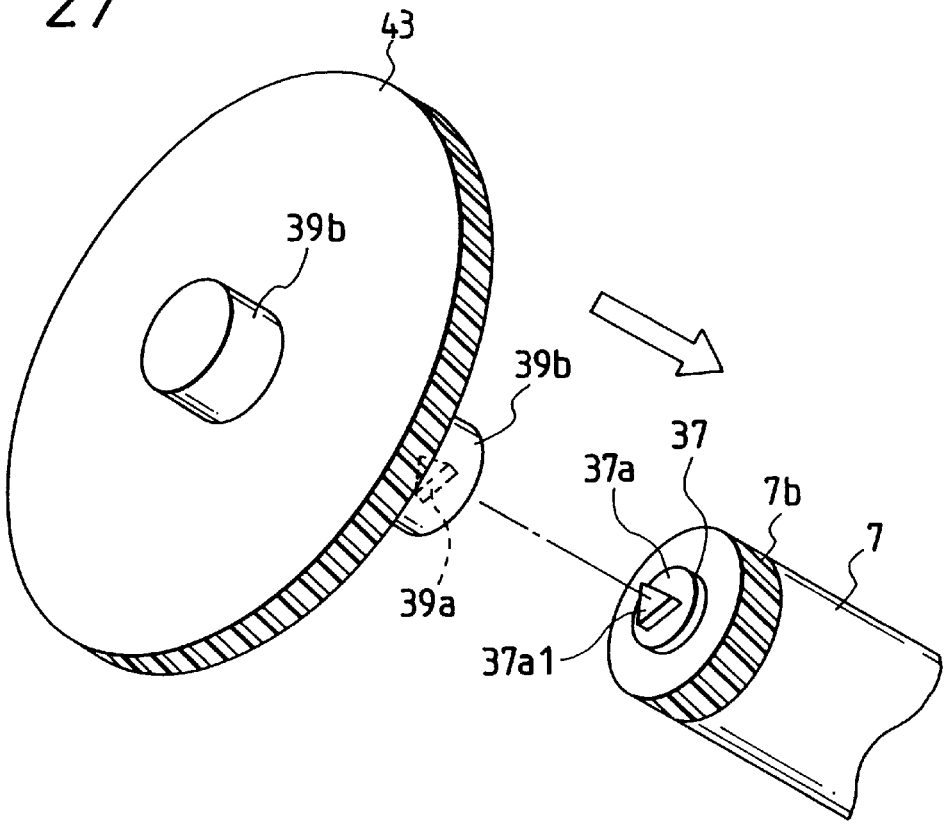
FIG. 27 is a perspective view of a coupling provided on the main body of the electrophotographic image forming apparatus and a coupling of the process cartridge.

On the other hand, the apparatus body 14 is provided with a body coupling means. The body coupling means includes a coupling recessed shaft 39*b* (cylindrical shape) which is aligned with the rotation axis of the photosensitive drum 7 when the process cartridge B is inserted (FIGS. 11 and 25). As shown in FIG. 11, the coupling recessed shaft 39*b* is a drive shaft integral with a large gear 43 for transmitting a driving force of a motor 61 to the photosensitive drum 7. (The recessed shaft 39*b* is positioned on the rotation center of the large gear 43 and is protrudes from a side surface of the large gear 43 (FIGS. 27 and 28).) In the illustrated embodiment, the large gear 43 and the coupling recessed shaft 39*b* are integrally formed.

The large gear 43 of the apparatus body 14 is a helical gear which is meshed with a small helical gear 62 secured to or integrally formed with a shaft 61*a* of the motor 61, and the large gear has a twisted direction and an inclined angle so that, when the driving force is transmitted from the small gear 62, the large gear generates a thrust force for shifting the recessed shaft 39*b* toward the protruded shaft 37. With this arrangement, in the image formation operation, when the motor 61 is driven, the recessed shaft 39*b* is shifted toward the protruded shaft 37 by the thrust force, thereby inter-engaging the recess 39*a* and the protrusion 37*a*. The recess 39*a* is provided in the tip end of the recessed shaft 39*b* in alignment with the rotational center of the recessed shaft 39*b*.

Incidentally, in the illustrated embodiment, while an example that the driving force is directly transmitted from the small gear 62 provided on the motor shaft 61*a* to the large gear 43 was explained, a gear train may be used to transmit the driving force with speed reduction, or, belt/pulleys or pair of friction rollers or timing-belt/pulleys may be used.

Next, an arrangement in which the recess 39*a* and the protrusion 37*a* are inter-fitted in synchronism with the closing operation of the open/close member 35 will be explained with reference to FIGS. 29 to 32.

Figure 32:
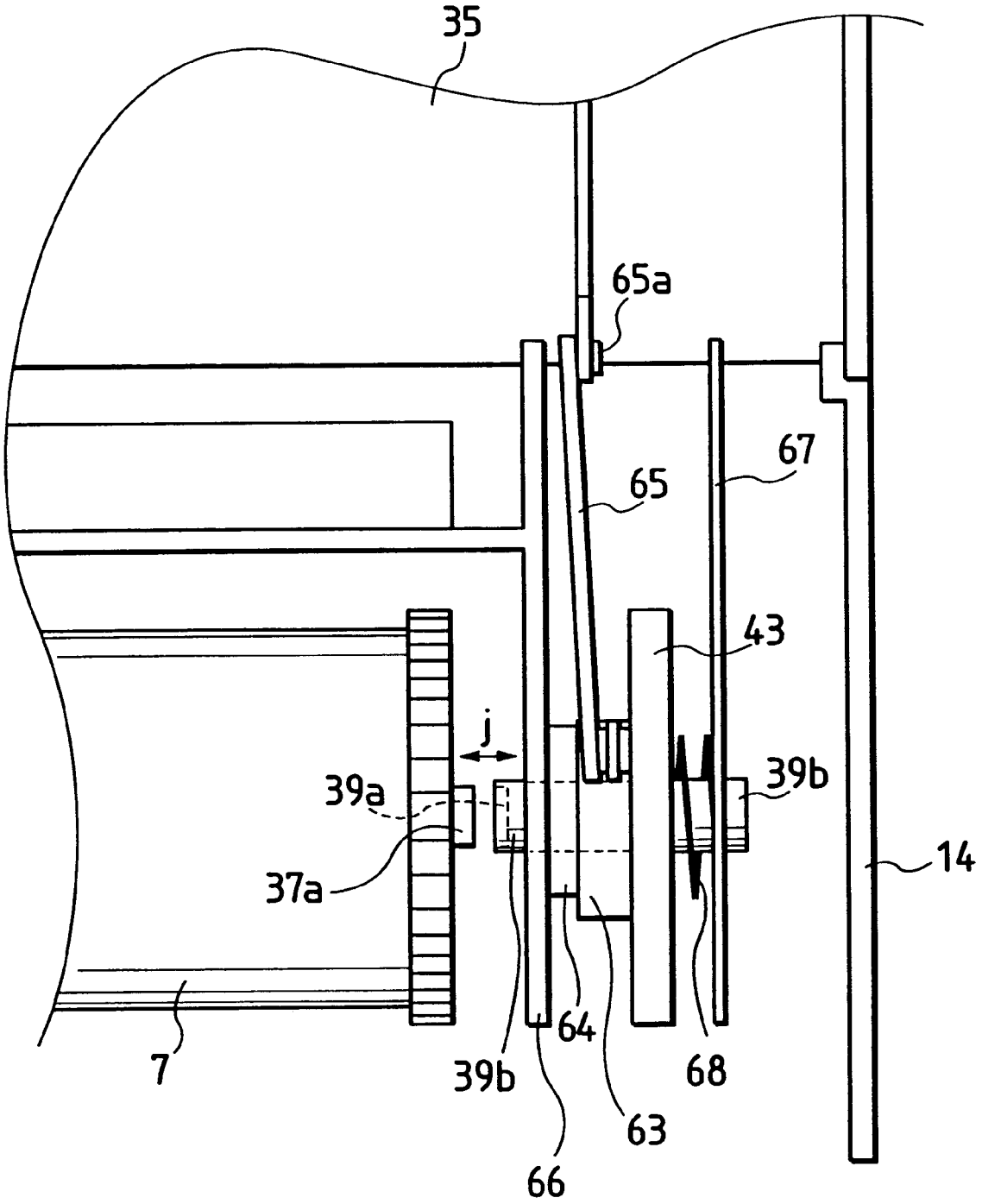
FIG. 32 is a front view showing the coupling recessed shaft and therearound when the process cartridge of the main body of the electrophotographic image forming apparatus is attached or detached.

As shown in FIG. 32, a fixed side plate 67 is opposed to a side plate 66 of the apparatus body 14 with the interposition of the large gear 43, and the coupling recessed shaft 39*b* integrally formed with the large gear 43 at its center is rotatably supported by the side plates 66, 67. An outer cam 63 and an inner cam 64 are closely interposed between the large gear 43 and the side plate 66. The inner cam 64 is secured to the side plate 66 and the outer cam 63 is rotatably mounted on the coupling recessed shaft 39*b*. Axial opposed surfaces of the outer and inner cams 63, 64 are cam surfaces which are threaded surfaces coaxial with the coupling recessed shaft 39*b*. Between the large gear 43 and the side plate 67, a compression spring 68 is mounted around the coupling recessed shaft 39*b* in a compressed condition.

Figure 31:
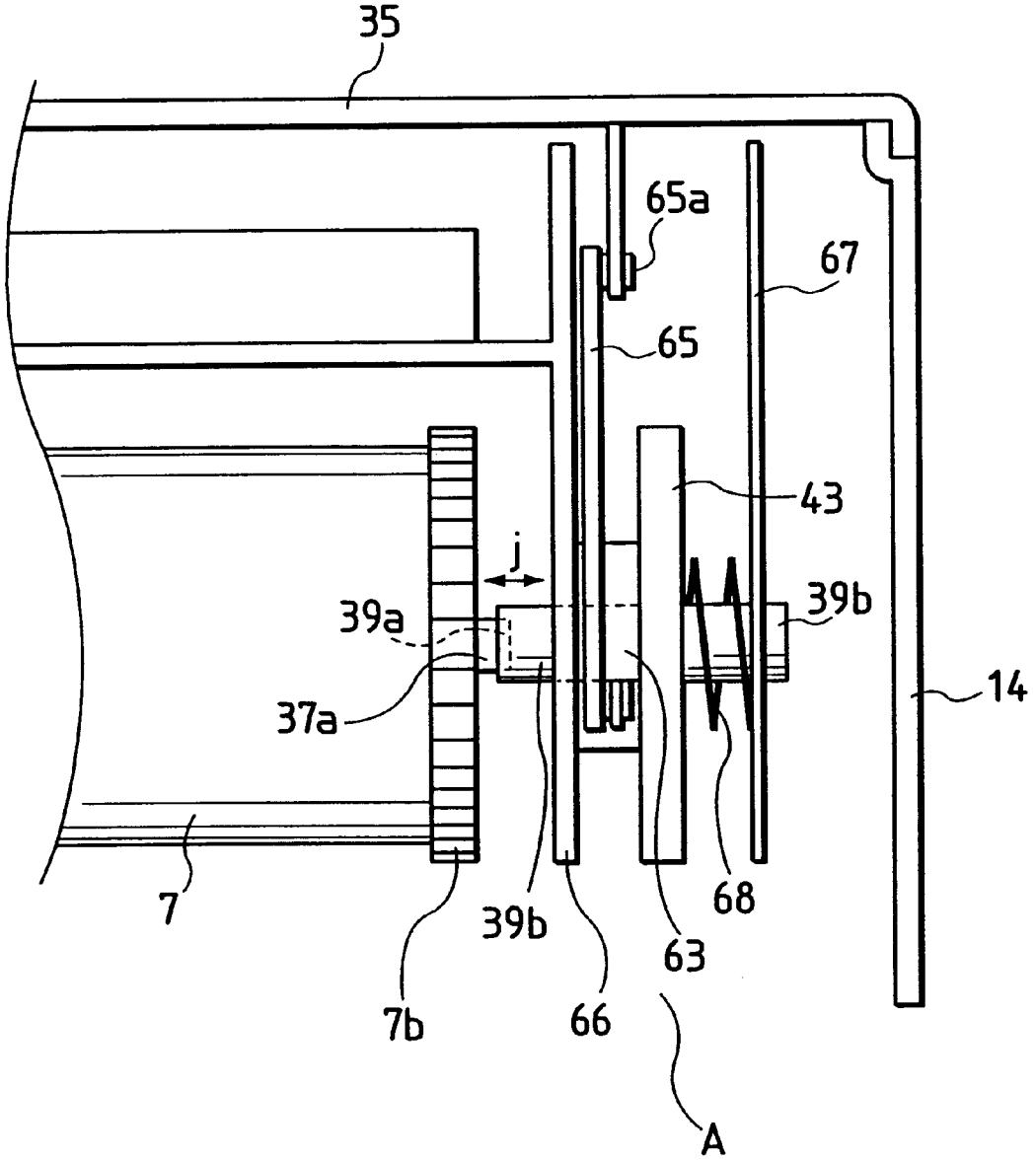
FIG. 31 is a front view showing a coupling recessed shaft and therearound when the process cartridge of the main body of the electrophotographic image forming apparatus is driven.

As shown in FIG. 30, an arm 63*a* extends radially from the periphery of the outer cam 63, and a free end of the arm 63*a* is connected to one end of a link 65 by a pin 65*b*, and an open end of the open/close member 35 extending obliquely and downwardly from the fulcrum 35*a* of the open/close member 35 in a closed condition shown in FIG. 31 is connected to the other end of the link 65 by a pin 65*a*.

FIG. 31 is a view looked at from the right. When the open/close member 35 is closed, the link 65 and the outer cam 63 are situated at positions as shown, and, in this case, the coupling protrusion 37*a* and the recess 39*a* are inter-engaged so that the driving force of the large gear 43 can be transmitted to the photosensitive drum 7. When the open/close member 35 is opened, the pin 65*a* is turned upwardly around the fulcrum 35*a* to lift the arm 63*a* via the link 65, with the result that the outer cam 63 is rotated to slidingly operate the opposed cam surfaces of the outer and inner cams 63, 64, thereby shifting the large gear 43 away from the photosensitive drum 7. In this case, the large gear 43 is pushed by the outer cam 63 to shift while urging the compression coil spring 68 disposed between the side plate 67 and the large gear 43, with the result that, as shown in FIG. 32, the coupling recess 39*a* is disengaged from the coupling protrusion 37*a* to release the coupling, thereby permitting the dismounting of the process cartridge B.

Conversely, when the open/close member 35 is closed, the pin 65*a* connecting between the open/close member 35 and the link 65 is turned downwardly around the fulcrum 35*a* to shift the link 65 downwardly and to lower the arm 63*a*, with the result that the outer cam 63 is rotated reversely. Consequently, by the action of the spring 68, the large gear 43 is shifted to the left from the position of FIG. 32 to the position of FIG. 31, with the result that the large gear 43 is set again at the position of FIG. 31 to fit the coupling recess 39*a* onto the coupling protrusion 37*a*, thereby permitting the transmission of the driving force. With this arrangement, the process cartridge B can be brought to the mounting/dismounting permitting condition and the drive permitting condition in dependence upon the opening and closing of the open/close member 35. Incidentally, by closing the open/close member 35, when the outer cam 63 is rotated reversely and the large gear 43 is shifted to the left from the position of FIG. 32, if the end faces of the coupling recess 39*a* and the coupling protrusion 37*a* abut against each other not fit the coupling recess 39*a* onto the coupling protrusion 37*a*, as will be described later, they are inter-fitted soon after the image forming apparatus A is started.

In this way, in the illustrated embodiment, when the process cartridge B is mounted and dismounted with respect to the apparatus body 14, the open/close member 35 is opened. In synchronism with the opening and closing of the open/close member 35, the coupling recess 39*a* is shifted in the horizontal direction (shown by the arrow j). Thus, when the process cartridge B is mounted and dismounted with respect to the apparatus body 14, the couplings (37*a*, 39*a*) of the process cartridge B and the apparatus body 14 are not interconnected or were not interconnected. Accordingly, the mounting and dismounting of the process cartridge B with respect to the apparatus body 14 can be effected smoothly. Further, in the illustrated embodiment, the coupling recess 39*a* is biased toward the process cartridge B by pushing the large gear 43 by means of the compression coil spring 68. Thus, when the coupling protrusion 37*a* and the coupling recess 39*a* is inter-fitted, if the coupling protrusion 37*a* and the coupling recess 39*a* abut against each other not to fit the coupling recess 39*a* onto the coupling protrusion 37*a*, after the process cartridge B is mounted to the apparatus body 14, when the motor 61 is firstly rotated, the coupling recess 39*a* is rotated, thereby fitting the coupling recess 39*a* onto the coupling protrusion 37*a*. If the mounting of the process cartridge B is improper to be positioned in front of the proper mounting position, a solenoid (not shown) is energized at the same time when pre-rotation operation (preliminary operation for the image forming operation) is performed, with the result that the process cartridge is set to the proper position and the coupling recess 39*a* is fitted onto the coupling protrusion 37*a* by the spring force of the compression coil spring 68.

Next, configurations of the protrusion 37*a* and recess 39*a* which are engagement portions of the coupling means will be explained.

Incidentally, as mentioned above, although the coupling recessed shaft 39 of the apparatus body 14 can be shifted in the axial direction, it cannot be shifted in the radial direction. On the other hand, the process cartridge B is mounted to the apparatus body 14 in such a manner that it can be shifted in the longitudinal direction and the cartridge mounting direction X (FIG. 9). In the longitudinal direction, the process cartridge B can be slightly moved between the guide members 16R, 16L of the cartridge mounting space S.

That is to say, when the process cartridge B is mounted to the apparatus body 14, a portion of the cylindrical guide 13*a*L (FIGS. 6, 7 and 8) formed on the flange 29 attached to the other longitudinal end of the cleaning frame 13 is closely fitted into the positioning recess 16*b* (FIG. 9) of the apparatus body 14 to position the cylindrical guide, with the result that the spur gear 7*n* secured to the photosensitive drum 7 is engaged by the gear (not shown) for transmitting the driving force to the transfer roller 4. On the other hand, at one longitudinal end (drive side) of the photosensitive drum 7, the cylindrical guide 13*a*R provided on the cleaning frame 13 is supported in the positioning recess 16*d* of the apparatus body 14.

By supporting the cylindrical guide 13*a*R in the positioning recess 16*d* of the apparatus body 14, the drum shaft 7*a* and the recessed shaft 39*b* are supported within a range of concentricity of ϕ 2.00 mm. In this way, a first centering action in the coupling process is completed.

Figure 28:
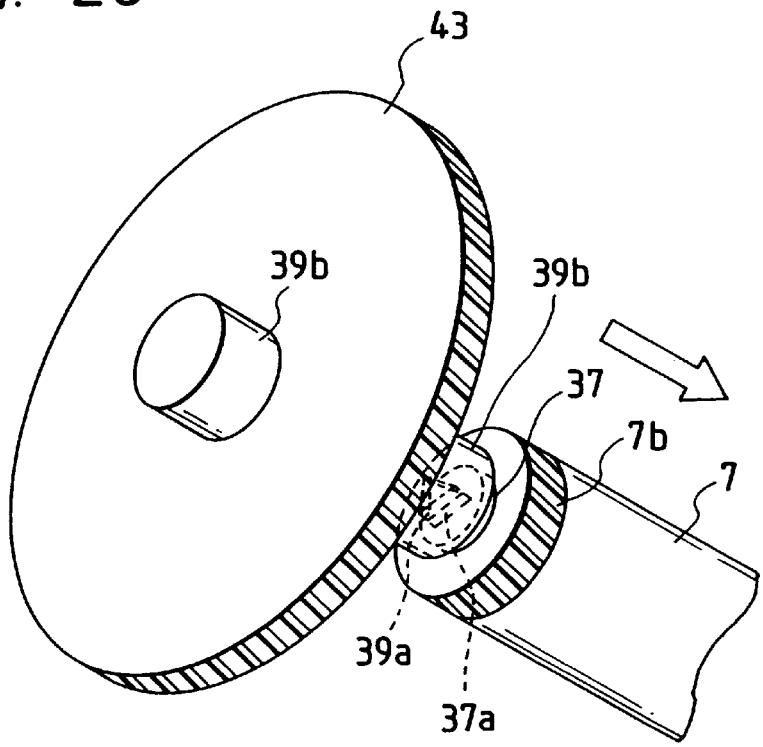
FIG. 28 is a perspective view of the coupling provided on the main body of the electrophotographic image forming apparatus and the coupling of the process cartridge.
Figure 29:
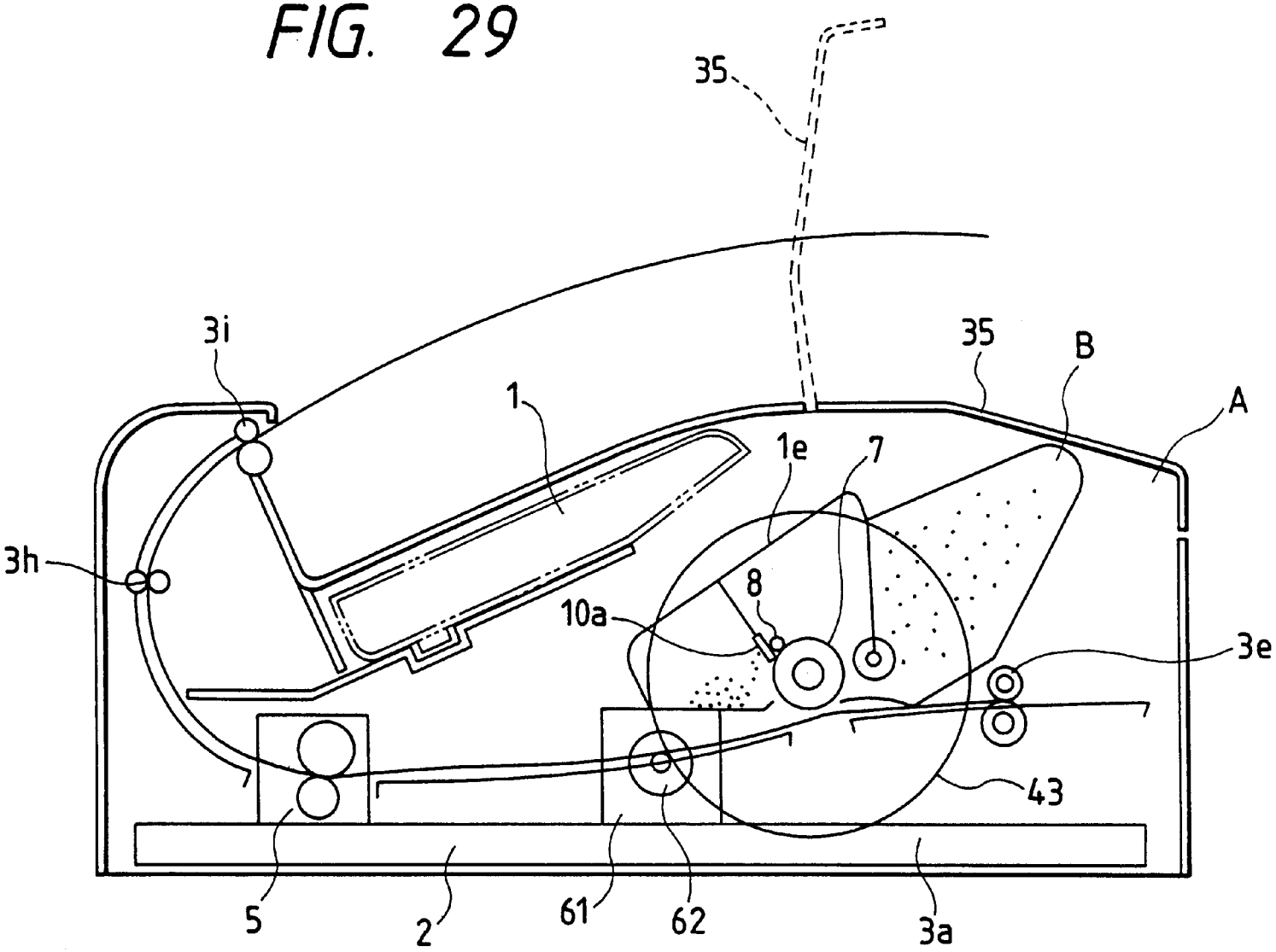
FIG. 29 is a schematic sectional view showing a drive system of the main body of the electrophotographic image forming apparatus.

By closing the open/close member 35, the coupling recess 39*a* is shifted horizontally to be fitted onto the protrusion 37*a* (FIG. 28).

Then, the drive side (coupling side) is positioned and drive-transmitted as follows.

First of all, when the motor 61 of the apparatus body 14 is rotated, the coupling recessed shaft 39*b* is shifted toward the coupling protruded shaft 37 (toward a direction opposite to the direction d in FIG. 11), with the result that, at the time when a phase of the coupling protrusion 37*a* is aligned with a phase of the recess 39*a* (in the illustrated embodiment, since the protrusion 37*a* and the recess 39*a* are substantially triangular, the phases of them are aligned every 120 degrees), they are engaged by each other, thereby transmitting the rotational force from the apparatus body 14 to the process cartridge B (the condition shown in FIG. 32 is changed to the condition shown in FIG. 31).

While the coupling is being effected, when the coupling protrusion 37*a* is entered into the recess 39*a*, since the sizes of the protrusion 37*a* and the recess 39*a* are different (i.e., the substantially triangular cross-section of the coupling recess 39*a* is greater than the substantially triangular coupling protrusion 37*a*), the protrusion 37*a* can smoothly be entered into the recess 39*a*.

During image formation, under the condition that the coupling protrusion 37*a* is entered into the recess 39*a*, when the coupling recessed shaft 39*b* is rotated, the inner surface of the coupling recess 39*a* contacts the three edge lines of the substantially triangular protrusion 37*a*, thereby transmitting the driving force. In this case, the coupling protruded shaft 37 is shifted instantaneously to be aligned with the center of the recessed shaft 39*b* so that the inner surface of the polygonal coupling recess 39*a* is equally contacted with the edge lines of the protrusion 37*a*.

With the arrangement as mentioned above, when the motor 61 is driven, the coupling protruded shaft 37 and recessed shaft 39*b* are automatically centered. Further, since the driving force is transmitted to the photosensitive drum 7, the rotational force is applied to the process cartridge B, with the result that (by this rotational force) the regulation abutment portion 13*j* (FIGS. 4, 5, 6, 7 and 26) provided on the upper surface of the cleaning frame 13 of the process cartridge B is strongly urged against the fixed member 25 (FIGS. 9, 10 and 26) of the apparatus body 14, thereby positioning the process cartridge B with respect to the body 14 of the image forming apparatus.

In a non-drive condition (non-image formation), since there is a gap between the coupling protrusion 37*a* and the recess 39*a* in the radial direction, engagement and disengagement between the coupling elements can be facilitated. In the drive condition, since the urging force at the interface between the coupling elements is stabilized, any play and vibration at the interface can be eliminated.

Figure 33:
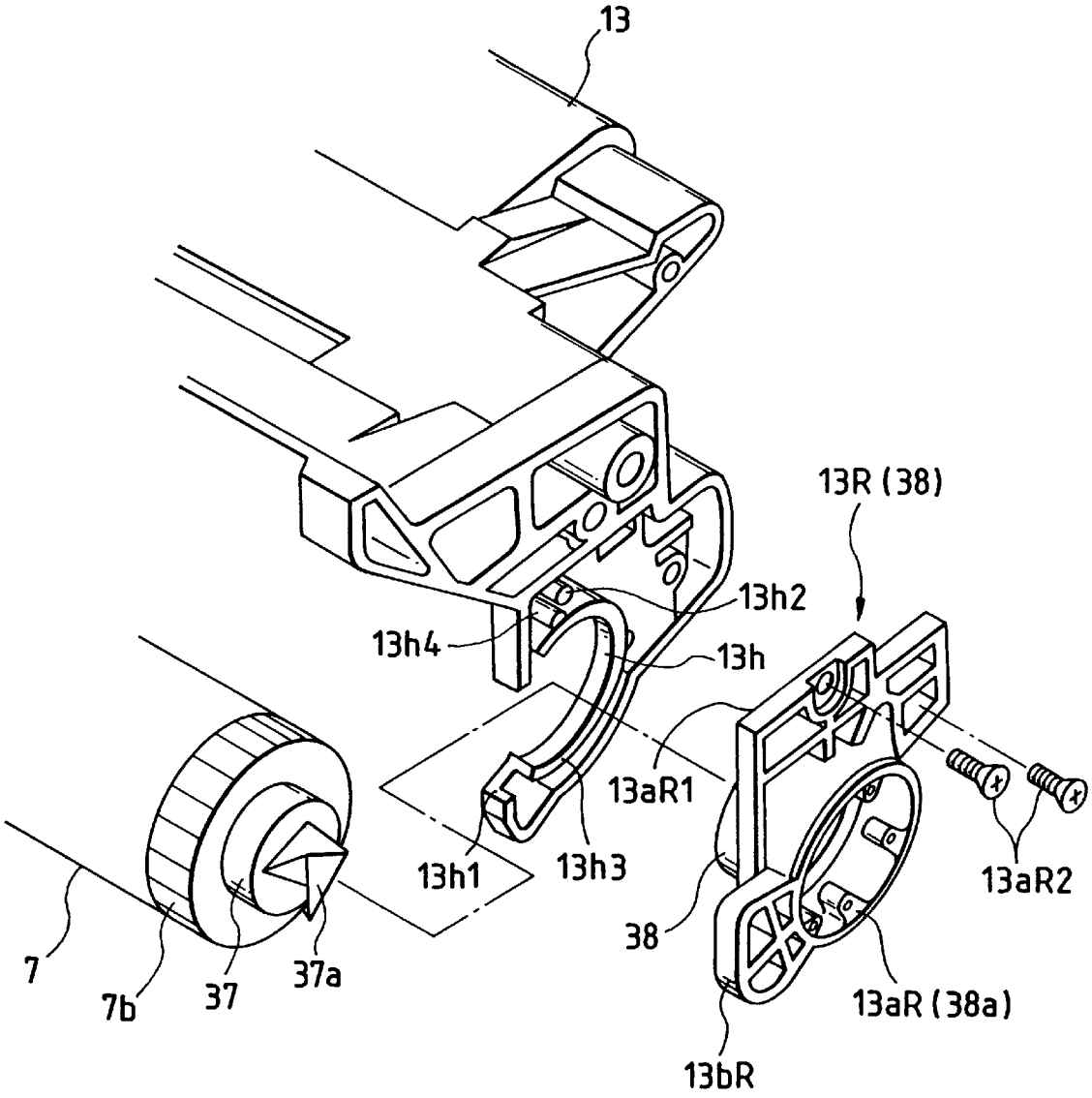
FIG. 33 is a perspective view showing an attachment portion of the process cartridge to a cleaning frame.
Figure 35:
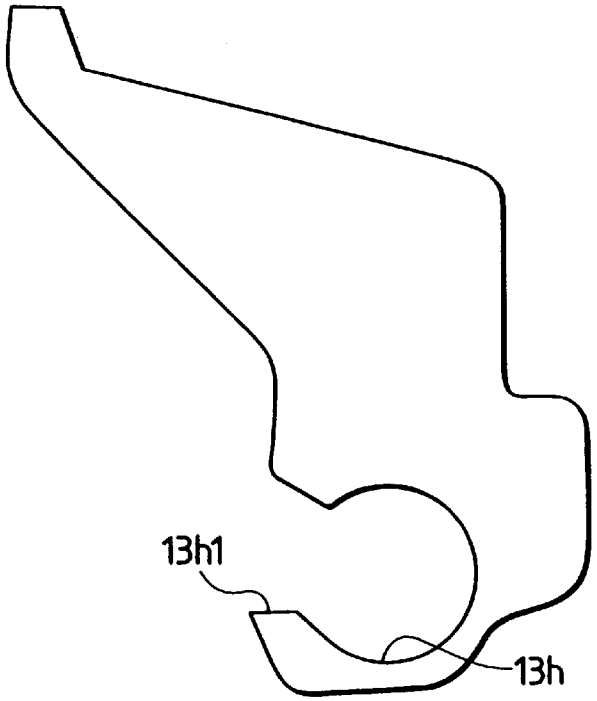
FIG. 35 is a side view showing an outer configuration of the drum bearing portion.

FIG. 33 is a perspective view fully showing an attachment relation between the right guide member 13R and the cleaning frame 13, FIG. 23 is an elevational sectional view showing a condition that the right guide member 13R is attached to the cleaning frame, and FIG. 35 is a view showing a portion of a right side surface of the cleaning frame 13. FIG. 35 is a side view showing an outline of the attachment portion of the bearing 38 integrally formed with the right guide member 13R.

Now, the attachment of the right guide member 13R (38) integral with the bearing 38 to the cleaning frame 13 schematically shown in FIG. 11 and the attachment of the unitized photosensitive drum 7 to the cleaning frame 13 will be fully explained.

Figure 34:
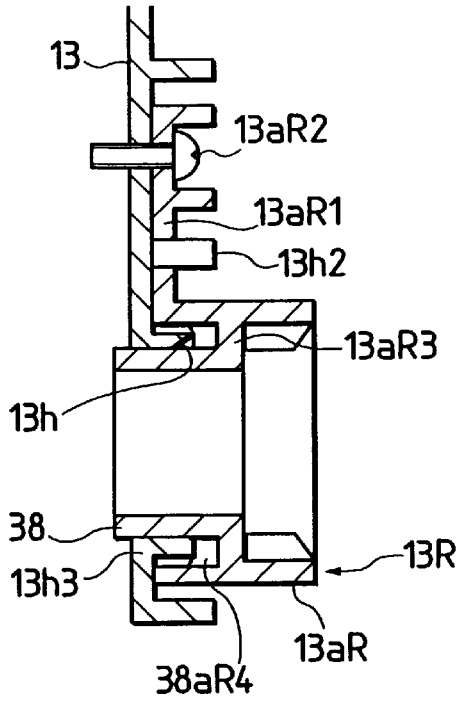
FIG. 34 is an elevational sectional view showing a drum bearing portion.

As shown in FIGS. 33 and 34, the bearing 38 having a small diameter and concentric with the cylindrical guide 13*a*R is provided on the rear surface of the right guide member 13R. A cylindrical end of the bearing 38 is connected to a circular plate member 13*a*R3 at an axial (longitudinal) intermediate portion of a cylindrical guide 38*a*R. A circular (looked at from the interior of the cleaning frame 13) groove 38*a*R4 is formed between the bearing 38 and the cleaning frame 13 side of the cylindrical guide 13*a*R.

As shown in FIGS. 33 and 35, a notched cylindrical bearing attachment hole 13*h* is formed in the side surface of the cleaning frame 13, and a distance or gap of the notched portion 13*h*1 is smaller than a diameter of the bearing attachment hole 13*h* and is greater than a diameter of the coupling protruded shaft 37. Further, since the coupling protruded shaft 37 is fitted into the bearing 38, there is a gap between the coupling protruded shaft 37 and the bearing attachment hole 13*h*. A positioning pin 13*h*2 integrally formed with the side surface of the cleaning frame 13 is closely fitted into a flange 13*a*Ra of the guide member 13R. Thus, the unitized photosensitive drum 7 can be attached to the cleaning frame 13 from a direction transverse to the axial (longitudinal) direction of the photosensitive drum 7, and, when the right guide member 13R is attached to the cleaning frame 13 from the longitudinal direction, a positional relation of the right guide member 13R with respect to the cleaning frame 13 is correctly determined.

In order to attach the unitized photosensitive drum 7 to the cleaning frame 13, as shown in FIG. 33, the photosensitive drum 7 is shifted in a direction transverse to the longitudinal direction, and the coupling protruded shaft 37 is passed through the notched portion 13*h*1 and is inserted into the bearing attachment hole 13*h* while keeping the drum gear 7*b* within the cleaning frame 13. In this condition, the drum shaft 7*a* integral with the right guide 13*a*L shown in FIG. 11 is passed through the side end 13*k* of the cleaning frame 13 and is fitted into the spur gear 7*n*, and the small screws 13*d* are threaded into the cleaning frame 13 through the lange 29 so that the guide 13*a*L is secured to the cleaning frame 13 and one end of the photosensitive drum 7 is supported.

Then, the periphery of the bearing 38 integral with the right guide member 13R is fitted into the bearing attachment hole 13*h* and the inner periphery of the bearing 38 is fitted onto the coupling protruded shaft 37, and the positioning pin 13*h*2 is fitted into a hole of the flange 13*a*R1 of the guide member 13R, and small screws 13*a*R2 are threaded into the cleaning frame 13 through the flange 13*a*R1 so that the right guide member 13R is secured to the cleaning frame 13.

In this way, the photosensitive drum 7 is secured to the cleaning frame 13 correctly and firmly.

Figure 36:
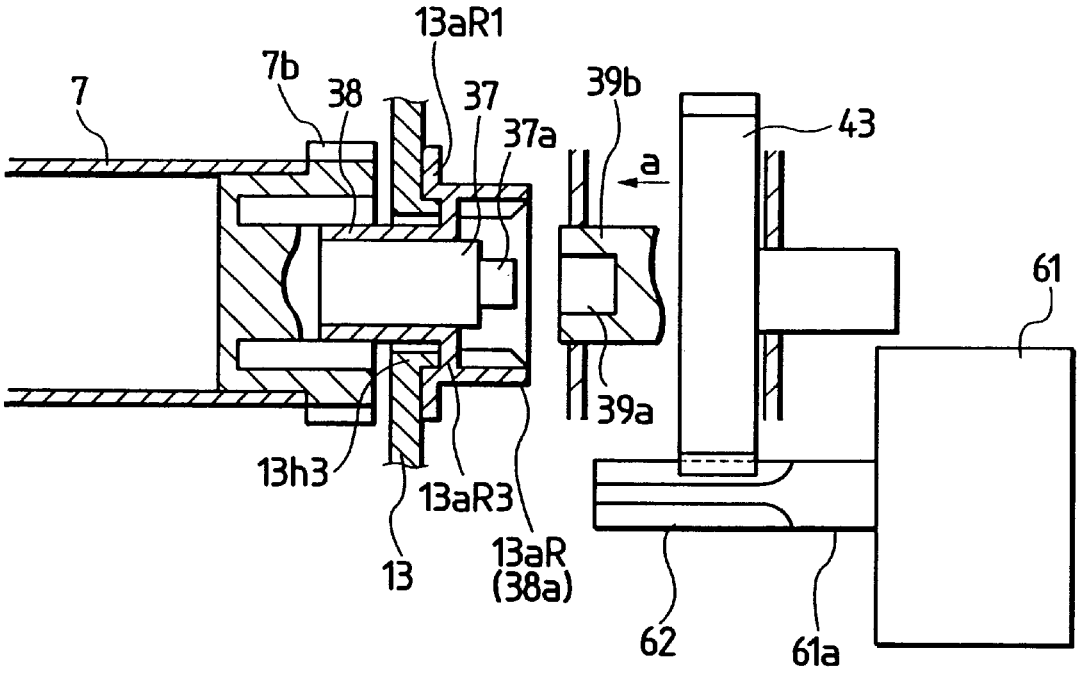
FIG. 36 is a development sectional view showing another embodiment of a drum bearing portion.
Figure 37:
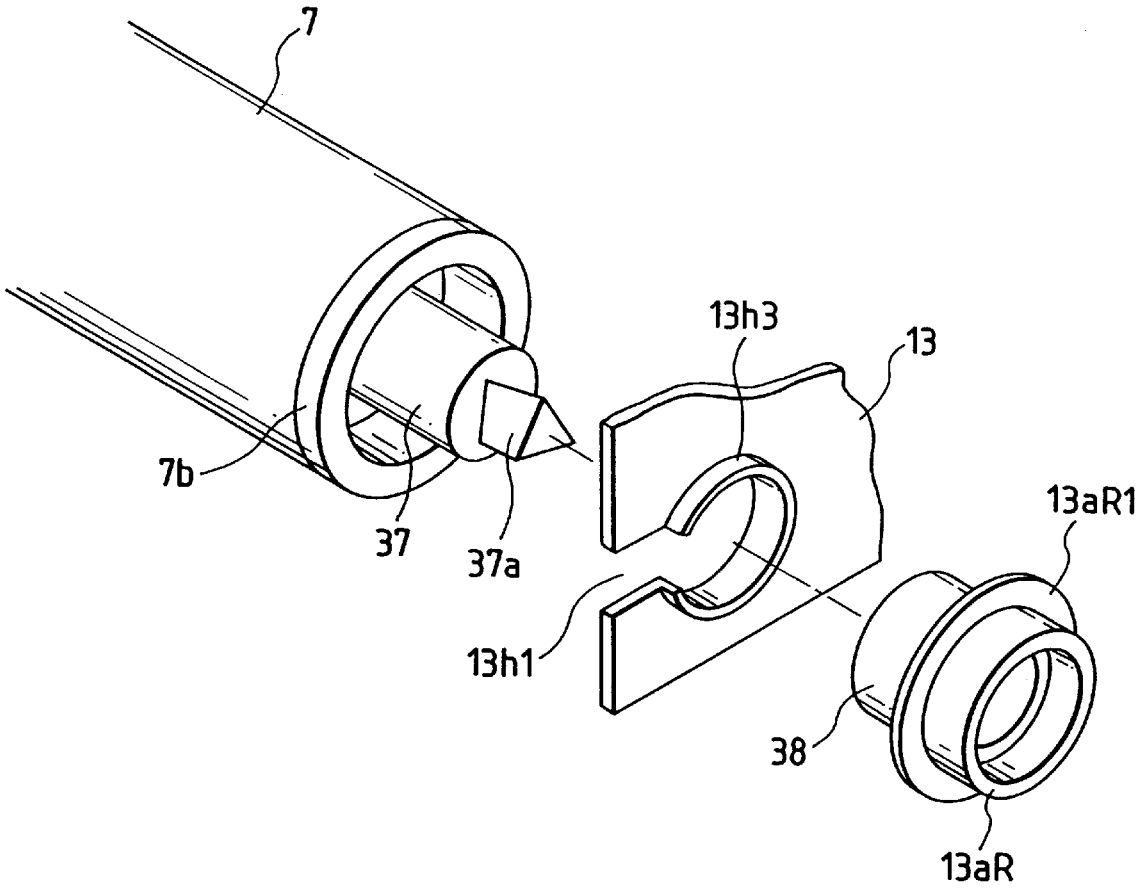
FIG. 37 is a perspective view showing the drum bearing portion schematically.

FIGS. 36 and 37 are elevational sectional development views showing another method for attaching the bearing 38 integral with the right guide member 13R to the cleaning frame 13.

Incidentally, in these figures, the bearing 38 of the photosensitive drum 7 is mainly shown schematically.

As shown in FIG. 36, a circumferential rib 13*h*3 is provided on an outer side edge of the bearing attachment hole 13*h*, and an outer periphery of the rib 13*h*3 is a part of a cylinder. In this example, a periphery of a portion of the right cylindrical guide 13*a*R reaching a flange 13*a*R1 exceeding a circular plate member 13*a*R3 is closely fitted onto the outer periphery of the rib 13*h*3. The outer periphery of the bearing 38 is loosely fitted into the bearing attachment hole 13*h*. (Connection between cleaning frame (also referred to as "drum frame") developing frame)

As mentioned above, the cleaning frame 13 into which the charge roller 8 and the cleaning means 10 are incorporated is joined to the developing frame 12 into which the developing means 9 is incorporated. In general, regarding such joining, the joining between the drum frame 13 into which the electrophotographic photosensitive drum 7 is incorporated and the developing frame 12 into which the developing means is incorporated is at least required as one aspect of the process cartridge B.

Referring to FIGS. 12, 13 and 32, the gist of the joining between the cleaning frame 13 and the developing frame 12 is as follows. Incidentally, in the following description, "right" and "left" are referred to as directions when the recording medium is looked at along the conveying direction from the above.

In a process cartridge, which can detachably be mounted to a body 14 of an electrophotographic image forming apparatus, the process cartridge B comprises an electrophotographic photosensitive drum 7, a developing means 9 for developing a latent image formed on the electrophotographic photosensitive drum 7, a developing frame 12 for supporting the developing means 9, a drum frame 13 for supporting the electrophotographic photosensitive drum 7, a toner frame 11 having a toner containing portion, compression coil springs 22*a* disposed at longitudinal one and the other ends of the developing means 9 and each having one end attached to a portion of the developing frame 12 above the developing means 9 and the other end abutting against the drum frame 13, a first protruded portion (fight arm portion 19) provided on a portion of the developing frame 12 at the longitudinal one and the other ends of the developing means 9 and protruding toward a direction transverse to a longitudinal direction of the developing means 9, a second protruded portion (left arm portion 19), a first opening (right hole 20) provided in the first protruded portion (right arm portion 19), a second opening (left hole 20) provided in the second protruded portion (left arm portion 19), a first engagement portion (right recess 21) provided on a portion of the drum frame 13 above the electrophotographic photosensitive drum 7 at one longitudinal end of the drum frame 13 and adapted to be engaged by the first protruded portion (right arm portion 19), a second engagement portion (left recess 21) provided on a portion of the drum frame 13 above the electrophotographic photosensitive drum 7 at the other longitudinal end of the drum frame 13 and adapted to be engaged by the second protruded portion (left arm portion 19), a third opening (right hole 13*e* shown in FIG. 12) provided in the first engagement portion (right recess 21), a fourth opening (left hole 13*e* shown in FIG. 12) provided in the second engagement portion (left recess 21), a first pass-through member (right connection member 22 shown in FIG. 12) passing through the first opening (right hole 20) and the third opening (right hole 13*e*) to join the drum frame 13 and the developing frame 12 in a condition that the first protruded portion (right arm portion 19) is engaged by the first engagement portion (right recess 21), and a second pass-through member (left connection member 22 shown in FIG. 12) passing through the second opening (left hole 20) and the fourth opening (left hole 13*e*) to join the drum frame 13 and the developing frame 12 in a condition that the second protruded portion (left arm portion 19) is engaged by the second engagement portion (left recess 21).

A method for assembling the developing frame 12 and the cleaning frame 13 having the above-mentioned constructions comprises a first engaging step for engaging the first protruded portion (right arm portion 19) of the developing frame 12 and the first engagement portion (right recess 21) of the drum frame 13 with each other, a second engaging step for engaging the second protruded portion (left arm portion 19) and the second engagement portion (left recess 21) with each other, a first passing step for passing the first pass-through member (right connection member 22) through the first opening (right hole 20) provided in the first protruded portion (right arm porion 19) and the third opening (right hole 13*e*) provided in the first engagement portion (right recess 21) to join the drum frame 13 and the developing frame 12 in a condition that the first protruded portion (right arm portion 19) is engaged by the first engagement portion (right recess 21), and a second passing step for passing the second pass-through member (left connection member 22) through the second opening (left hole 20) provided in the second protruded portion (left arm portion 19) and the fourth opening (left hole 13*e*) provided in the second engagement portion (left recess 21) to join the drum frame 13 and the developing frame 12 in a condition that the second protruded portion (left arm portion 19) is engaged by the second engagement portion (left recess 21). By this method, the developing frame 12 and the drum frame 13 are combined to obtain the process cartridge B.

As mentioned above, the process cartridge can be assembled merely by engaging the developing frame 12 with the drum frame 13 and by passing the connection members 22 through these frames, and can be disassembled merely by removing the connection members 22 and by separating the developing frame 12 from the drum frame 13. Thus, the assembling and disassembling are very facilitated.

In the above arrangement, the developing means has a developing roller 9*c*, and the first engaging step for engaging the first protruded portion and the first engagement portion with each other and the second engaging step for engaging the second protruded portion and the second engagement portion with each other are performed simultaneously, and; when (1) the electrophotographic photosensitive drum 7 is installed substantially in parallel with the developing roller 9*c*, (2) the developing roller 9*c* is shifted along the periphery of the electrophotographic photosensitive drum 7, (3) the developing frame 12 is rotated in response to the shifting movement of the developing roller 9*c*, (4) the first and second protruded portions (both arm portions 19) are entered into the first and second engagement portions (both recesses 21) in response to the rotation of the developing frame 12, respectively, and (5) the first and second protruded portions (both arm portions 19) are engaged by the first and second engagement portions (both recesses 21), respectively, since the arm portions 19 can be approached to the recesses 21 by turning the developing roller 9*c* around the photosensitive drum 7 in a condition that the spacer sub-rollers 9*i* contact both end peripheral surfaces of the photosensitive drum 7, and engagement locations between the arm portions 19 and the recesses 21 are made constant, and, thus, the configurations of the arm portions 19 and the recesses 21 can be determined so that the holes 20 provided in the arm portions 19 of the developing frame 12 can easily be aligned with the holes 13*e* provided in the recesses 21 of the drum frame 13.

As mentioned above, in general, the developing unit D obtained by joining the toner frame 11 and the developing frame 12 is joined to the cleaning unit C in which the charge roller 8 is incorporated into the cleaning frame 13.

When the developing frame 12 and the drum frame 13 are engaged by each other in this way, the openings (holes 20) of the first and second protruded portions are substantially aligned with the openings (holes 13*e*) of the first and second engagement portions so that the pass-through members (connection members 22) can pass through these openings.

Figure 38:
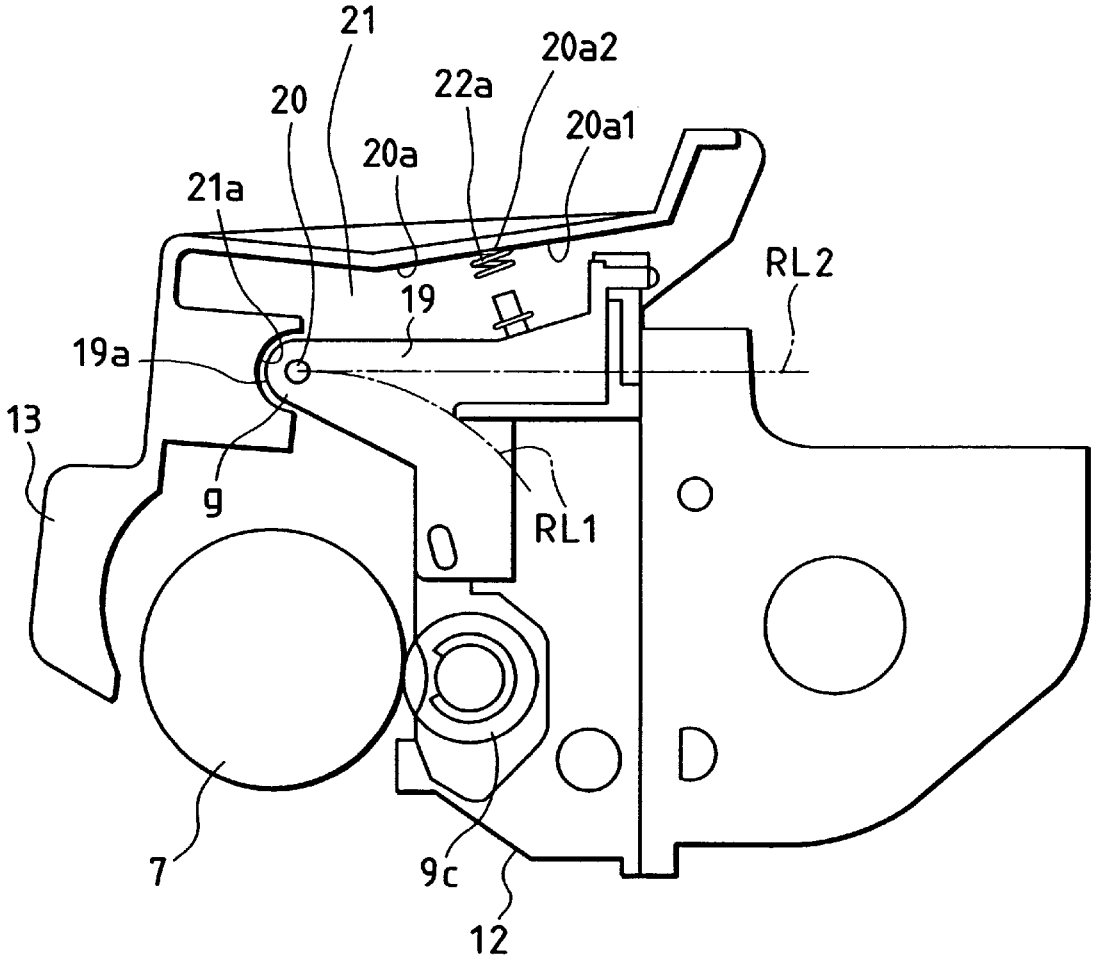
FIG. 38 is an elevational sectional view showing a joined condition between a drum frame and the developing frame.

As shown in FIG. 38, each of the tip ends 19*a* of the arm portions 19 has an arc shape around the corresponding hole 20, and each of the bottoms 21*a* of the recesses 21 has an arc shape around the corresponding hole 13*e*. A radius of the arc shape of the tip end 19*a* of the arm porion 19 is slightly smaller than a radius of the arc shape of the bottom 21*a* of the recess 21. The difference in radius is selected so that, when the tip ends 19*a* of the arm portions 19 abut against the bottoms 21*a* of the recesses 21, the connection member 22 having chamfered ends can easily be inserted into the holes 20 of the arm portions 19 through the holes 13*e* of the drum frame (cleaning frame) 13, and, when the connection members 22 are inserted, arc-shaped gaps g are created between the tip ends 19*a* of the arm portions 19 and the bottoms 21*a* of the recesses 21 to rotatably support the arm portions 19 by the connection members 22. Although the gaps g are shown in an exaggerated manner, in fact, the gap g is smaller than chamferred dimensions on the end of the connection member 22 and on the hole 20.

As shown in FIG. 38, the developing frame 12 and the drum frame 13 are assembled in such a manner that each hole 20 of each arm portion 19 describes a locus RL1 or RL2 or any locus between the loci RL1 and RL2. In this case, the inner surfaces 20*a* of the upper walls of the recesses 21 are continuously inclined so that the compression coil springs 22*a* are gradually compressed. That is to say, it is so selected that, during the assembling, a distance between the attachment position of each compression coil spring 22*a* and the opposed inner surface 20*a* of the upper wall of the recess 21 is gradually decreased. In this example, on the way of the assembling, an upper winding of each compression coil spring 22*a* contacts an inclined portion 20*a*1 of the inner surface 20*a*, in the condition that the joining between the developing frame 12 and the drum frame 13 is completed, and each compression coil spring 22*a* is contacted with a spring seat portion 20*a*2 contiguous to the inclined porion 20*a*1. The compression coil spring 22*a* and the spring seat portion 20*a*2 are perpendicular to each other.

Since the above-mentioned arrangement is adopted, when the developing frame 12 and the drum frame 13 are assembled, it is not required that the compression coil springs 22*a* are incorporated in the compressed condition. Thus, the assembling can easily be performed, and the spacer sub-rollers 9*i* automatically contact the photosensitive drum 7.

Incidentally, the locus RL1 is an arc around the photosensitive drum 7, and the locus RL2 is a substantially straight line in which a distance between the line and the inclined portion 20*a*1 is gradually decreased from the right to the left in FIG. 38.

Figure 39:
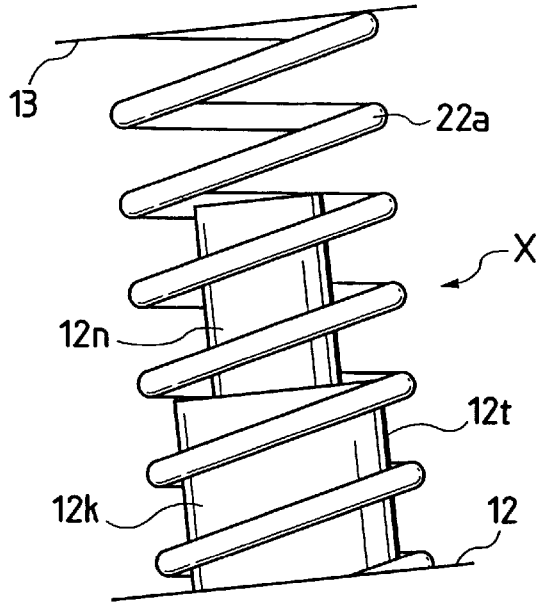
FIG. 39 is a side sectional view showing an attachment portion for a compression spring.

As shown in FIG. 39, the compression coil springs 22*a* are held by the developing frame 12. FIG. 39 is an elevational sectional view showing a root of the arm portion 19 of the developing frame 12 along the process cartridge mounting direction X. Spring holding portions 12*t* extending upwardly are provided on the developing frame 12. Each spring holding portion 12*t* comprises a cylindrical spring fixing root portion 12*k* onto which the inner periphery of the bottom winding of the corresponding compression coil spring 22*a* is press-fitted, and a guide portion 12*n* which has a diameter smaller than that of the fixing portion 12*k* and on which a portion of the compression coil spring 22*a* is inserted.

As shown in FIG. 12, there are provided partition walls 13*t* spaced apart inwardly from outer walls 13*s* of the drum frame 13, and each recess 21 is defined between each partition wall and the corresponding outer wall.

An inner distance of the recess 21 shown in FIG. 12 in the longitudinal direction includes the drum gear 7*b*, and the opposed faces of the outer wall 13*s* and the partition wall 13*t* constituting the right recess 21 are perpendicular to the longitudinal direction, respectively, and the right arm portion 19 at the same side of the developing roller gear 9*k* of the developing frame 12 is closely fitted between these opposed faces. On the other hand, the left recess 21 of the cleaning frame 13 at the same side as the spur gear 7*n* loosely contains the arm portion 19 of the developing frame 12 in the longitudinal direction.

Accordingly, the alignment between the developing frame 12 and the cleaning frame 13 in the longitudinal direction can be effected correctly.

Countermeasure to Non-Opening of Seal Member 100 When Process Cartridge is Mounted When the process cartridge B is mounted to the apparatus body 14, in order to permit the supplying of the toner from the toner frame 11 to the developing frame 12, the seal member 100 adhered to the recessed surface 11*k* to close the opening portion 11*i* of the toner frame 11 is pulled out of the process cartridge B in the longitudinal direction of the process cartridge B together with the grip member 11*t* separated from the toner frame 11, with the result that the seal member 100 is torn along the cut lines 100*c*, thereby unsealing the opening portion 11*i* of the toner frame 11.

Since the unsealing of the seal member 100 is effected by the operator himself, if the process cartridge B is mounted to the apparatus body 14 without removing the seal member 100, not only the desired image output cannot be obtained, but also, since the developing roller 9*c* is rotated in the condition that the toner is not supplied to the developing frame 12, damage of the process cartridge B may occur.

To avoid this, in the illustrated embodiment, the operator is informed of the fact that the seal member 100 is not yet removed before the image output, and, in order to prevent the malfunction of the process cartridge B which may occur if the developing roller 9*c* in the process cartridge B in which the seal member 100 is not removed is rotated for a long term, the unsealing of the seal member 100 can be detected by utilizing a change in potential corresponding to change in electrostatic capacity caused by a change in toner amount within the developing frame 12 between the antenna rod 9*h* and the developing roller 9*c* (detected by the control means 500 (FIG. 41) electrically connected to the toner detecting contact member 126 of the apparatus body 14).

Now, the arrangement capable of detecting the unsealing of the seal member 100 will be fully described.

A relation between the change in potential and the toner amount is shown in FIG. 25. In FIG. 25, the reference numeral 201 denotes an output level when there is no toner between the antenna rod 9*h* and the developing roller 9*c*, i.e., the output level when the seal member 100 is not unsealed. This level is referred to as a first threshold value.

As mentioned above, since the seal member 100 is constituted by laminating the (conductive) aluminium film and the PET (polyethylene telephthalate) films and is disposed near the antenna rod 9*h*, the electrostatic capacity between the antenna rod 9*h* and the developing roller 9*c* is influenced upon the seal member, and the electrostatic capacity becomes considerably great in comparison of the case where the toner exists.

Further, the reference numeral 203 denotes a critical output level in which the residual amount of toner within the toner container 11A can output the proper image having no void, and this level is referred to as a second threshold value. Incidentally, in FIG. 25, the reference numeral 202 denotes an output level in which the residual amount of toner within the toner container 11A may create an image having void.

These predetermined threshold values 201, 203 are previously determined and are stored in the seal member detecting portion 200 and the control portion 500C for detecting the fact that the seal member 100 is not removed (FIG. 41).

Now, the detection of the non-unsealing of the seal member 100 and the non-unsealing informing treatment will be fully explained.

In FIG. 41, if the process cartridge B in which the seal member 100 is not removed is mounted to the apparatus body 14, the electrostatic capacity is measured by the control portion 500C of the control means 500 of the apparatus body 14 through the toner remaining amount detecting contact 122. If the electrostatic capacity is the first threshold value 201, the fact that the seal member 100 is not removed or not unsealed is detected by the seal member detecting portion 200.

When the seal member detecting portion 200 detects the fact that the seal member 100 is not removed, the informing portion 300 informs the oparator of the fact that the seal member 100 is not removed, i.e., the fact that the seal member 100 is not unsealed.

The non-unsealing information may be effected, for example, by displaying a message "Not unsealed" on a display (not shown) of the apparatus body 14 or by generating an alarm sound by an alarm source (not shown) of the apparatus body 14.

Further, when the seal member detecting portion 200 detects the fact that the seal member 100 is not unsealed, an image forming operation controlling portion 400 inhibits the image forming operation of the optical system 1 or the pre-rotation operation of the motor 61. Accordingly, in the condition that the toner is not supplied to the developing roller 9*c*, the excessive rotation of the developing roller 9*c* can be prevented.

During the image forming operation, as a result that the toner within the toner container 11A is gradually consumed, when the electrostatic capacity becomes the second threshold value 203, the control portion 500C informs the operator of the need for replacement of the process cartridge B. The replacement information may be effected, for example, by displaying a message "No toner" on the display or by generating an alarm sound by the alarm source.

Further, when the control portion 500C detects the fact that the electrostatic capacity is a third threshold value smaller than the second threshold value 203, the fact that the process cartridge B is mounted to the apparatus body 14 is detected. That is to say, if a value greater than the third threshold value is detected, the apparatus body recognizes the fact that the cartridge is mounted, and, if a value smaller than the third threshold value is detected, the apparatus body recognizes the fact that the cartridge is mounted, and, if a value smaller than the third threshold value is detected, the apparatus body recognizes the fact that the cartridge is not mounted. Further, if the fact that the process cartridge B is mounted is not detected, the control portion 500C does not start the image forming operation of the apparatus body 14.

Incidentally, information regarding non-mounting of the process cartridge may be effected (for example, by flash of lamp or by displaying "No cartridge").

Second Embodiment

In the aforementioned embodiment, while an example that the means for detecting the fact that the seal member 100 is not removed utilizes the fact that the electrostatic capacity measured by the toner remaining amount detecting portion of the control portion 500C is influenced by the seal member 100 including the conductive material was explained, in a second embodiment of the present invention, an insulation seal member 100 not including conductive material is used. In this case, the electrostatic capacity in a condition that the seal member 100 is not removed (i.e., in a condition that there is no toner in the developing frame 12) is previously sought, and this value may be used as the first threshold value in the previous embodiment. Incidentally, in FIG. 25, the reference numeral 204 denotes the first threshold value in this case.

By using the first threshold value 204, when the fact that the seal member 100 is not unsealed is detected by the seal member detecting portion 200, the informing portion 300 informs the unsealing information and the image forming operation controlling portion 400 inhibits the image forming operation or the pre-rotation in the same manner as the first embodiment.

Accordingly, also in the second embodiment, the fact that the operator is informed that the seal member 100 is not removed, and the malfunction of the process cartridge B, which may occur if the developing roller 9*c* in the process cartridge B, in which the seal member 100 is not removed, is rotated for a long term, can be prevented.

Third Embodiment

In the first and second embodiments, while an example that the means for detecting the fact that the seal member 100 is not removed utilizes the toner remaining amount detecting portion of the control portion 500C was explained, in a third embodiment of the present invention, the apparatus body 14 is provided with a sensor for detecting presence/absence of a seal member 100. In this case, the seal member 100 is formed from material having a high reflection factor such as aluminium film, and an optical sensor of reflection type (not shown) is provided in the apparatus body 14, so that the presence or absence of the seal member 100 on the basis of a difference in the reflection factor between when the seal member 100 is removed and when the seal member 100 is not removed. When the seal member 100 is detected by the optical sensor, the informing portion 300 informs the operator of the unsealing information and the image forming operation controlling portion 400 inhibits the image forming operation or the pre-rotation in the same manner as the first embodiment.

Accordingly, also in the third embodiment, the fact that the operator is informed that the seal member 100 is not removed before the image output, and the malfunction of the process cartridge B, which may occur if the developing roller 9*c* in the process cartridge B, in which the seal member 100 is not removed, is rotated for a long term, can be prevented.

Fourth Embodiment

In the third embodiment, while an example that the presence/absence of the seal member 100 is detected by using the optical sensor was explained, in a fourth embodiment of the present invention, the presence/absence of the grip portion 11*t* removable from the toner frame 11 is detected. In this case, the presence/absence of seal member 100 can be detected by providing a switch (not shown) which can be turned ON or OFF in accordance with the presence/absence of the grip portion 11*t* within the apparatus body 14.

Further, since the presence/absence of seal member 100 is detected by detecting the presence/absence of the grip portion 11*t*, any material can be used for forming the seal member 100.

When the seal member 100 is detected by the switch, the informing portion 300 informs the operator of the unsealing information and the image forming operation controlling portion 400 inhibits the image forming operation or the pre-rotation in the same manner as the first embodiment.

Accordingly, also in the fourth embodiment, the operator is informed of the fact that the seal member 100 is not removed before the image output, and the malfunction of the process cartridge B, which may occur if the developing roller 9*c* in the process cartridge B in which the seal member 100 is not removed, is rotated for a long term, can be prevented.

Other Embodiments

In the above-mentioned embodiments, while an example that the transmission means for transmitting the driving force from the apparatus body 14 to the photosensitive drum 7 of the process cartridge B includes the coupling comprised of the coupling protruded shaft 37 and the coupling recessed shaft 39*b* was explained, as a transmission means for transmitting the driving force from the apparatus body 14 to the photosensitive drum 7 of the process cartridge B, gears may be used.

Further, in the first and second embodiments, while an example that the seal member 100 including the aluminium film is used was explained, the present invention is not limited to such an example, but the seal member may include other material so long as the same advantage can be obtained.

Further, in the above-mentioned embodiments, while an example that the process cartridge for forming a mono-color image is used was explained, the present invention can be applied to a process cartridge in which a plurality of developing means are provided to form plural color image (for example, two-color image, three-color image or full-color image).

The electrophotographic photosensitive member is not limited to the photosensitive drum 7, but, for example, the followings can be included. First of all, photo-conductive body is used as a photosensitive body, and the photo-conductive body may be, for example, amorphous silicon, amorphous selenium, zinc oxide, titanium oxide, or organic photo-conductor (OPC). Further, as a structure on which the photosensitive body is mounted, for example, a drum or a belt may be used, and, for example, in a photosensitive member of a drum type, a photo-conductive body is deposited or coated on an aluminium alloy cylinder.

Further, the developing method may be a publicly known two-component magnet brush developing method, a cascade developing method, a touch-down developing method or a cloud developing method.

In the illustrated embodiments, while an example that the charge means of so-called contact charge type is used was explained, a conventional charge means in which a U-shaped three walls formed from tungsten wires are covered by metallic (for example, aluminium) shields and positive or negative ions generated by applying high voltage to the tungsten wires are shifted to the surface of the photosensitive drum to uniformly charge the surface of the photosensitive drum may be used.

The charge means may be of a blade type (charge blade), a pad type, a block type, a rod type or a wire type, as well as a roller type.

In the cleaning method for removing the residual toner remaining on the photosensitive drum, a blade, a fur brush or a magnet brush may be used.

The process cartridge incorporates therein the electrophotographic photosensitive member and at least one process means. Accordingly, as well as the above-mentioned one, the process cartridge may incorporate therein an electrophotographic photosensitive member, a developing means and a charge means as a unit which can detachably be mounted to an image forming apparatus, or may incorporate therein an electrophotographic photosensitive member and a developing means as a unit which can detachably be mounted to an image forming apparatus, or may incorporate therein an electrophotographic photosensitive member, a developing means and a cleaning means as a unit which can detachably be mounted to an image forming apparatus.

What is claimed is:

1. A cartridge detachably attachable to main body of an image forming apparatus, comprising:

a developing device for developing an electrostatic image formed on an image bearing member with developer, said developing device including:

a developer containing container for containing the developer;

a developing container having a developer bearing member for bearing and conveying the developer to a developing position where the electrostatic image is developed, the developer being supplied from said developer containing container to said developing container through an opening portion;

a removable seal member for covering said opening portion, wherein said seal member has a conductive portion; and a detecting portion for detecting an amount of the developer within said developing container, wherein the main body of said image forming apparatus detects whether said seal member is removed or not in dependence upon the presence or absence of said conductive portion when said detecting portion is detected by the main body of said image forming apparatus.

2. A cartridge according to claim 1, wherein said detecting portion has a conductive member, and the main body of said image forming apparatus detects whether said seal member is removed or not in dependence upon a change in voltage between said conductive member and said developer bearing member.

3. A cartridge according to claim 1, wherein said cartridge comprises said image bearing member.

4. A cartridge according to claim 3, wherein said image bearing member is an electrophotographic photosensitive member.

5. A cartridge detachably attachable to a main body of an image forming apparatus, comprising:

a developing device for developing an electrostatic image formed on an image bearing member with developer, said developing device including:

a developer containing container for containing the developer;

a developing container having a developer bearing member for bearing and conveying the developer to a developing position where the electrostatic image is developed, the developer being supplied from said developer containing container to said developing container through an opening portion; and a removable seal member for covering said opening portion, said seal member having a light reflecting portion, and the main body of said image forming apparatus detecting whether said seal member is removed or not by detecting the presence or absence of said light reflecting portion by the main body of said image forming apparatus.

6. A cartridge according to claim 5, wherein said cartridge comprises said image bearing member.

7. A cartridge according to claim 6, wherein said image bearing member is an electrophotographic photosensitive member.

8. A cartridge detachably attachable to a main body of an image forming apparatus, comprising:

a developing device for developing an electrostatic image formed on an image bearing member with developer, said developing device including:

a developer containing container for containing the developer;

a developing container having a developer bearing member for bearing and conveying the developer to a developing position where the electrostatic image is developed, the developer being supplied from said developer containing container to said developing container through an opening portion; and a removable seal member for covering said opening portion;

wherein said cartridge has a grip portion removable from said developing device to remove said seal member, and the main body of said image forming apparatus detects whether said seal member is removed or not by detecting whether said grip portion is removed or not by the main body of said image forming apparatus.

9. A cartridge according to claim 8, wherein said cartridge comprises said image bearing member.

10. A cartridge according to claim 9, wherein said image bearing member is an electrophotographic photosensitive member.

11. An image forming apparatus comprising:

mounting means for detachably mounting a cartridge to main body of said image forming apparatus detachably attachable;

wherein said cartridge has a developing device for developing an electrostatic image formed on an image bearing member with developer, said developing device including:

a developer containing container for containing the developer;

a developing container having a developer bearing member for bearing and conveying the developer to a developing position where the electrostatic image is developed, the developer being supplied from said developer containing container to said developing container through an opening portion;

a removable seal member for covering said opening portion, wherein said seal member has a conductive portion; and a detecting portion for detecting an amount of the developer within said developing container, and wherein said image forming apparatus further comprises detecting means for detecting whether said seal member is removed or not in dependence upon the presence or absence of said conductive portion by using said detecting portion.

12. An image forming apparatus according to claim 11, wherein said detecting portion has a conductive member, and said detecting means detects a voltage between said conductive member and said developer bearing member, and detection of whether said seal member is removed or not is effected in dependence upon a change in the voltage.

13. An image forming apparatus according to claim 12, wherein said detecting means detects the fact that said seal member is not removed when the voltage between said conductive member and said developer bearing member is greater than a predetermined value and detects the fact that said seal member is removed when the voltage is smaller than said predetermined value.

14. An image forming apparatus according to claim 11, wherein said seal member is insulative and said detecting portion has a conductive member, and said detecting means detects a voltage between said conductive member and said developer bearing member, and detection of whether said seal member is removed or not is effected in dependence upon a change in the voltage.

15. An image forming apparatus according to claim 14, wherein said detecting means detects the fact that said seal member is not removed when the voltage between said conductive member and said developer bearing member is smaller than a predetermined value and detects the fact that said seal member is removed when the voltage is greater than said predetermined value.

16. An image forming apparatus according to claim 11, further comprising an informing means for informing the operator of the fact that said seal member is not removed when the fact is detected by said detecting means.

17. An image forming apparatus according to claim 16, further comprising control means for controlling said apparatus to inhibit an image forming operation of said image forming apparatus when said detecting means detects the fact that said seal member is not removed.

18. An image forming apparatus according to claim 11, wherein said detecting means indirectly detects whether said seal member is removed or not by using said detecting portion.

19. An image forming apparatus according to any one of claims 11 and 12–17, wherein said cartridge has said image bearing member.

20. An image forming apparatus according to claim 19, wherein said image bearing member is an electrophotographic photosensitive member.

21. An image forming apparatus comprising:

a mounting means for detachably mounting a cartridge to a body of said image forming apparatus, wherein said cartridge has a developing device for developing an electrostatic image formed on an image bearing member with developer, said developing device including:

a developer containing container for containing the developer;

a developing container having a developer bearing member for bearing and conveying the developer to a developing position where the electrostatic image is developed, the developer being supplied from said developer containing container to said developing container through an opening portion; and a removable seal member for covering said opening portion and having a light reflecting portion; and wherein said image forming apparatus further comprises a detecting means for detecting whether said seal member is removed or not by detecting the presence or absence of said light reflecting portion.

22. An image forming apparatus according to claim 21, further comprising an informing means for informing an operator of the fact that said seal member is not removed when said fact is detected by said detecting means.

23. An image forming apparatus according to claim 22, further comprising control means for controlling said apparatus to inhibit an image forming operation of said image forming apparatus when said detecting means detects the fact that said seal member is not removed.

24. An image forming apparatus according to any one of claims 21 to 23, wherein said cartridge has said image bearing member.

25. An image forming apparatus according to claim 24, wherein said image bearing member is an electrophotographic photosensitive member.

26. An image forming apparatus comprising:

a mounting means for detachably mounting a cartridge to a body of said image forming apparatus, wherein said cartridge has (a) a developing device for developing an electrostatic image formed on an image bearing member with developer, said developing device including:

a developer containing container for containing the developer, a developing container having a developer bearing member for bearing and conveying the developer to a developing position where an electrostatic latent image is developed, the developer being supplied from said developer containing container to said developing container through an opening portion, and a removable seal member for covering said opening portion; and (b) a grip portion removable from said developing device to remove said seal member, and wherein said image forming apparatus further comprises a detecting means for detecting whether said seal member is removed or not by detecting whether said grip portion is removed or not.

27. An image forming apparatus according to claim 26, further comprising an informing means for informing an operator of the fact that said seal member is not removed when said fact is detected by said detecting means.

28. An image forming apparatus according to claim 29, further comprising control means for controlling said apparatus to inhibit an image forming operation of said image forming apparatus when said detecting means detects the fact that said seal member is not removed.

29. An image forming apparatus according to any one of claims 26 to 28, wherein said cartridge has said image bearing member.

30. An image forming apparatus according to claim 29, wherein said image bearing member is an electrophotographic photosensitive member.

* * * * *

UNITED STATES PATENT AND TRADEMARK OFFICE

CERTIFICATE OF CORRECTION

PATENT NO. : 6,137,970
DATED : October 24, 2000
INVENTOR(S) : Yoshikazu Sasago

It is certified that error appears in the above-identified patent and that said Letters Patent is hereby corrected as shown below:

Title page, Item [54], Column 1, line1,
Item [54], "DETACHABLE" should read -- ATTACHABLE --.

Column 1,
Line 9, "to," should read -- to --.
Line 10, "ratus" should read -- ratus, --.
Line 19, "contained" should read -- container --.
Line 32, "used" should read -- user --.
Line 49, "inconvenience" should read -- inconvenience, --.

Figures 23A, 23B:
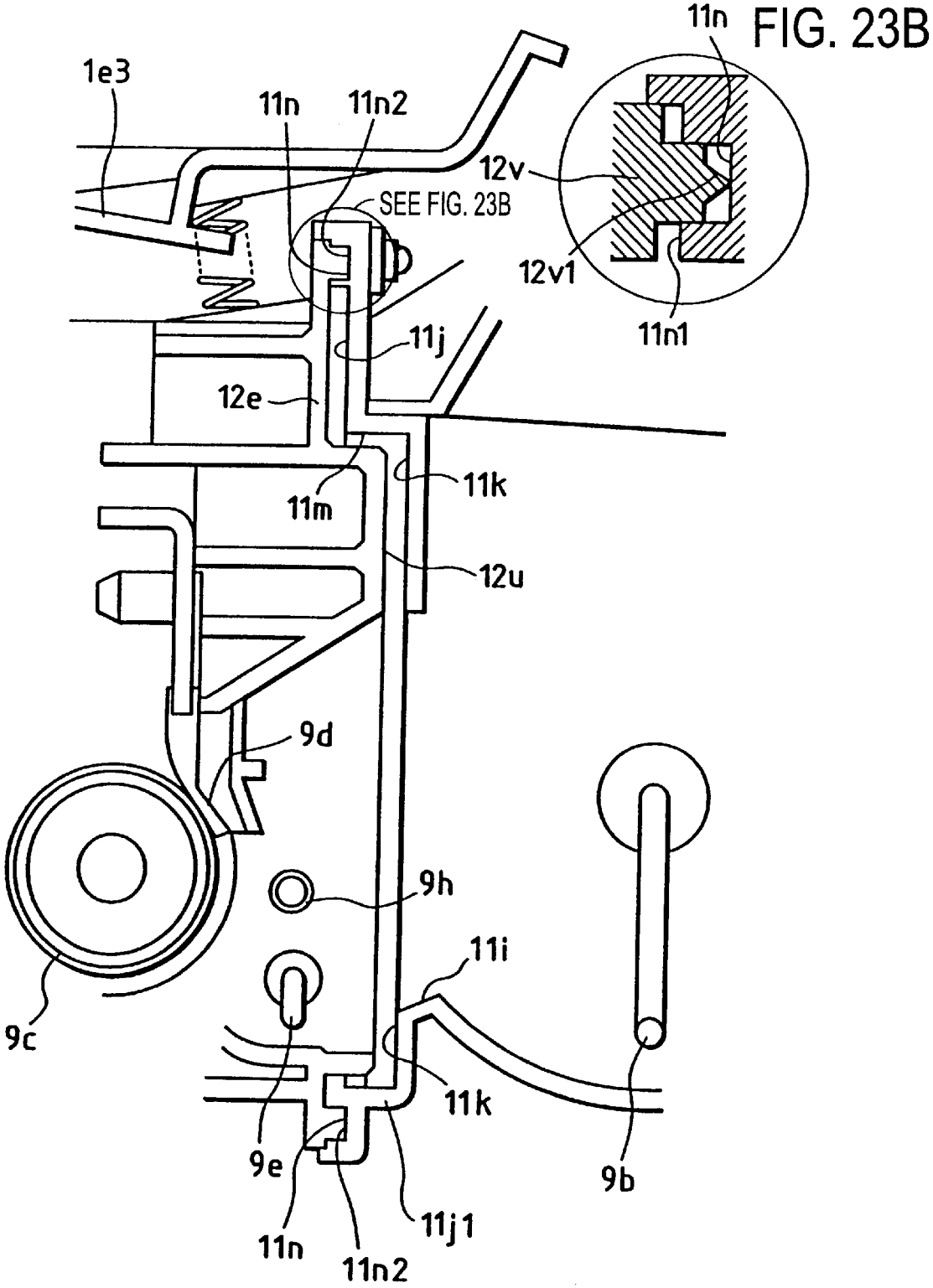
FIG. 23 is an elevational sectional view of a toner seal portion of FIG. 21.
Figure 24:
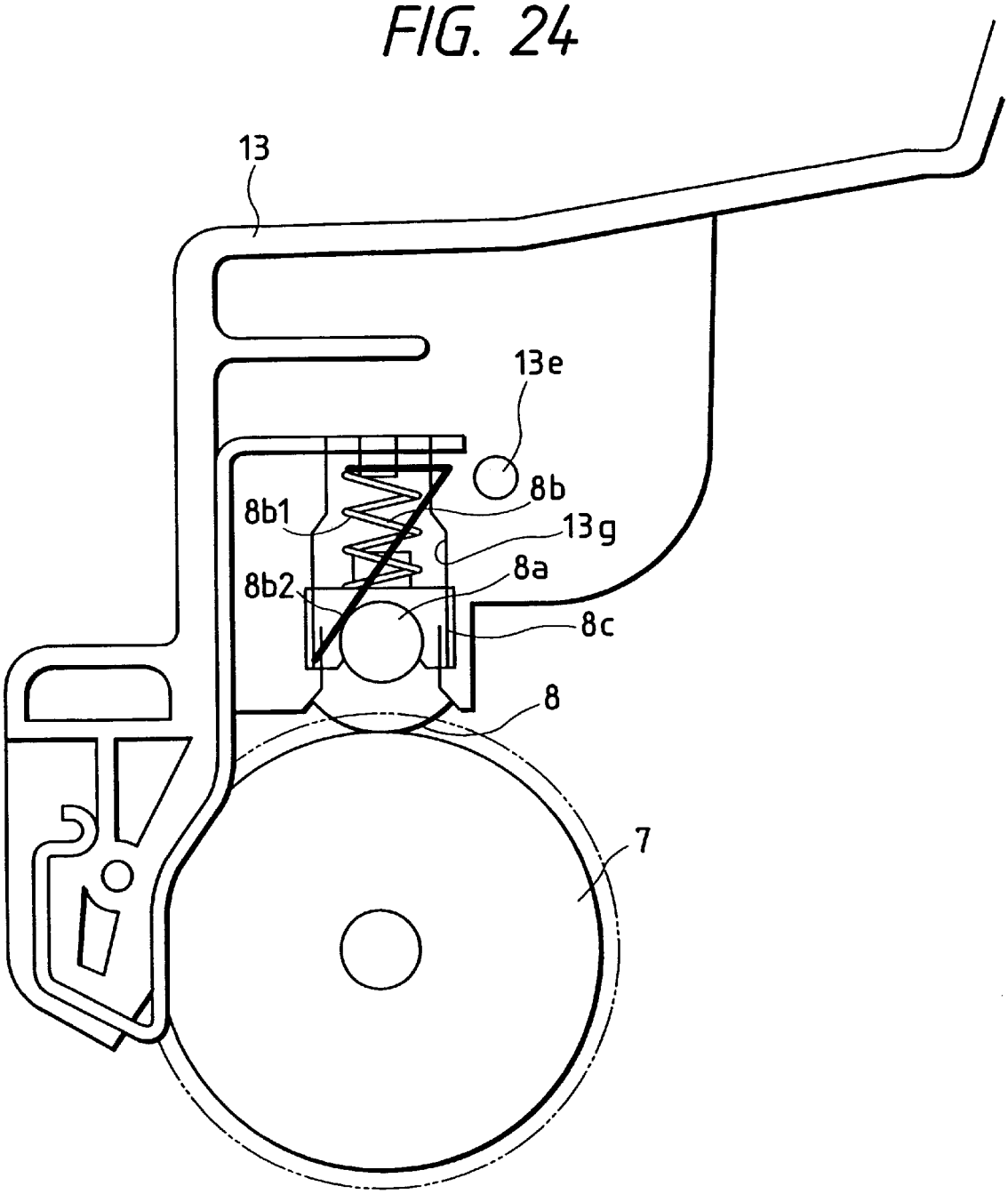
FIG. 24 is an elevational sectional view showing a supporting device for a charge roller portion.

Column 2,
Line 54, "FIG. 23 is" should read -- FIGS. 23A and 23B are --.
Line 60, "FIG. 26 is" should read -- FIGS. 26A and 26B are --.

Column 5,
Line 4, "the guide" should read -- the convey guide --.
Line 4, "pairs" should read -- the pairs --.
Line 24, "and" should read -- and the --.
Line 32, "onto" should be deleted.

Column 7,
Line 9, "recording medium-conveying" should read -- recording-medium conveying --.

Column 9,
Line 39, "coincide" should read -- coincide with --.

Column 10,
Line 66, "to end" should read -- to an end --.

Column 13,
Line 28, "Thee" should read -- The --.

Column 14,
Line 22, "a" should read -- the --.

Column 15,
Line 34, "is" should be deleted.
Line 42, "is protruded" should read -- protrudes --.

UNITED STATES PATENT AND TRADEMARK OFFICE

CERTIFICATE OF CORRECTION

PATENT NO. : 6,137,970
DATED : October 24, 2000
INVENTOR(S) : Yoshikazu Sasago

It is certified that error appears in the above-identified patent and that said Letters Patent is hereby corrected as shown below:

Column 16,
Line 33, "is" should be deleted, and "with" should be deleted.
Line 36, "protruded" should read -- protruding --.
Line 40, "is contacted" should read -- contacts --.
Line 41, "with" should be deleted.

Column 17,
Line 14, "cover" should read -- covering --.
Lines 38, 39, 50 and 54, "is" should be deleted.

Column 19,
Line 23, "contracts with" should read -- contacts --.

Column 20,
Line 23, "the" should read -- at the --.
Lines 41 and 56, "are" should be deleted.
Line 47, "be" should be deleted.

Column 23,
Line 12, "is" should be deleted.
Line 13, "28).)" should read -- 28). --.

Column 24,
Line 30, "not" should read -- and do not --.

Column 26,
Line 65, "lange" should read -- flange --.

Column 27,
Line 26m, "frame)" should read -- frame). --.

Column 29,
Line 37, "porion" should read -- portion --.
Line 50, "chamferred" should read -- chamfered --.
Line 67, "is contacted with" should read -- contacts --.

Column 31,
Line 34, "void." should read -- a void. --.
Line 54, "oparator" should read -- operator --.

UNITED STATES PATENT AND TRADEMARK OFFICE

CERTIFICATE OF CORRECTION

PATENT NO. : 6,137,970
DATED : October 24, 2000
INVENTOR(S) : Yoshikazu Sasago

It is certified that error appears in the above-identified patent and that said Letters Patent is hereby corrected as shown below:

Column 33,
Line 40, "B" should read -- B, --.

Column 34,
Line 1, "followings" should read -- following --.
Line 43, "to" should read -- to a --.

Column 35,
Line 49, "portion;" should read -- portion, --.
Line 63, "to" should read -- to a --.

Column 38,
Line 25, "claim 29," should read -- claim 27, --.

Signed and Sealed this

Nineteenth Day of March, 2002

*Attest:*

*Attesting Officer*

JAMES E. ROGAN
*Director of the United States Patent and Trademark Office*